US012520885B2

(12) United States Patent
Uchida

(10) Patent No.: US 12,520,885 B2
(45) Date of Patent: Jan. 13, 2026

(54) COOLING GARMENT, COOLING GARMENT SET, AND METHOD FOR WEARING THE COOLING GARMENT SET

(71) Applicant: BIGBORN CO., LTD., Hiroshima (JP)

(72) Inventor: Takayuki Uchida, Hiroshima (JP)

(73) Assignee: BIGBORN CO., LTD., Hiroshima (JP)

( * ) Notice: Subject to any disclaimer, the term of this patent is extended or adjusted under 35 U.S.C. 154(b) by 0 days.

(21) Appl. No.: 18/859,482

(22) PCT Filed: Dec. 20, 2023

(86) PCT No.: PCT/JP2023/045714

§ 371 (c)(1),
(2) Date: Oct. 23, 2024

(87) PCT Pub. No.: WO2024/176597

PCT Pub. Date: Aug. 29, 2024

(65) Prior Publication Data

US 2025/0255363 A1 Aug. 14, 2025

(30) Foreign Application Priority Data

Feb. 24, 2023 (JP) ..... 2023-027109
Aug. 9, 2023 (JP) ..... 2023-129934
Nov. 1, 2023 (JP) ..... 2023-187750

(51) Int. Cl.
*A41D 13/005* (2006.01)
*A41D 1/04* (2006.01)

(52) U.S. Cl.
CPC ..... *A41D 13/0056* (2013.01); *A41D 1/04* (2013.01)

(58) Field of Classification Search
CPC ..... A41D 13/0056; A41D 1/04
See application file for complete search history.

(56) References Cited

U.S. PATENT DOCUMENTS 476,503 A * 6/1892 Woodward
3,452,554 A * 7/1969 Smith ..... A41D 13/0055 62/259.3

(Continued)

FOREIGN PATENT DOCUMENTS

CN 115190770 A 10/2022
JP S6381810 U 5/1988

(Continued)

OTHER PUBLICATIONS

"International Preliminary Report on Patentability", Patent Cooperation Treaty, Aug. 15, 2025, pp. 1-6.

*Primary Examiner* — Tajash D Patel
(74) *Attorney, Agent, or Firm* — NKL Law; Allen Xue

(57) ABSTRACT

A cooling garment includes a front side material and a back side material arranged on a front side or a back side of a body. The front side material or the back side material has an inner layer arranged closest to the body that is waterproof, an outer layer arranged farthest from the body that is moisture permeable and an intermediate layer made of a nonwoven fabric arranged between the inner layer and the outer layer and that absorbs water and stores the absorbed water. A water inlet that supplies the water to the intermediate layer is arranged at an upper part of the front side material or the back side material and a drainage outlet that drains the water is arranged at a lower part of the front side material or the back side material when the cooling garment is attached to the body.

4 Claims, 48 Drawing Sheets

(56) References Cited

U.S. PATENT DOCUMENTS

| | | | | |
|---|---|---|---|---|
| 6,125,645 | A * | 10/2000 | Horn | A62B 17/005 2/458 |
| 9,635,889 | B1 * | 5/2017 | Copeland | A41D 13/0056 |
| 2002/0073481 | A1 * | 6/2002 | Creagan | A41D 13/0056 2/458 |
| 2014/0305148 | A1 * | 10/2014 | Paull | A41D 13/0056 62/259.3 |
| 2014/0318154 | A1 * | 10/2014 | Kobayashi | F25D 7/00 62/3.5 |
| 2021/0219634 | A1 * | 7/2021 | Rykaczewski | A42B 1/008 |
| 2025/0228308 | A1 * | 7/2025 | Fan | A41D 27/28 |

FOREIGN PATENT DOCUMENTS

| | | | | |
|---|---|---|---|---|
| JP | H04118409 | U | 10/1992 | |
| JP | 2001040512 | A | 2/2001 | |
| JP | 3118697 | U | 2/2006 | |
| JP | 6008301 | B2 | 10/2016 | |
| JP | 2021110064 | A | 8/2021 | |
| JP | 3239820 | U | 11/2022 | |
| WO | WO-0128373 | A1 * | 4/2001 | A45F 3/20 |
| WO | 2013105478 | A1 | 7/2013 | |
| WO | WO-2020263090 | A1 * | 12/2020 | A41D 31/102 |
| WO | WO-2021179955 | A1 * | 9/2021 | A41D 13/0056 |

* cited by examiner

COOLING GARMENT, COOLING GARMENT SET, AND METHOD FOR WEARING THE COOLING GARMENT SET

TECHNICAL FIELD

Present disclosure relates to a cooling garment that cools a body by vaporizing water absorbed by a nonwoven fabric, a cooling garment set and a cooling garment set.

BACKGROUND ART

As a countermeasure against outdoor heat and heat stroke in summer, a cooling garment is known which is a vest or other garment that can be worn by a person or an animal such as a dog, and in which a water absorbent material absorbing the water is provided in a shape of a surface and which can cool the body by absorbing heat of the body due to evaporating the water (see Patent document 1).

In Patent document 1, a water inlet is arranged at an upper part of the cooling garment, a PET bottle is inserted into the water inlet, and the cold water from the PET bottle is poured from the water inlet to the water absorbent material inside the cooling garment. The heat is absorbed by the vaporization of the cold water poured and the body is cooled. Here, the cold water is water with a temperature lower than an ambient temperature around the body.

PRIOR ART DOCUMENTS

Patent Documents

Patent Document 1: Japanese Patent No. 6008301

SUMMARY OF INVENTION

Technical Problem

In the cooling garment of the patent document 1, the cold water absorbed in the absorbent material evaporates, after then temperature of the cold water in the absorbent material reaches room temperature (room temperature is ambient temperature around the body or close to ambient temperature around the body). At that time, not all of the cold water absorbed by the absorbent material evaporates and some water remains in the cooling garment.

Consequently, when the cold water in the absorbent material reaches room temperature, even if more cold water is added from the water inlet, only a small amount of the cold water is absorbed into the absorbent material, so a cooling effect at the second and subsequent pours of the water almost can be obtained.

The Patent Document 1 has such a problem.

The cooling garment, the cooling garment set and the method for wearing the cooling garment set of the present disclosure can solve the above problem.

Solution to Problem

A cooling garment according to an aspect of the present disclosure includes

- a front side material arranged on a front side of a body; and
- a back side material arranged on a back side of the body, wherein the front side material or the back side material has

- an inner layer arranged closest to the body, which is waterproof;
  - an outer layer arranged farthest from the body, which is moisture permeable; and
  - an intermediate layer made of a nonwoven fabric that is arranged between the inner layer and the outer layer, and that absorbs water and stores the absorbed water,
  - wherein a water inlet that supplies the water to the intermediate layer is arranged on an upper part of the front side material or the back side material and a drainage outlet that drains the water absorbed by the intermediate layer is arranged on a lower part of the front side material or the back side material when the cooling garment is attached to the body.

A cooling garment according to another aspect of the present disclosure includes

- a front side material arranged on a front side of a body; and
- a back side material arranged on a back side of the body, wherein the front side material or the back side material has
  - an inner layer arranged closest to the body, which is waterproof;
  - an outer layer arranged farthest from the body, which is moisture permeable; and an intermediate layer made of a nonwoven fabric that is arranged between the inner layer and the outer layer, and that absorbs water and stores the absorbed water,
- wherein the front side material or the back side material has a slope pressing bonding part that is a part where the outer layer adheres to the inner layer,
- wherein the slope pressing bonding part is inclined with respect to a horizontal line perpendicular to a centerline of a longitudinal direction of the cooling garment so that the water moves from an upper part of the cooling garment toward a lower part of the cooling garment by gravity when the cooling garment is attached to the body.

A cooling garment including according to yet another aspect of the present disclosure includes

- a front side material arranged on a front side of a body; and
- a back side material arranged on a back side of the body, wherein the front side material is constituted of a mesh, wherein the back side material has
  - an inner layer arranged closest to the body, which is waterproof;
  - an outer layer arranged farthest from the body, which is moisture permeable; and
  - an intermediate layer made of a nonwoven fabric that is arranged between the inner layer and the outer layer, and that absorbs water and stores the absorbed water,
- wherein the front side material or the back side material includes a pressing bonding part that is a part where the outer layer adheres to the inner layer,
- wherein the intermediate layer is surrounded by the pressing bonding part.

A cooling garment including according to yet another aspect of the present disclosure includes

- a front side material arranged on a front side of a body; and
- a back side material arranged on a back side of the body, wherein the front side material is constituted of a mesh, wherein the back side material has an inner layer arranged closest to the body, which is waterproof;

an outer layer arranged farthest from the body, which is moisture permeable; and an intermediate layer made of a nonwoven fabric that is arranged between the inner layer and the outer layer, and that absorbs water and stores the absorbed water, wherein the front side material or the back side material includes a pressing bonding part that is a part where the outer layer adheres to the inner layer, wherein the intermediate layer is surrounded by the pressing bonding part.

A method according to an aspect of the present disclosure for wearing a cooling garment set includes a cooling garment and an air conditioning function garment, the cooling garment comprising:

a front side material arranged on a front side of a body; and a back side material arranged on a back side of the body, wherein the front side material or the back side material has an inner layer arranged closest to the body, which is waterproof;

an outer layer arranged farthest from the body, which is moisture permeable; and an intermediate layer made of a nonwoven fabric that is arranged between the inner layer and the outer layer, and that absorbs water and stores the absorbed water, wherein a water inlet that supplies the water to the intermediate layer is arranged on an upper part of the front side material or the back side material and a drainage outlet that drains the water absorbed by the intermediate layer is arranged on a lower part of the front side material or the back side material when the cooling garment is attached to the body, wherein the method including:

(i) wearing the air conditioning function garment with a fan stopped over the cooling garment, and then rotating the fan of the air conditioning garment; or (ii) wearing the air conditioning function garment with the fan rotating over the cooling garment.

Advantageous Effects of Invention

A cooling garment of one aspect of the present disclosure can lower the body temperature of the body without using electric power.

In addition, the cooling garment of one aspect of the present disclosure can easily repeat operations of pouring cold water and draining water. As a result, the above operations can be repeated multiple times a day to lower the body temperature throughout the day.

In addition, wearing an air conditioning function garment over the cooling garment of one aspect of the present disclosure can further lower the body temperature faster with its synergistic effect.

DESCRIPTION OF EMBODIMENTS

Figure 1:
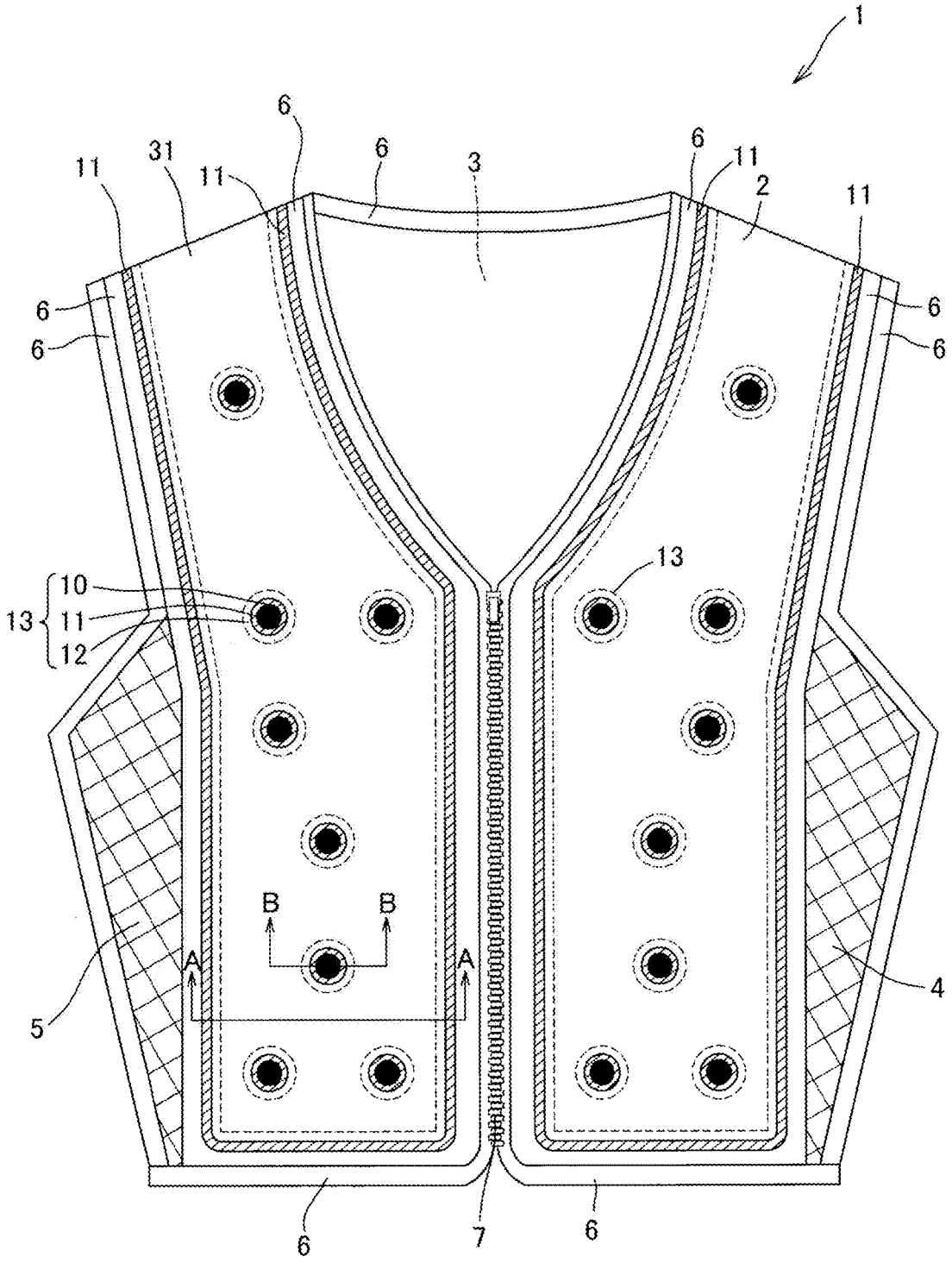
FIG. 1 is a front view of a schematic configuration of a cooling garment in Embodiment 1.

Hereinafter, more specific embodiments of the present disclosure will be described. However, unnecessarily detailed description may be omitted. For example, a detailed description of a well-known matter and a repeated description of substantially the same configuration may be omitted. This is to avoid unnecessary redundancy of the following description and to facilitate understanding of those skilled in the art. Note that the present inventors provide the accompanying drawings and the following description in order for those skilled in the art to fully understand the present disclosure, and do not intend to limit the subject matter described in the claims by the accompanying drawings and the following description. In the following description, the same or similar components are denoted by the same reference numerals.

First, an overall outline of a cooling garment 1 (also referred to as a water cooling garment) will be described, next a detailed description of each component will be described.

(An Entirety of the Cooling Garment)

The following is a schematic description of the cooling garment 1 that illustrates one aspect of the present disclosure, using the drawings.

Figure 2:
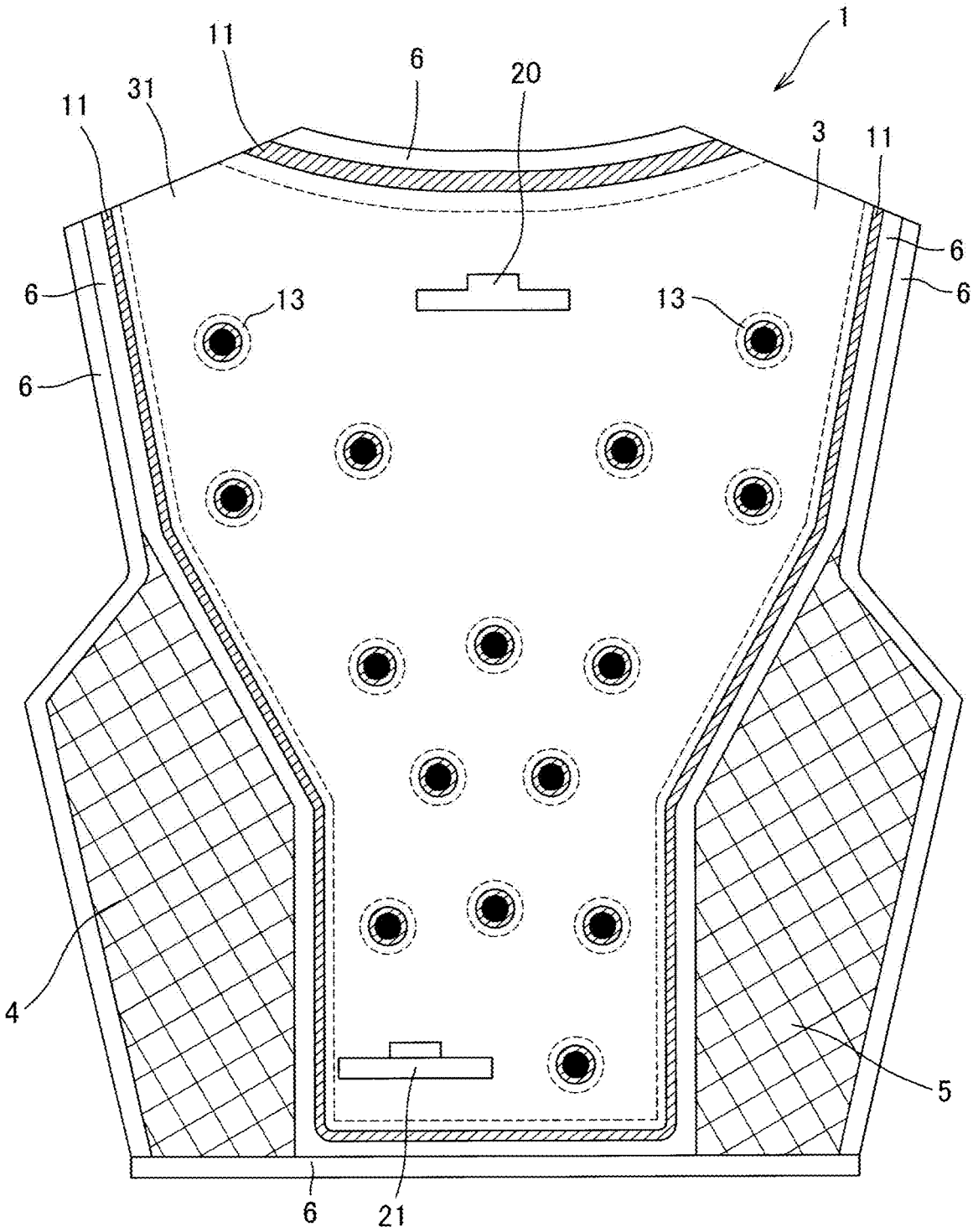
FIG. 2 is a rear view of a schematic configuration of the cooling garment in Embodiment 1.
Figure 3:
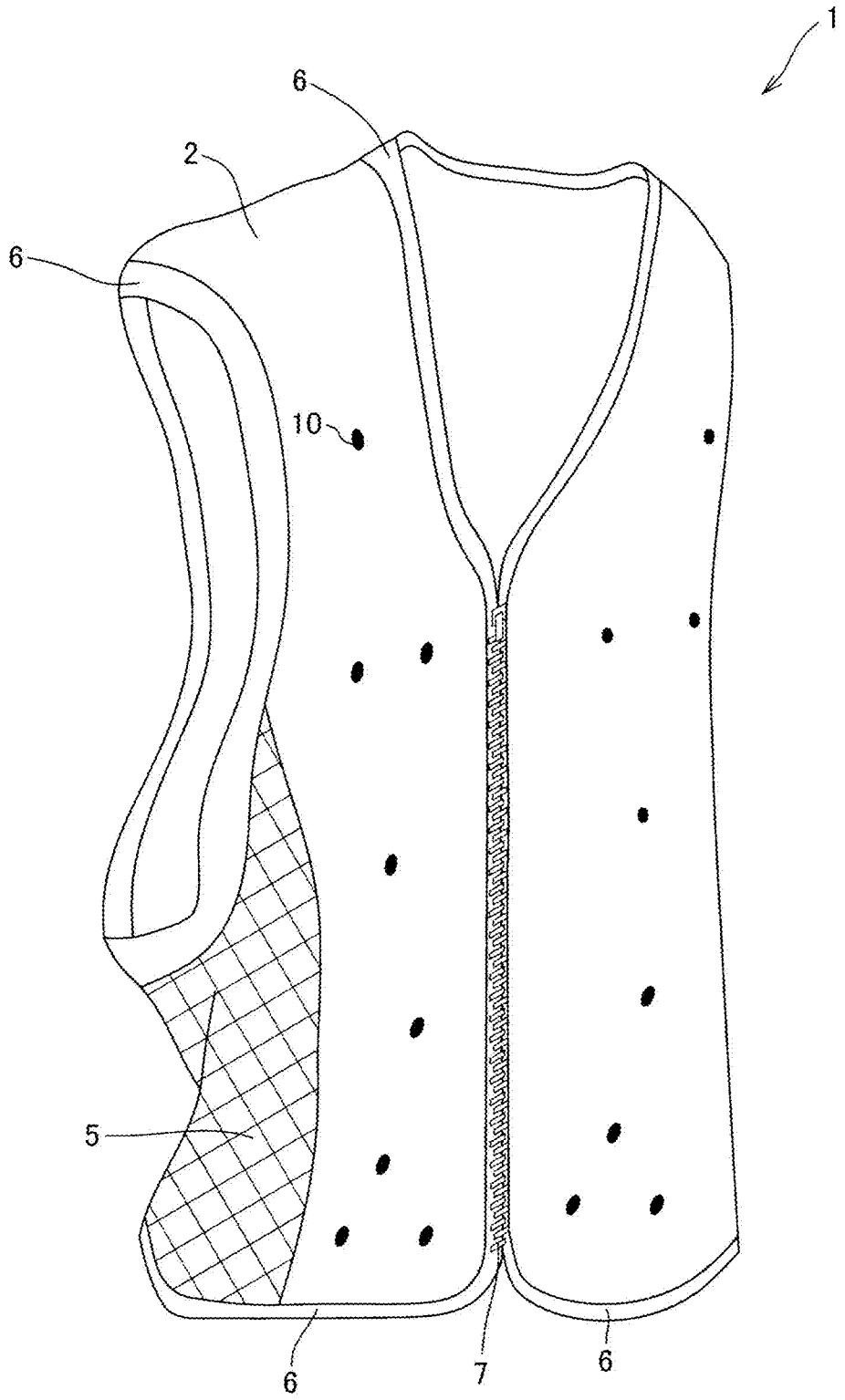
FIG. 3 is a front perspective view of a schematic configuration of the cooling garment which is observed from a left side in Embodiment 1.
Figure 4:
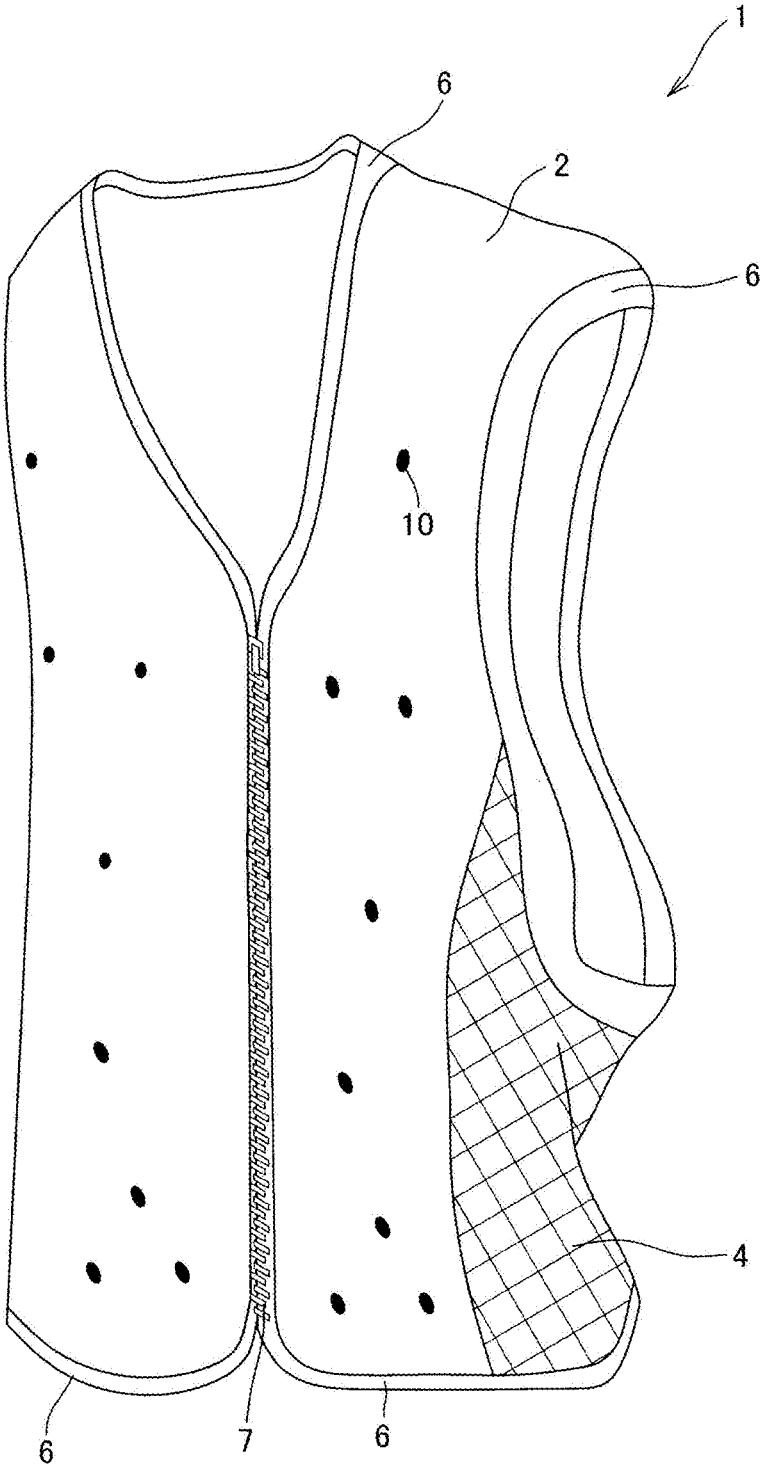
FIG. 4 is a front perspective view of a schematic configuration of the cooling garment which is observed from a right side in Embodiment 1.
Figure 5:
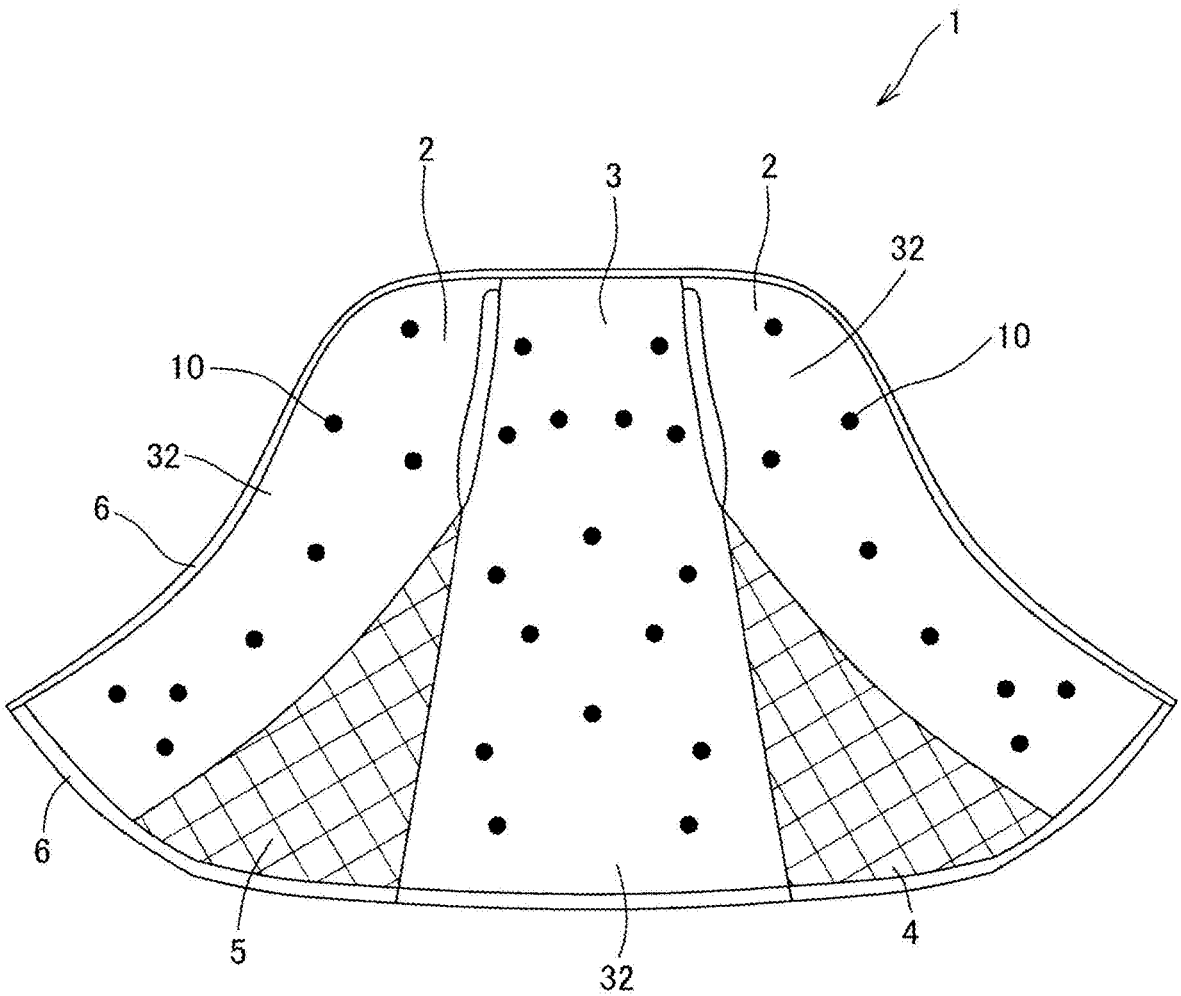
FIG. 5 is an inside view of a schematic configuration of the cooling garment in Embodiment 1.

FIG. 1 is a front view of a schematic configuration of the cooling garment in Embodiment 1, FIG. 2 is a rear view of a schematic configuration of the cooling garment in first Embodiment 1, FIG. 3 is a front perspective view of a schematic configuration of the cooling garment which is observed from a left side in Embodiment 1, FIG. 4 is a front perspective view which is observed from a right side and FIG. 5 is an inside view of a schematic configuration of the cooling garment in Embodiment 1.

The above front perspective view which is observed from a left side means a perspective view of the cooling garment 1 at which an observer looks from the left side.

The above front perspective view which is observed from a right side means a perspective view of the cooling garment 1 at which an observer looks from the right side.

These definitions are also adapted in following descriptions.

As shown in FIGS. 18 and 19, a central axis of the cooling garment 1 (a person's central axis) when the cooling garment 1 is attached to the human body is defined as a centerline 92.

A left side from the centerline 92 is defined as a left side and a right side from the centerline 92 is defined as a right side when the cooling garment 1 is attached to the human body.

A side closest to the human body is defined as an inner side and a side farthest away from the human body is defined as an outer side when the cooling garment 1 is worn on the human body.

A head side is defined as an upper side and a leg side as a lower side when the cooling garment 1 is attached to the human body.

A term "human body" is also used to include both a state of nakedness (a skin itself) and a state in which a person is worn.

A term "water" is also is also used to include, for example, cold water chilled in a refrigerator as well as water at room temperature (ambient temperature where people are present).

As shown in FIG. 1, the cooling garment 1 includes a front side material 2 arranged on the front side of the body, a back side material 3 arranged on the back side of the body, a left side material 4 arranged on the left side of the body, a right side material 5 arranged on the right side of the body, and a fastener 7 arranged in the middle of the front side material 2.

The cooling garment 1 also includes a reinforcement line 6 that reinforces edges of the cooling garment 1.

An intermediate layer 31 is provided inside the front side material 2 and the back side material 3, and the intermediate layer 31 is made of non-nonwoven fabric that absorbs water and vaporizes the absorbed water with body heat. Details of the intermediate layer 31 will be described below.

A pressing bonding part 11 confines the intermediate layer 31 in the front side material 2 and the back side material 3, and is a line-like area where an outer layer 30, adheres to an inner layer 32, and is a continuous line drawn in a single stroke.

The pressing bonding part 11 is a part where the outer layer 30 and the inner layer 32 are pressed, joined, or bonded so that the outer layer 30 adheres to the inner layer 30.

The front side material 2 includes a plurality of water holding parts 13 that hold the water. The details of the water holding part 13 are described below, but the water holding part 13 has a hole 10 (black circle) that penetrates the front side material 2 in a center of it.

As shown in FIG. 2, the front side material 2 as well as the back side material 3 include a plurality of the water holding parts 13 that hold the water, the intermediate layer 31, and the pressing bonding part 11.

In an interior of the front side material 2 and the back side material 3, the intermediate layer 31 is made of one nonwoven fabric and is continuous.

As mentioned above, the intermediate layer 31 is confined inside the front side material 2 and the back side material 3 by the pressing bonding part 11.

The back side material 3 includes a water inlet 20 at an upper part to supply the water to the intermediate layer 31 and a drainage outlet 21 at a lower part to drain the water absorbed by the intermediate layer 31.

Here, the upper part is higher than half of the cooling garment 1, and the lower part is lower than half of the cooling garment 1.

In FIG. 2, the drainage outlet 21 is arranged at a left end of the back side material 3 so that when a person sits at a chair or similar, a body of the person is not pushed by the drainage outlet 21.

The drainage outlet 21 may be arranged at a right end of it.

As shown in FIGS. 3 and 4, the left side material 4 and the right side material 5 are provided at the cooling garment 1 so that the front side material 2 and the back side material 3 fit the body when a person wears the cooling garment 1.

The left side material 4 and the right side material 5 connect the front side material 2 and the back side material 3 and are made of elastic material or other stretchable material.

The left side material 4 and right side fabric 5 may include multiple holes to improve ventilation.

In addition, in FIGS. 3 and 4, the hole 10 which is a black circle is depicted in the front side material 2 and which the black circle is representative of the water holding part 13 described below.

This is also adopted in the following figures.

FIG. 5 is an inside view of a schematic configuration of the cooling garment 1 in Embodiment 1.

As shown in FIG. 5, an inner layer 32 inside of the front side material 2 and the back side material 3 are arranged on the left, center, and right sides.

A plurality of holes 10 are arranged in the inner layer 32.

Next, the details of each component will be explained.

(Water Inlet and Drainage Outlet)

Figure 6:
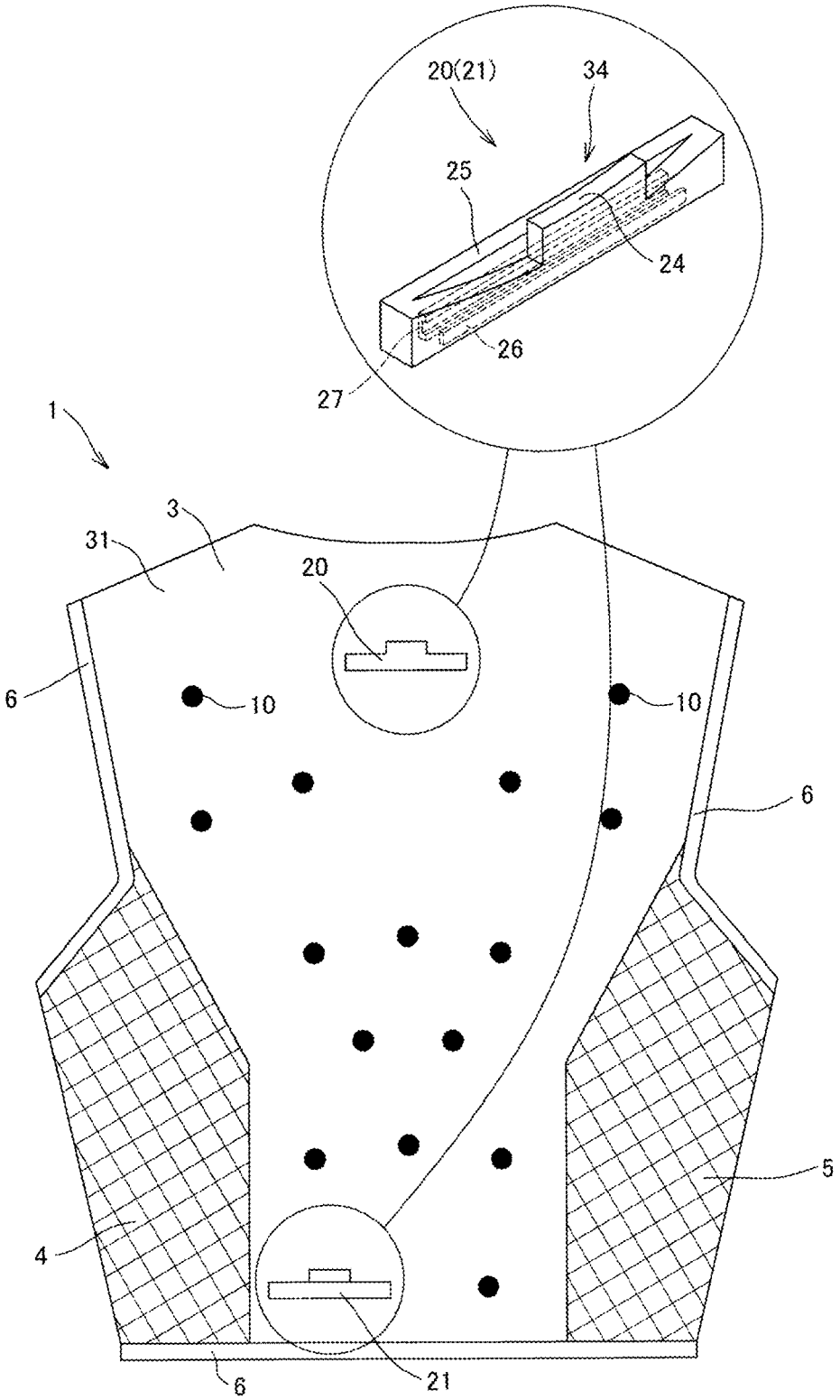
FIG. 6 is a rear view of a schematic configuration of the cooling garment in Embodiment 1.

FIG. 6 is a rear view of schematic configuration of the cooling garment 1 of Embodiment 1 and FIG. 6 illustrates an enlarged view of the water inlet 20 and drainage outlet 21.

With reference to a state in which the cooling garment 1 is worn, the water inlet 20 includes an outer lid 24 arranged far from the body and an inner lid 25 arranged close to the body, from leaking out of the interior.

The outer lid 24 and the inner lid 25 constitute a closure 34 so that the outer lid 24 and the inner lid 25 contact each other in a front-back direction to prevent the water in the intermediate layer 31.

The outer lid 24 has a protrusion so as to be grasped by a hand.

A convex 26 is arranged inside the outer lid 24 and a concave 27 is arranged outside the inner lid 25.

By pressing the outer lid 24 against the inner lid 25, the convex 26 and concave 27 engage to prevent the water in the intermediate layer 31 from leaking out of the interior of the intermediate layer 31.

The water injected through the water inlet 20 is absorbed by the intermediate layer 31 of the back side material 3 and also spreads out the intermediate layer 31 of the front side material 2, and spreads to an entire surface of the cooling garment 1.

In addition, the water inlet 20 may constitute a hook and loop fasteners such as Velcro (registered trademark), a water stopping chuck, or a fastener that prevents the water in the intermediate layer 31 from leaking out of the interior of the cooling garment 1.

The drainage outlet 21 has the same structure as the water inlet 20 and may be different from a size of the water inlet 20.

Figure 7A:
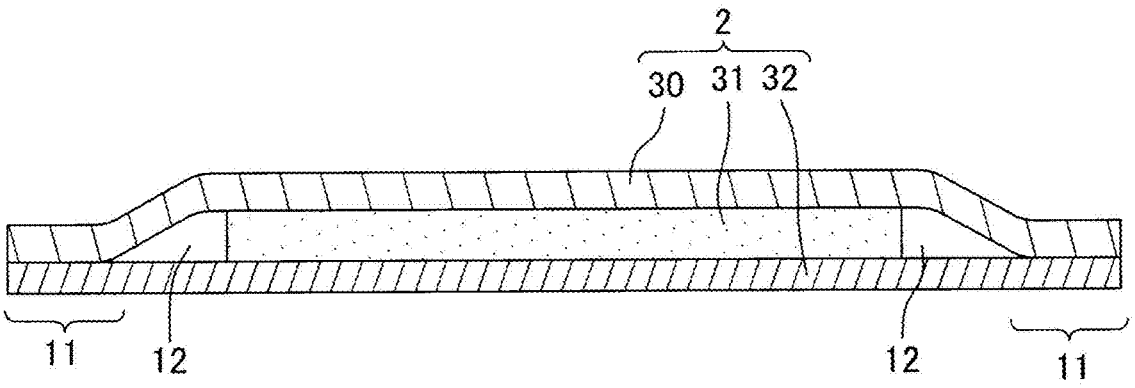
FIG. 7A is a schematic sectional view of the cooling garment in Embodiment 1, taken along line A-A of FIG. 1.

FIG. 7A is a schematic sectional view of the cooling garment 1 in Embodiment 1, taken along line A-A of FIG. 1.

As shown in FIG. 7A, the front side material 2 includes the inner layer 32 that is waterproof and arranged closest to the body, the outer layer 30 that is moisture permeable and arranged farthest from the body, and the intermediate layer 31 that is arranged between the inner layer 32 and the outer layer 30 and that is made of the nonwoven fabric which absorbs the water and vaporizes the absorbed water with body heat.

A material of the inner layer 32 is preferably a waterproof material such as nylon. The material of the inner layer 32 may also be made antistatic by, for example, antistatic yarns such as hydrophilic polymers.

A material of the intermediate layer 31 is nonwoven fabric, and other materials such as polyurethane moisture absorption and divergence polyester fleece, technology wicking polyester fleece, or fibers containing polymers based on sodium salt of polyacrylic acid and spun directly from them are preferred. The material of the intermediate layer 31 is not limited to the above materials as long as it absorbs the water and easily vaporizes the absorbed water. A material of the outer layer 30 is preferably a moisture permeable material such as nylon jersey 50% and polyurethane 50%, and may be antistatic with antistatic yarn.

The material of the outer layer 30 and/or the inner layer 32 may be made of flame-retardant fiber. The material of the outer layer 30 and/or the material of the inner layer 32 may be fire-proofed.

VINAL (registered trademark), polyetherimide (PEI) fiber, Moeni (registered trademark), CONEX (registered trademark), SUPER EXTAR (registered trademark), UNFLA (registered trademark), HEIM (registered trademark), PROTEXA (registered trademark) FR, HONOGUARD (registered trademark), BREVANO (registered trademark), Nomex (registered trademark), etc. can be used as flame-retardant and fire-retardant fibers.

As shown in FIG. 7A, the cooling garment 1 has an air gap 12 between the pressing bonding part 11 and the intermediate layer 31, the pressing bonding part 11 being a part where the front layer 30 and inner layer 32 are pressed, joined, or bonded to be adhered closely together. In other words, the pressing bonding part 11 of an outer edge of the cooling garment 1 surround the intermediate layer 31 through the air gap 12.

The pressing bonding part 11 of the outer edge of the cooling garment 1 does not include the intermediate layer 31.

The back side material 3 is the same construction and material as the front side material 2.

In FIG. 1, the water holding part 13 holds the water when the water falls from a shoulder of the cooling garment 1 to the lower part of the cooling garment 1.

Figure 7B:
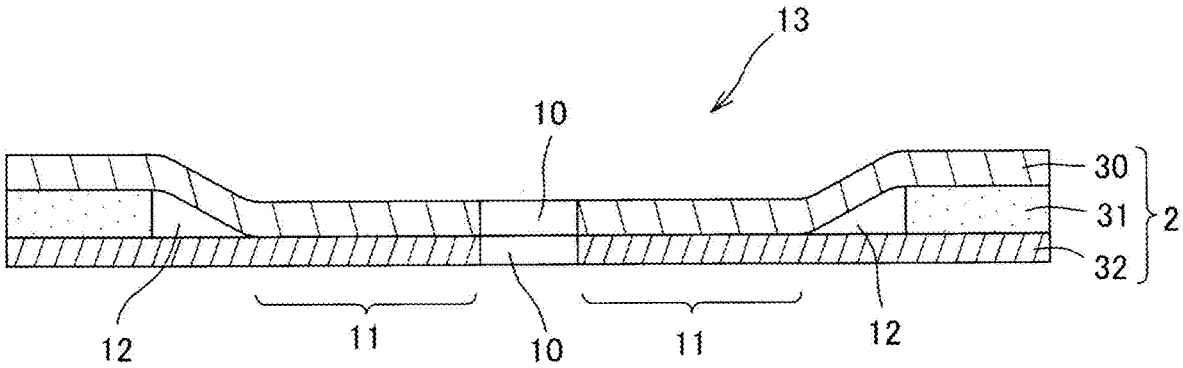
FIG. 7B is a schematic sectional view of the cooling garment in Embodiment 1, taken along line B-B of FIG. 1.

As shown in FIG. 7B, the water holding part 13 has the hole 10 through the front side material 2 and the back side material 3, the pressing bonding part 11 where the outer layer 30 adheres to the inner layer 32 around the hole 10 and the air gap 12 arranged around the pressing bonding part 11 and between the outer layer 30 and the inner layer 32.

The water is retained in the water holding parting 13 since the water is stored in the air gap 12.

The water holding part 13 will be described in detail.

The water holding part 13 stores the water temporarily.

On describing in detail, when the water is supplied to the intermediate layer 31 from the water inlet 20, the water is temporarily stored in the air gap 12 of the water holding part 13.

In this state, as the water held by the intermediate layer 31 adjacent to the air gap 12 evaporates, the water held in the intermediate layer 31 becomes decreased.

Then, due to a capillary action of the intermediate layer 31, the water stored in the air gap 12 moves from the air gap 12 to the intermediate layer 31 and is absorbed in the intermediate layer 31.

After a further period of time, all of the water stored in air gap 12 moves to the intermediate layer 31 and the water in the air gap 12 does not exist.

(Drainage Operation)

Figure 8A:
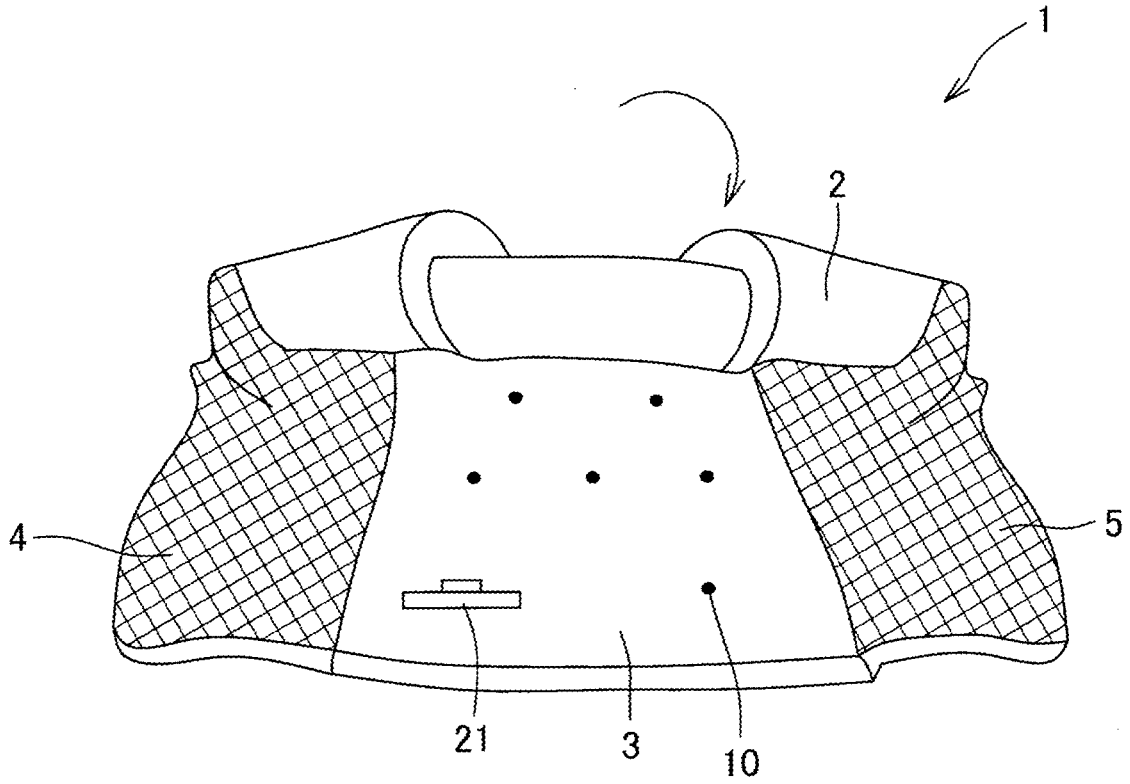
FIG. 8A is a schematic operation diagram draining the cold water from the intermediate layer of the cooling garment in Embodiment 1, illustrating the beginning of rounding an upper part of the cooling garment.
Figure 8B:
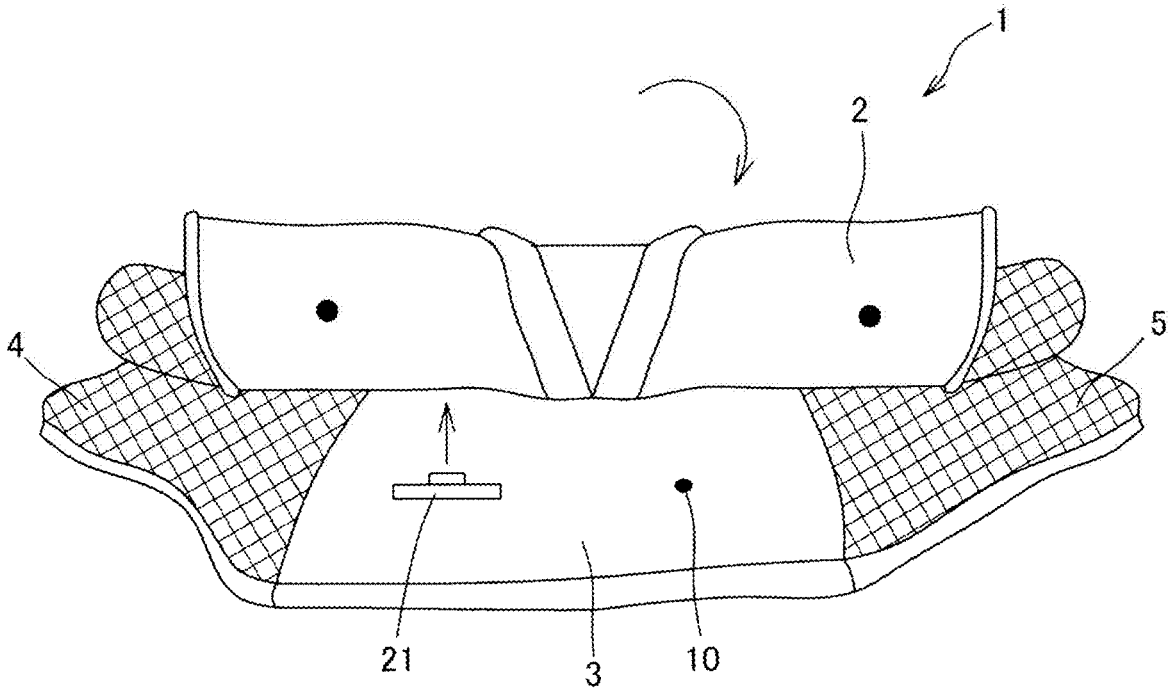
FIG. 8B is a schematic operation diagram draining the cold water from the intermediate layer of the cooling garment in Embodiment 1, illustrating the end of rounding the cooling garment.

FIGS. 8A and 8B illustrates a schematic operation to drain the water from the intermediate layer 31 of the cooling garment 1 in Embodiment 1.

The premise is a state that the intermediate layer 31 of the cooling garment 1 is already absorbed by the water.

First, a closure 34 of the water inlet 20 is closed and the closure 34 of the drainage outlet 21 is opened, as shown in FIG. 8A.

Next, as an upper part of the cooling garment 1 begins to be rounded, the water in the upper part of the intermediate layer 31 in the front side material 2 is squeezed out and the water moves to the lower part of the intermediate layer 31.

Finally, as shown in FIG. 8B, as an end of rounding the cooling garment 1 is nearing and the drainage is nearly complete, the closure 34 of drainage outlet 21 is made closed.

The above operation can drain the water in the intermediate layer 31 and can allow the water to be poured from the water inlet 20.

If the water can be repeatedly poured and drained, the water can be supplied to the cooling garment 1 as many times as needed (e.g., four times a day) to cool the body with the cooling garment 1.

Embodiment 2

Figure 9:
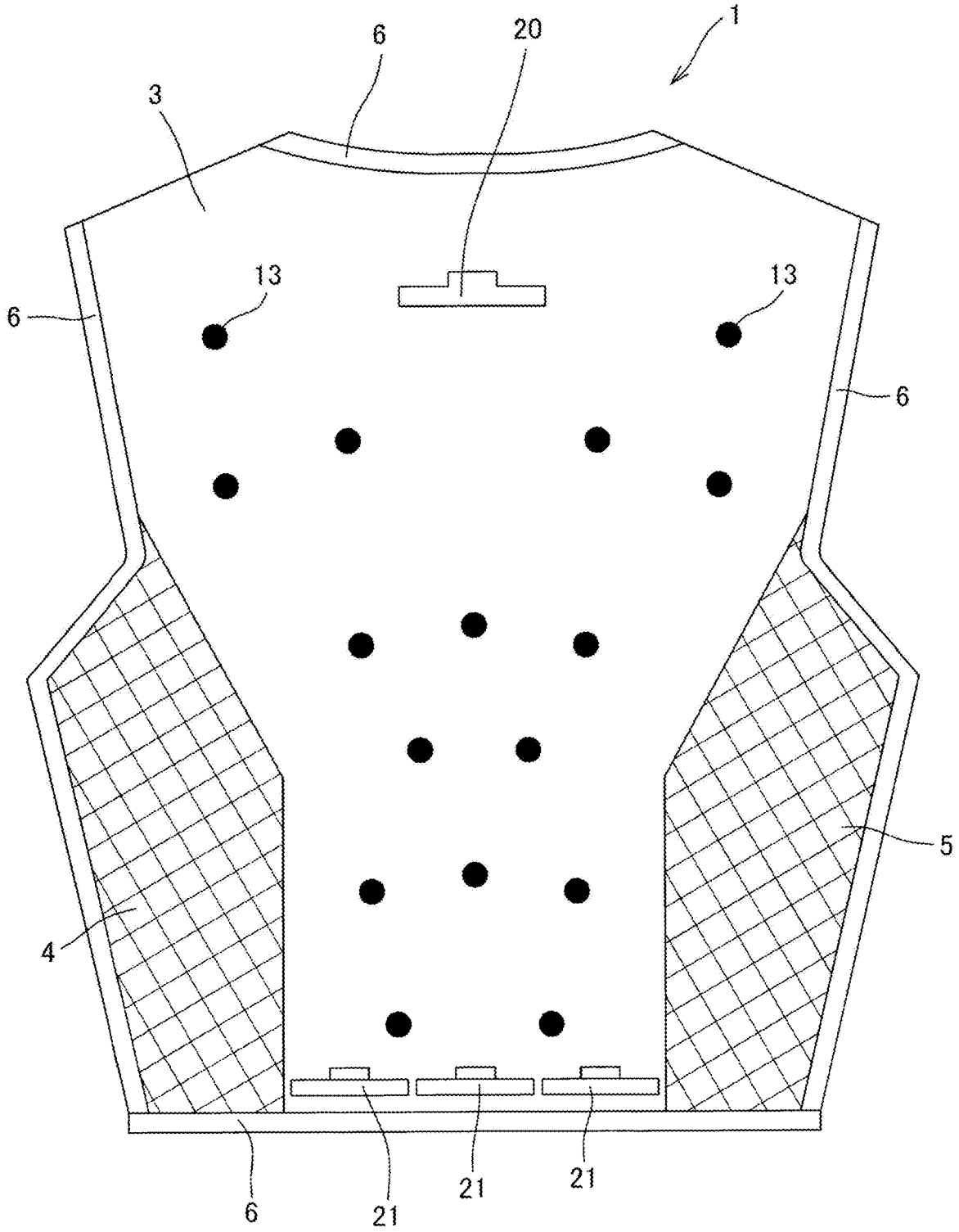
FIG. 9 is a rear view of a schematic configuration of a cooling garment in Embodiment 2.
Figure 10:
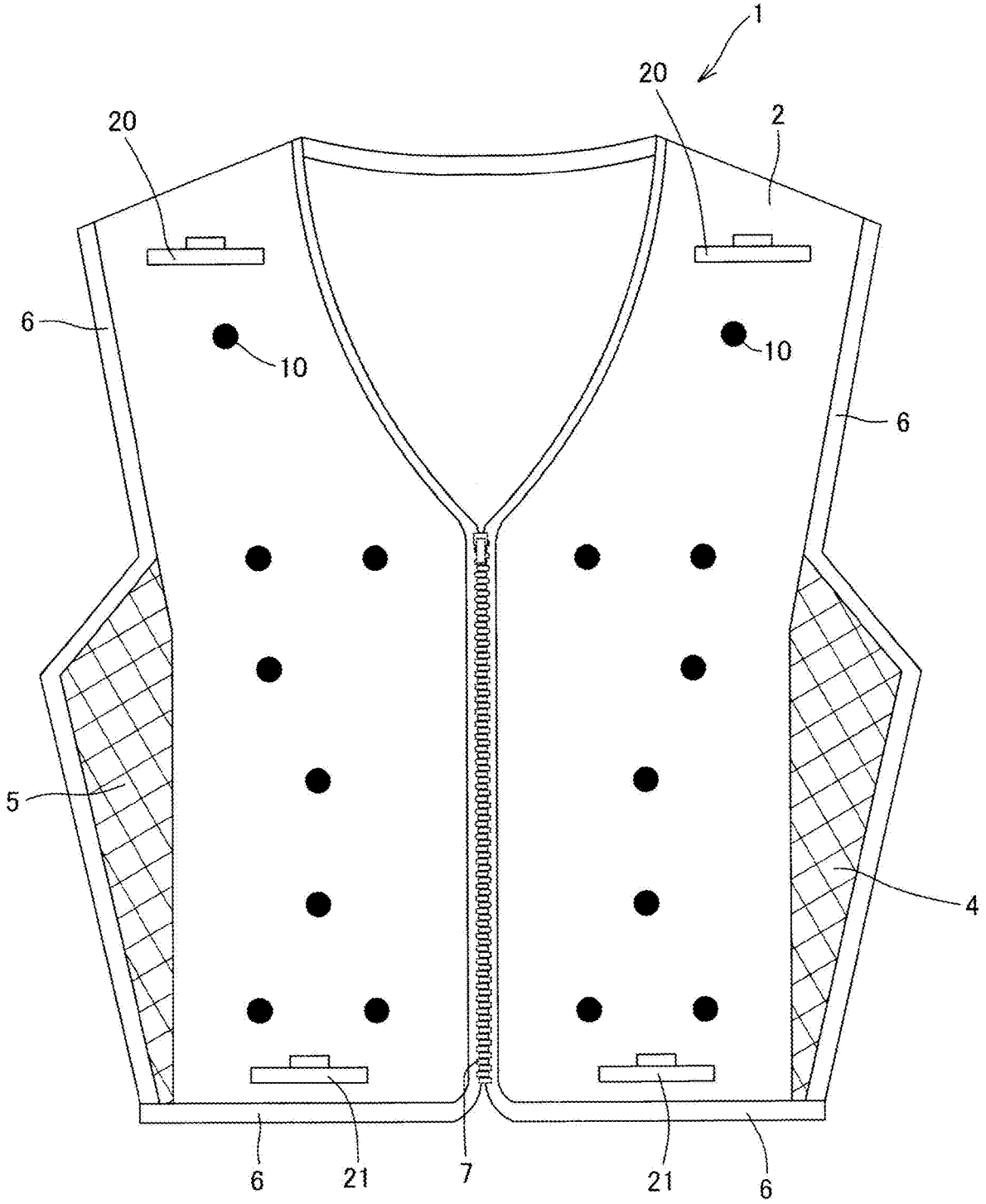
FIG. 10 is a front view of a schematic configuration of the cooling garment in Embodiment 2.

FIG. 9 is a rear view of a schematic configuration of the cooling garment 1 in Embodiment 2, and FIG. 10 is a front view of a schematic configuration of the cooling garment 1 in Embodiment 2.

In Embodiment 2, as shown in FIG. 9, one water inlet 20 is arranged at an upper part of the back side material 3 and a plurality of drainage outlets 21 are arranged at a lower part of the back side material 3. In FIG. 9, and three drainage outlets 21 are arranged.

As shown in FIG. 10, two water inlets 20 are arranged at the upper part of the front side material 2, and two drainage outlets 21 are arranged at a right side and a left side of the lower part of the front side material 2.

According to the above aspect, since multiple drainage outlets 21 are arranged at the lower part of the back side material 3 or multiple drainage outlets 21 are arranged at the lower part of the front side material 2, as the cooling garment 1 is rounded, the water can be discharged from the intermediate layer 31 in a short time.

In addition, as shown in FIG. 10, since the water inlet 20 is arranged in the front side material 2, the water can be spread quickly over an entire surface of the intermediate layer 31 in pouring operation.

When a person wears the cooling garment 1, the water tends to accumulate in the lower part of the front side material 2 or the back side material 3 due to gravity. The excess water that has accumulated in the lower part of the front side material 2 or the back side material 3 can be drained out through the drainage outlet 21.

Embodiment 3

Figure 11:
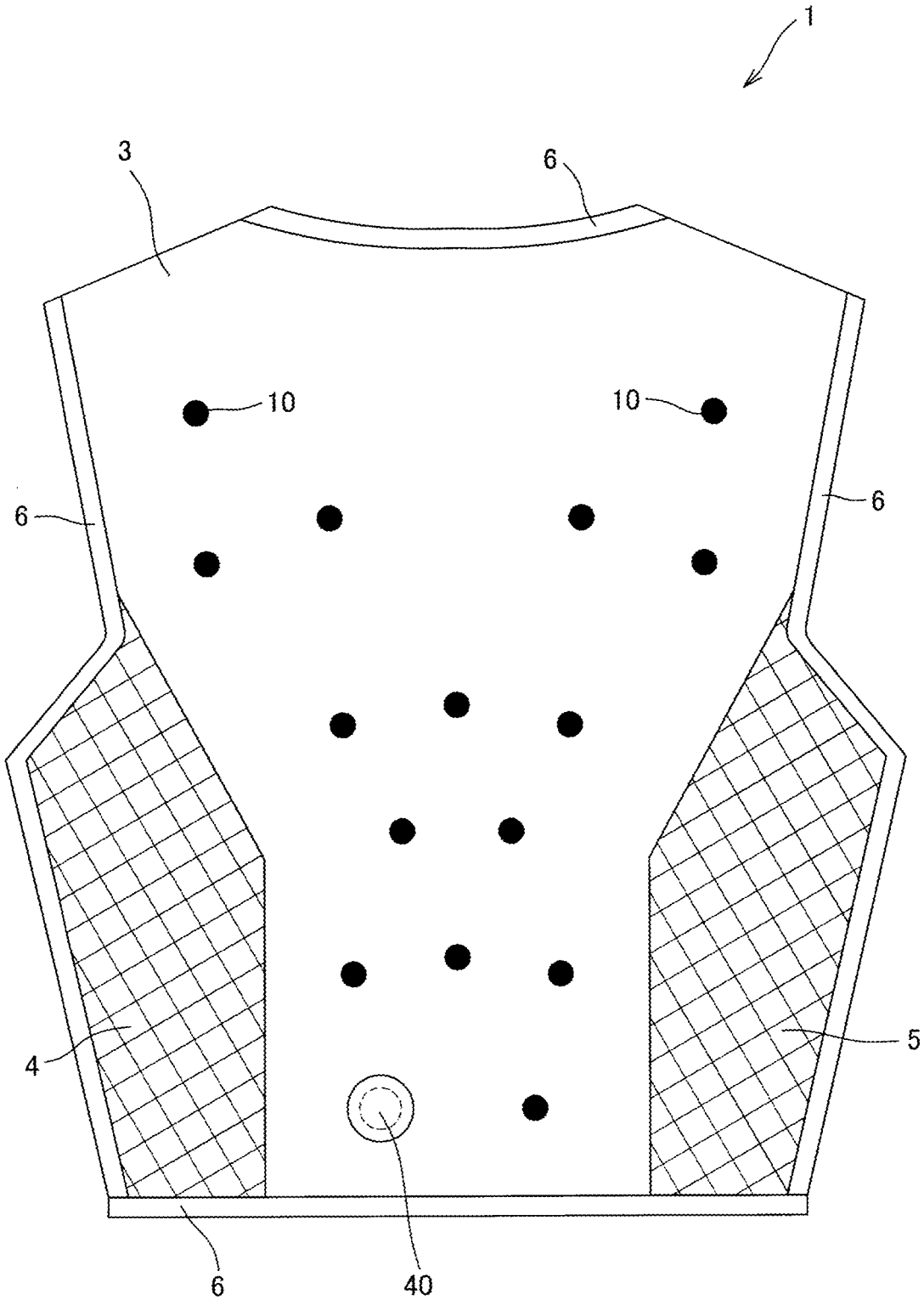
FIG. 11 is a rear view of a schematic configuration of a cooling garment in Embodiment 3.
Figure 12:
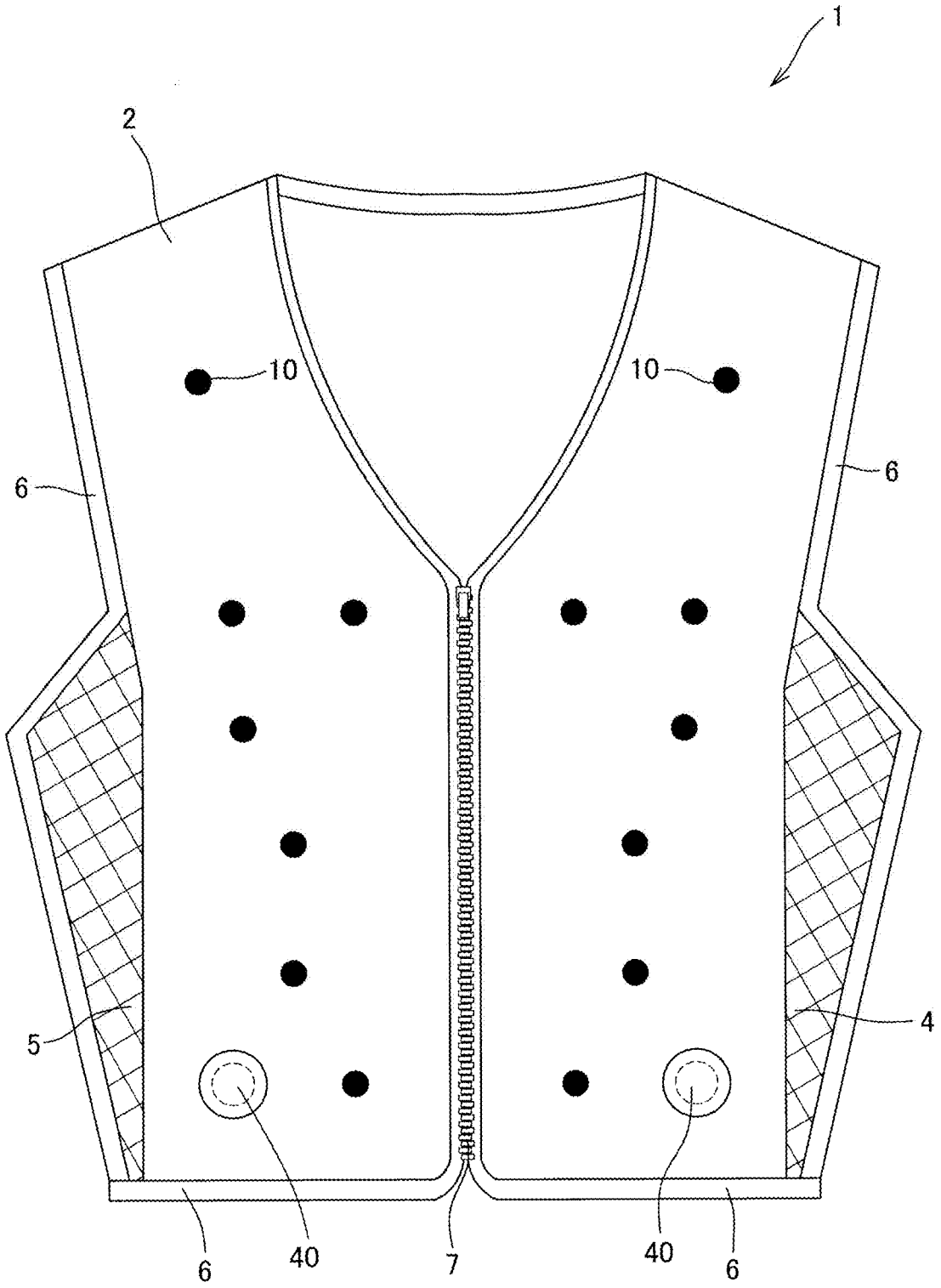
FIG. 12 is a front view of a schematic configuration of the cooling garment in Embodiment 3.

FIG. 11 is a rear view of a schematic configuration of a cooling garment 1 in Embodiment 3 and FIG. 12 is a front view of a schematic configuration of the cooling garment 1 in Embodiment 3.

In Embodiment 3, a water inlet and drainage outlet 40 that simultaneously pours the water into the cooling garment 1 and drains the water from the cooling garment 1 is provided in the cooling garment 1. A structure of the water inlet and drainage outlet 40 is a normal cap and as a solid line of the water inlet and drainage outlet 40 in FIG. 11 is picked up and pulled, the cap is opened and a mouth of a dashed line becomes visible.

As shown in FIG. 11, the water inlet drainage outlet 40 is arranged at the bottom edge of the back side material 3.

As shown in FIG. 12, the water inlet drainage outlets 40 are arranged at left and right ends of a bottom of the front side material 2.

According to the above aspect, as pouring and draining can be performed by a single the water inlet drainage outlet 40, an area of the intermediate layer 31 can be enlarged and an amount of the water retention can be expanded.

Embodiment 4

Figure 13:
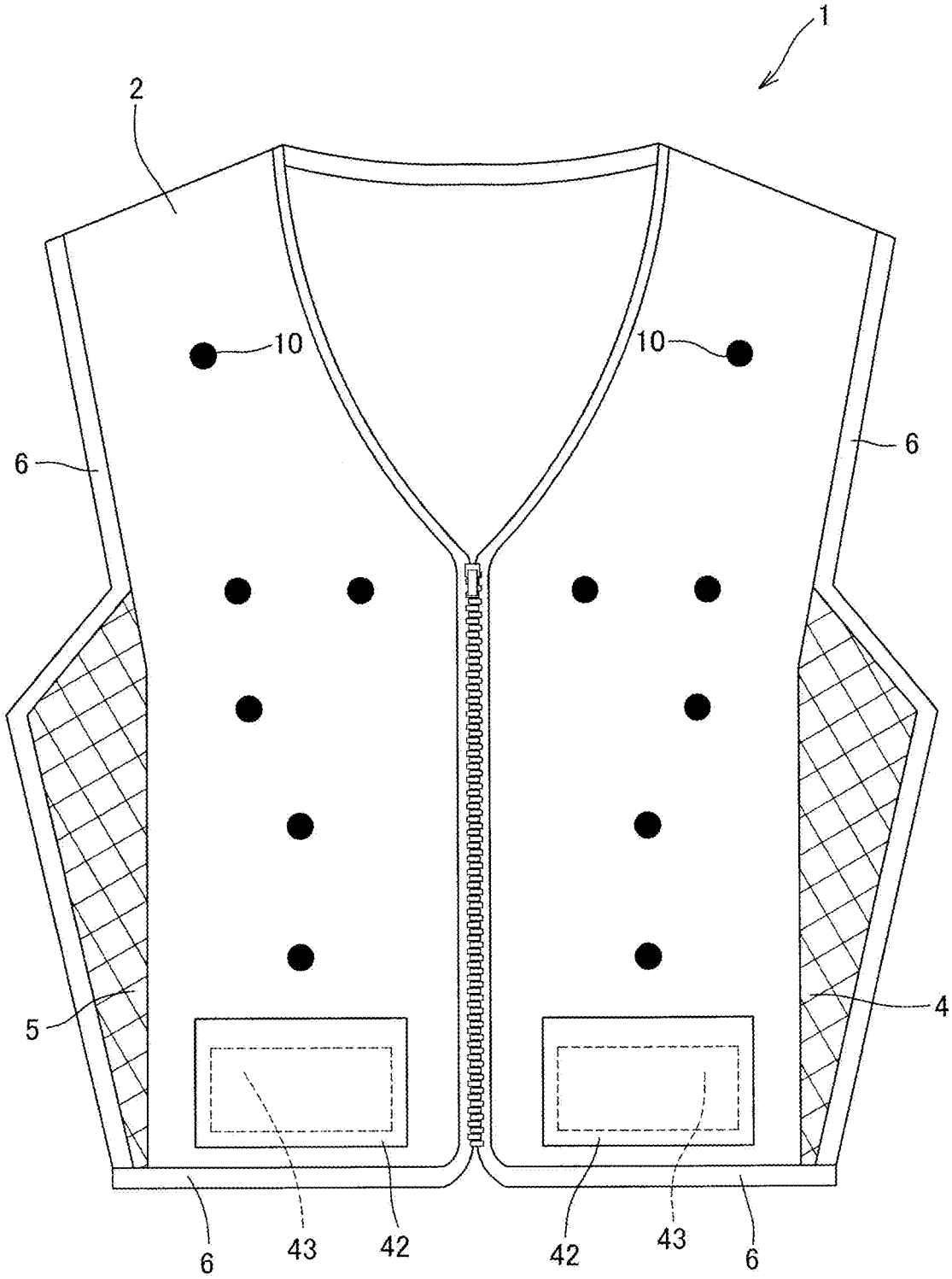
FIG. 13 is a front view of a schematic configuration of a cooling garment in Embodiment 4.
Figure 14:
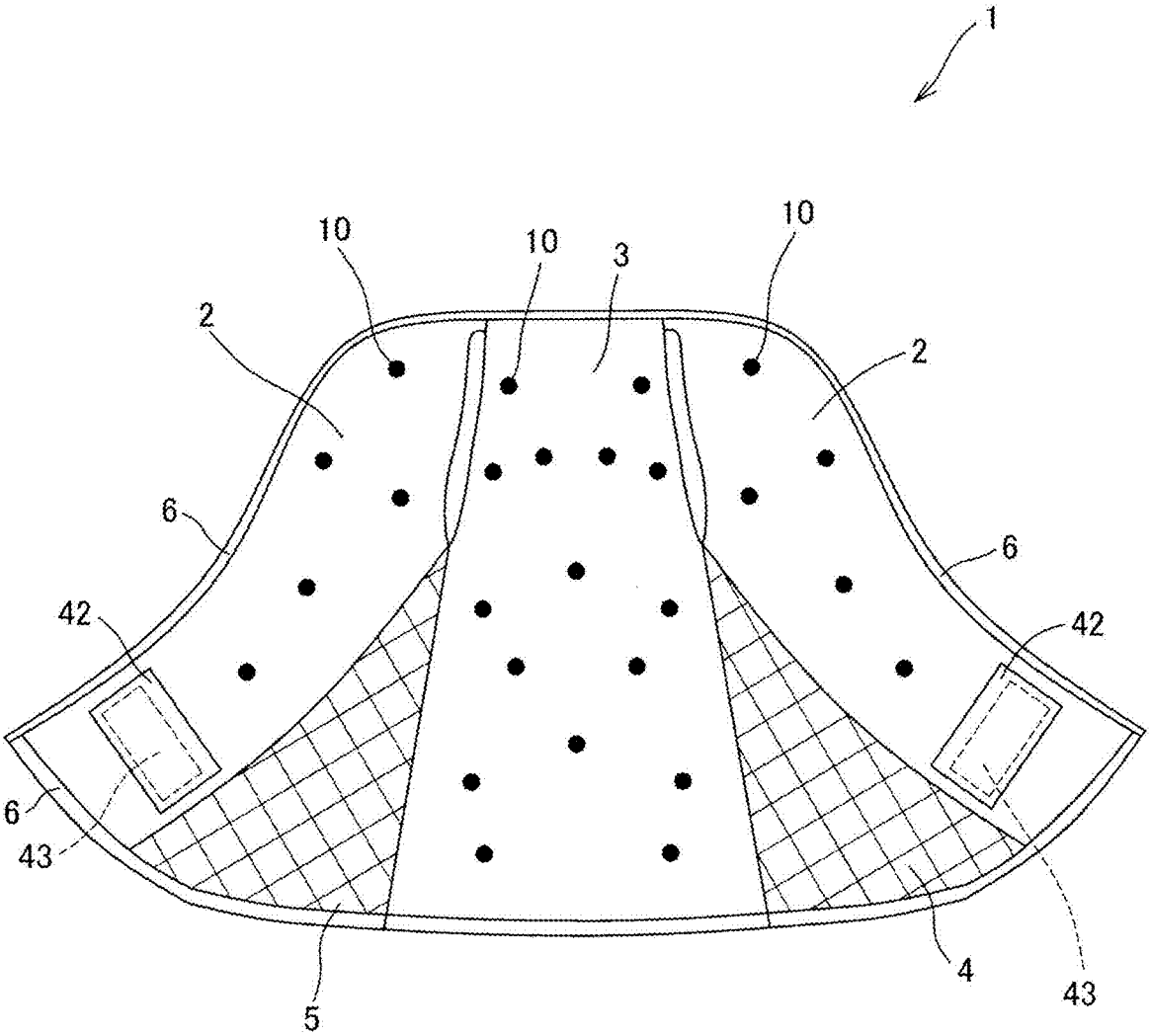
FIG. 14 is an inside view of a schematic configuration of the cooling garment in Embodiment 4.

FIG. 13 is a front view of a schematic configuration of a cooling garment 1 in Embodiment 4 and FIG. 14 is an inside view of a schematic configuration of the cooling garment 1 in Embodiment 4.

As shown in FIGS. 13 and 14, in Embodiment 4, two pockets 42 holding refrigerants 43 are arranged outside of the front side and inside of the front side material 2 on the lower part of a left side and a right side of the front side material 2.

According to the above Embodiment, the water in the intermediate layer 31 is cooled by the refrigerants 43 held in the pockets 42 and a temperature rise of the water can be reduced, thus the body can be cooled for a long time.

The location of the pocket 42 is not limited on the outside of the front side material 2 and the lower part of the inside of the front side material 2, and the pocket 42 may be arranged anywhere. The pockets 42 may also be arranged on the back side material 3. The number of pockets 42 is not limited.

Embodiment 5

Figure 15:
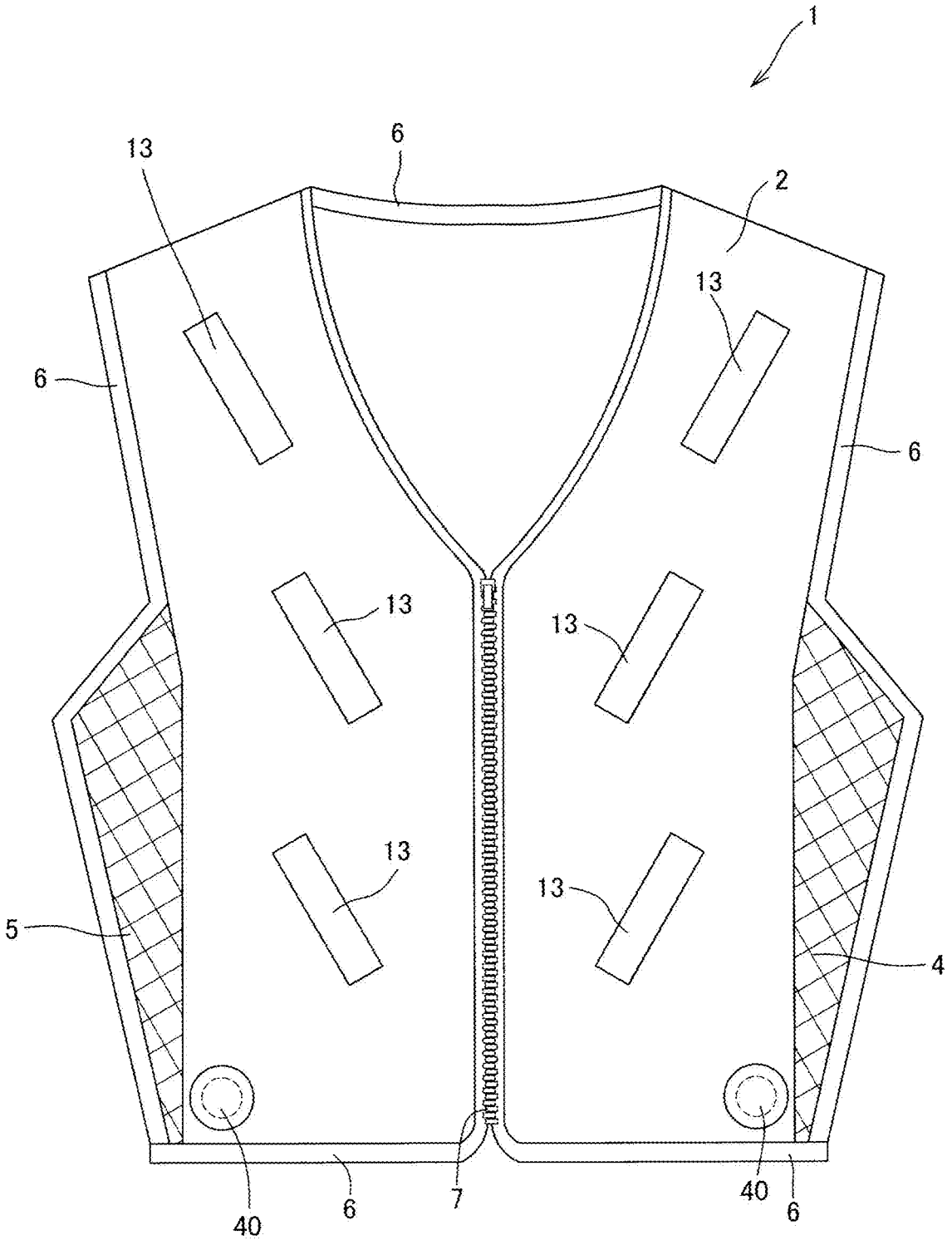
FIG. 15 is a front view of a schematic configuration of a cooling garment in Embodiment 5.
Figure 16:
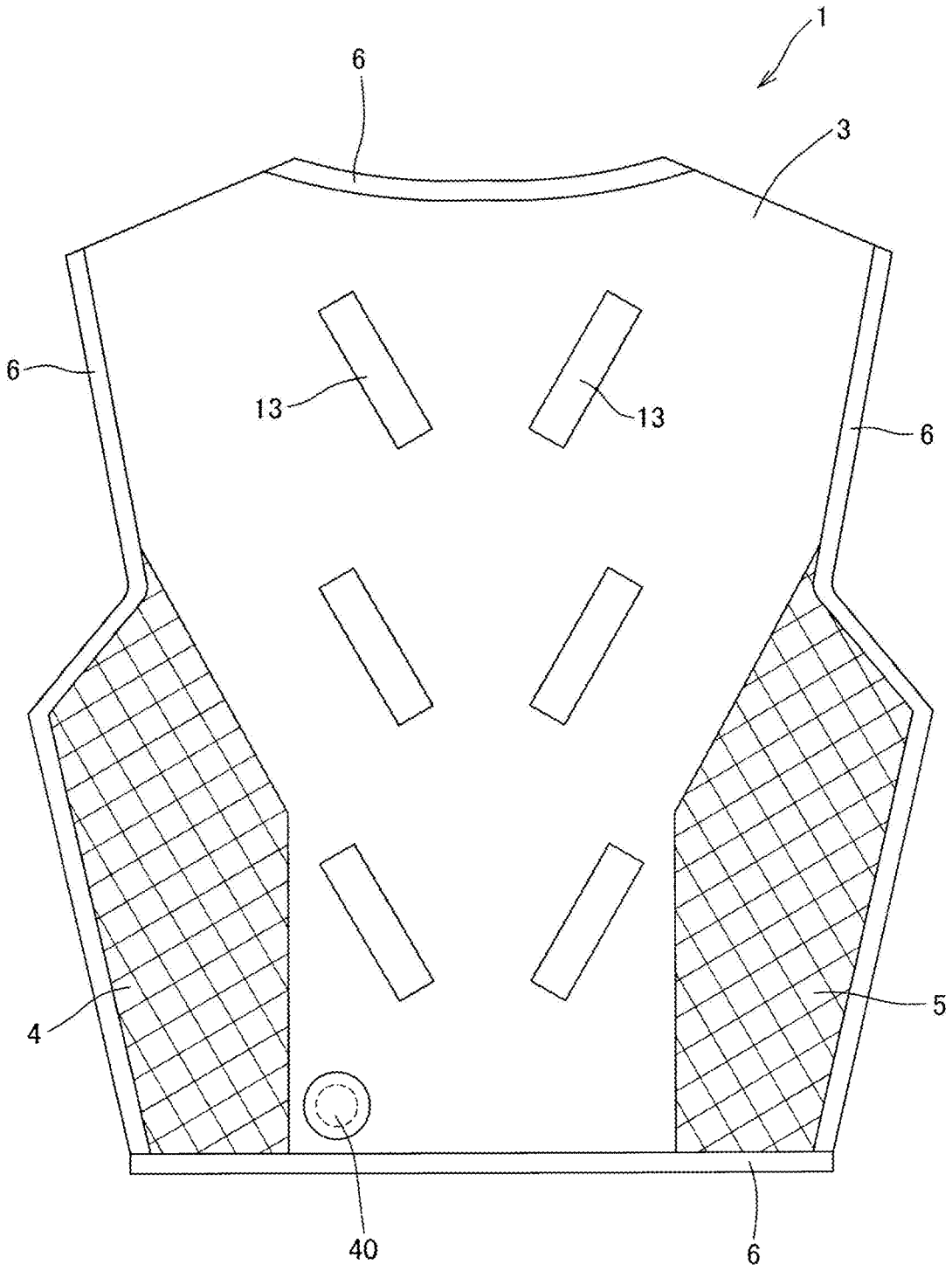
FIG. 16 is a: rear view of a schematic configuration of the cooling garment in Embodiment 5.

FIG. 15 is a schematic front view of the cooling garment 1 in Embodiment 5, and FIG. 16 is a rear view of the cooling garment 1 in Embodiment 5.

In Embodiment 5, the water holding part 13 is not circular but rectangular in shape and tilted.

As shown in FIG. 15, the two water inlet drainage outlet 40 are provided at two locations on the left and right sides of the front side material 2, and as shown in FIG. 16, the water inlet drainage outlet 40 is provided at the bottom edge of the back side material 3.

In addition, the water inlet 20 and drainage outlet 21 of Embodiment 1 may be provided instead of the water inlet and drainage outlet 40.

Embodiment 6

Figure 17:
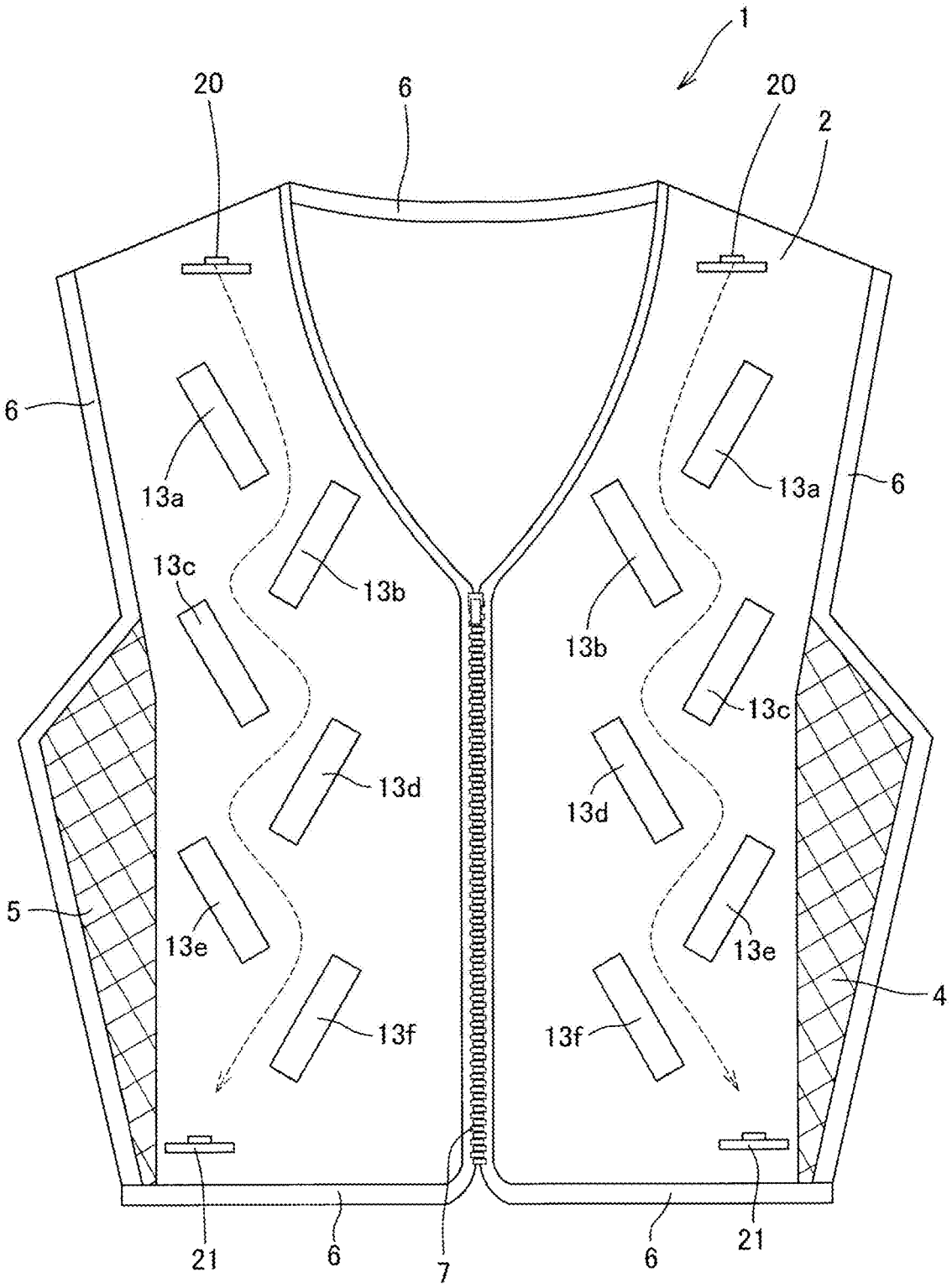
FIG. 17 is a: front view of a schematic configuration of a cooling garment in Embodiment 6.

FIG. 17 is a: front view of a schematic configuration of a cooling garment 1 in Embodiment 6. As shown in FIG. 17, in Embodiment 6, the rectangular-shaped water holding parts 13 are tilted and alternately staggered.

The water inlet 20 and the drainage outlet 21 in Embodiment 6 are the same structures as Embodiment 2.

The flow of the water on the left side of the front side material 2 in FIG. 17 will be described below.

Six water holding parts 13*a*-13*f* are arranged on the left side and the right side of the front side material 2.

On the left side of the front side material 2, first, the water falls downward from a shoulder of the front side material 2, passes through the right side of the first water holding part 13*a* from the top and falls from an upper left part to a lower right part.

Next, the water passes through the left side of the second water holding part 13*b* from the top and falls from an upper right part to a lower left part. At this time, the water hits the water holding part 13*b* so that the water flowing from the water holding part 13*a* is once caught by the water holding part 13*b*, so the water holding part 13*b* hold the water easily.

Next, the water holding parts 13*c* and 13*d*, the water holding part 13*e* and the water holding part 13*f* are also the same flows of the water as the water holding part 13*a* and the water holding part 13*b*. Like the water holding part 13*b*, the water holding parts 13*c*-13*e* also hold the water easily.

Finally, the water passes through the left side of the water holding part 13*f*, being the sixth from the top, and falls from the upper right part to the lower left part and reaches the drainage outlet 21. In this way, a direction of the water flowing from the water holding part 13*f* is oriented toward the drainage outlet 21, the water can be discharged smoothly when the water is discharged.

The flow of water in the left side of the front side material 2 in FIG. 17 is symmetrical with the flow in the right side of the front side material 2 with respect to the center of the front side material 2.

According to the above Embodiment, the water can be held in the water holding parts 13 by arranging the water holding part 13 in a staggered pattern. Consequently, the body can be cooled for a long time.

In addition, since the direction of the water flowing from the lowest water holding part 13*f* is oriented toward the drainage outlet 21, so the water can be discharged smoothly when the water is discharged.

Although the staggered water holding parts 13 are provided on the front side material 2, like the staggered water holding parts 13 may be also provided on the back side material 3 as on the front side material 2.

Embodiment 7

Figure 18A:
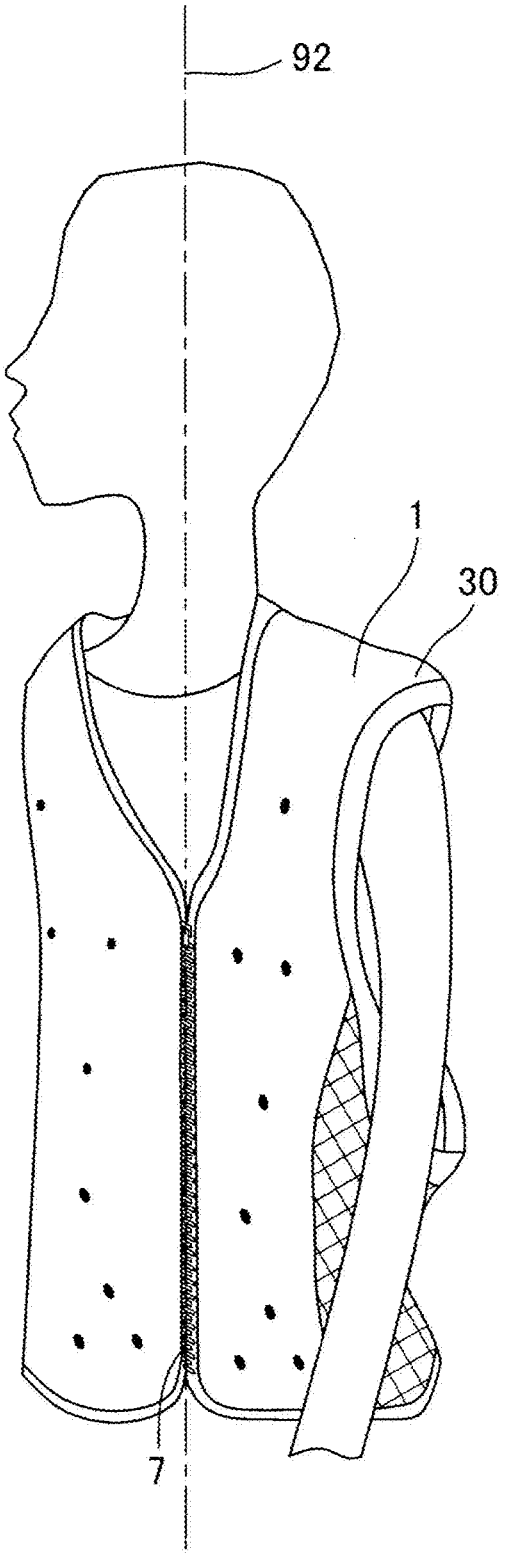
FIG. 18A is a schematic perspective view Illustrating that a person wore the cooling garment, in a case where a person wears an air conditioning function garment over a cooling garment in Embodiment 7.
Figure 18B:
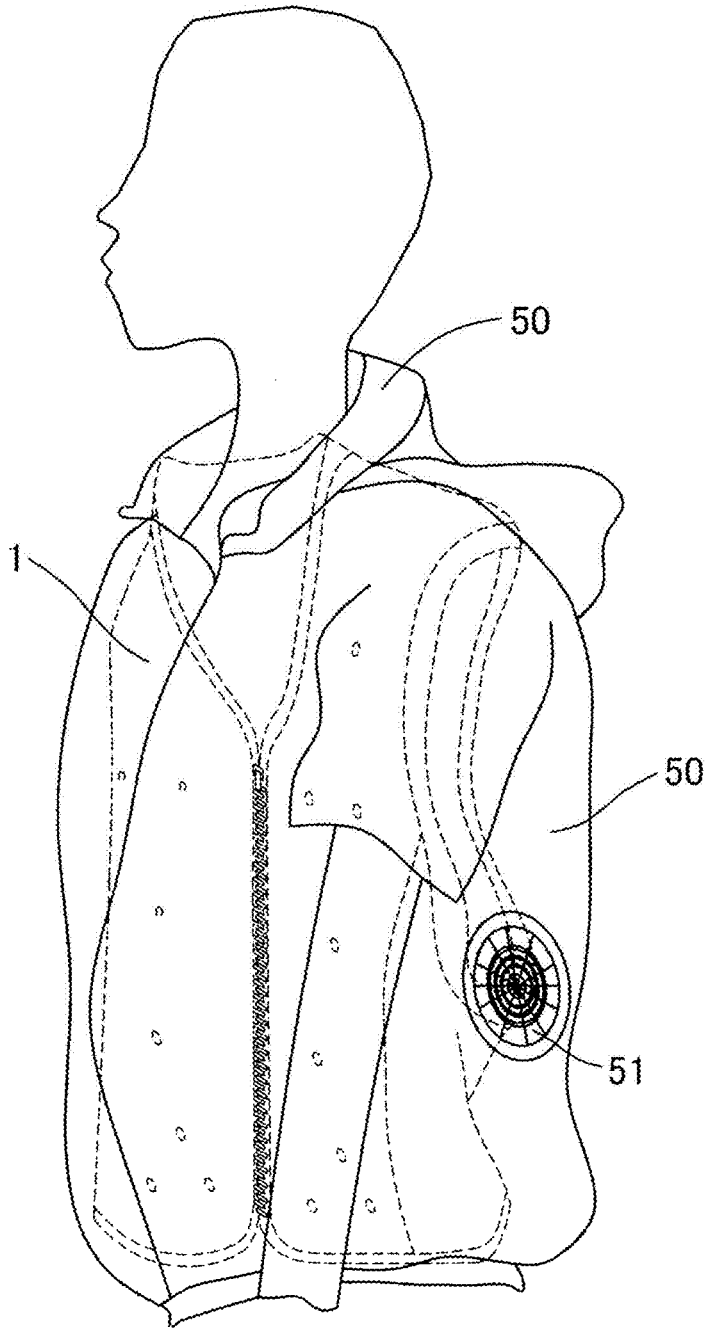
FIG. 18B is a: is a schematic perspective view Illustrating that a person wore the cooling garment and wore the air conditioning function garment over the cooling garment, in a case where a person wears the air conditioning function garment over the cooling garment in Embodiment 7.

FIGS. 18A and 18B illustrate a schematic perspective view in case where the cooling garment 1 of the present disclosure in Embodiment 7 and an air conditioning function garment 50 are worn in layers, the air conditioning function garment 50 also referred to as KUCHOFUUJINFUKU (registered trademark) and KUCHOFUKU (registered trademark). The air conditioning function garment 50 is a clothing that is attached to a fan 51 and is sent an outside air into an inside there in, and sweat from the body is evaporated by the outside air to lower the body temperature, as described in Japanese Examined Utility Model (Registration) Application Publication No. Hei 3-32487 and Japanese Patent No. 6536674.

The operation of layering the cooling garment 1 and the air conditioning function garment 50 will be described.

First, as shown in FIG. 18A, the cooling garment 1, which has already been poured with the water, is attached to the body and the fastener 7 is fastened.

Next, as shown in FIG. 18B, the air conditioning function garment 50 is laid on top of the cooling garment 1, and the fastener 7 of the air conditioning function garment 50 is fasten.

Finally, the fan 51 of the air conditioning function garment 50 is rotated and the outside air is sent into the inside of it.

The combination of the layered the cooling garment 1 and the air conditioning function garment 50 is referred to as a cooling garment set.

According to the above Embodiment, the air conditioning function garment 50 sends the outside air into a surface of the cooling garment 1 and the vaporization of the water in the cooling garment 1 is promoted. Consequently, the body temperature can be lowered fast. Although the fan 51 is rotated after the air conditioning function garment 50 was put on, the air conditioning function garment 50 of which fan 51 is rotating may be worn over the cooling garment 1.

Figure 19A:
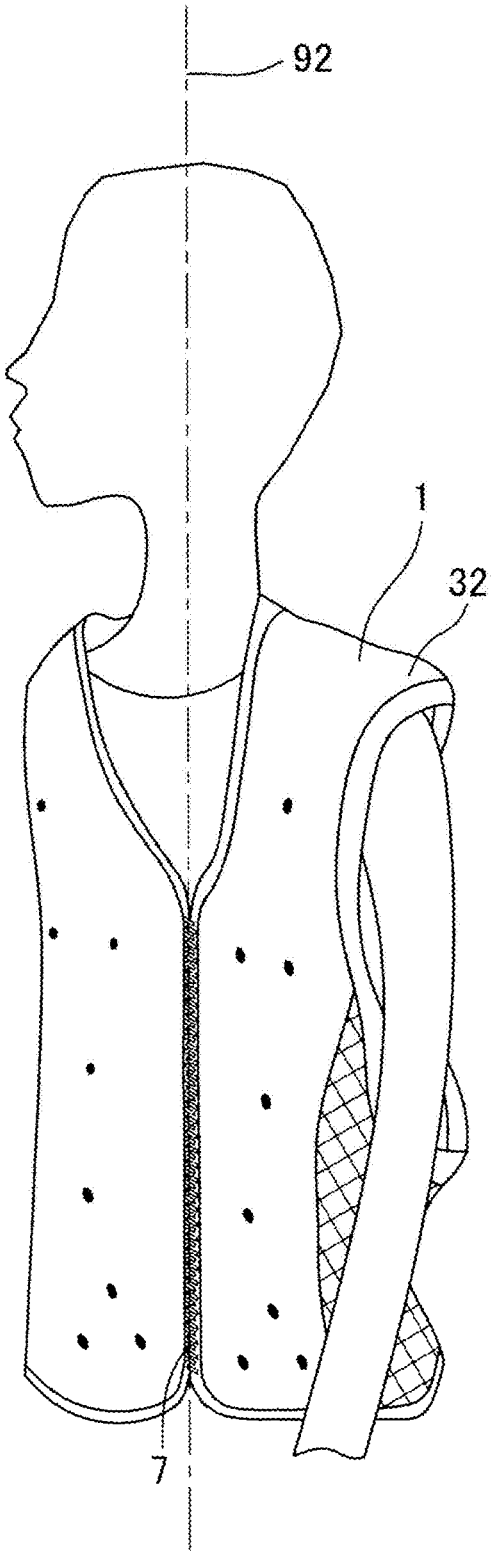
FIG. 19A is a perspective view Illustrating that a person wore a reversed cooling garment, in a case where a person wears the reversed cooling garment and wears the air conditioning function garment over the cooling garment in Embodiment 7.
Figure 19B:
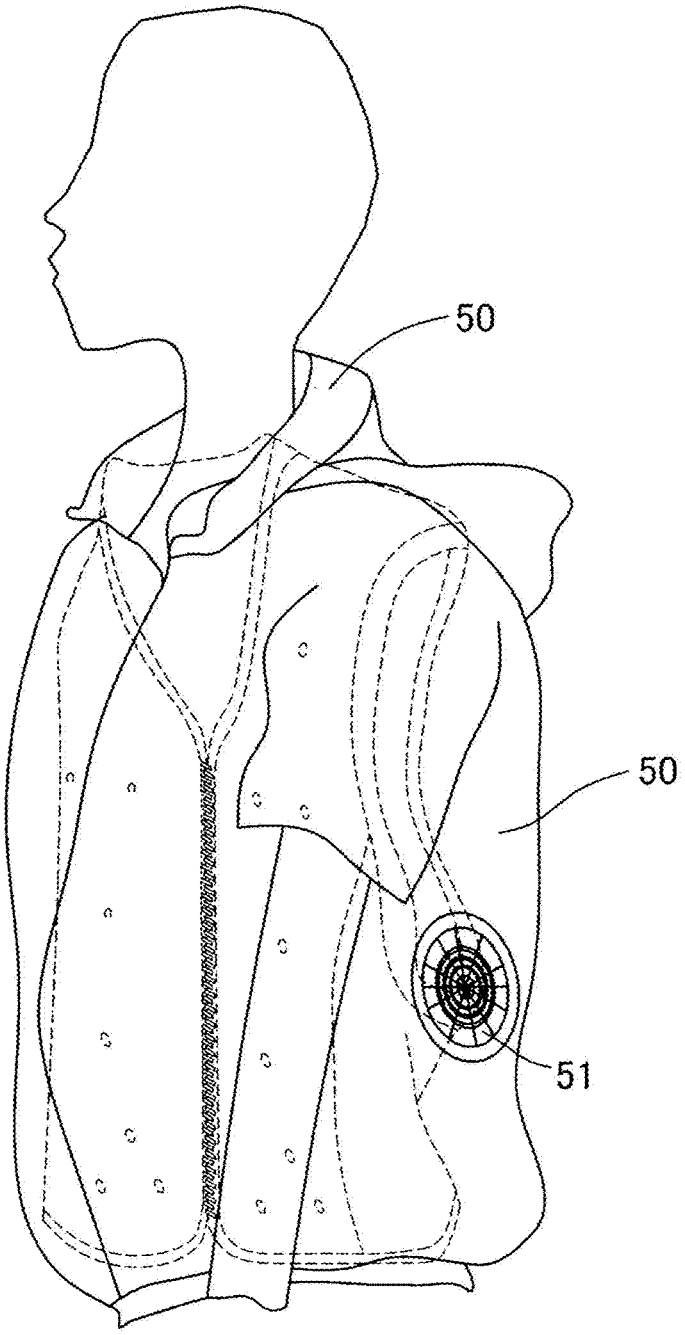
FIG. 19B is a perspective view Illustrating that a person wore an air conditioning function garment over a reversed cooling garment, in a case where a person wears the reversed cooling garment and wears the air conditioning function garment over the cooling garment in Embodiment 7.

FIGS. 19A and 19B are variations of FIGS. 18A and 18B, respectively.

In the variations, the cooling garment 1 is turned inside out (reversed) and attached to the body, as shown in FIG. 19A.

After an operation of overlaying the cooling garment 1 and the air conditioning function garment 50 is the same operation as in FIG. 18B, so the explanation is omitted.

According to the above Embodiment, since the outer layer 30 of the front side material 2 and the outer layer 30 of the back side material 3 in the cooling garment 1 are arranged closest to the body, so the water in the intermediate layer 31 can be vaporized through the outer layer 30 and consequently, the body temperature can be lowered even if a person does not perspire. In addition, the air conditioning function garment 50 allows the outside air to send into the cooling garment 1, so the vaporization of the cooling garment 1 can be promoted and consequently, the body temperature can be lowered faster.

Embodiment 8

Embodiment 8 is an aspect that the cooling garment 1 has an area for storing the water to cool the body for a long time when Embodiment 8 is compared with Embodiment 1.

Figure 21:
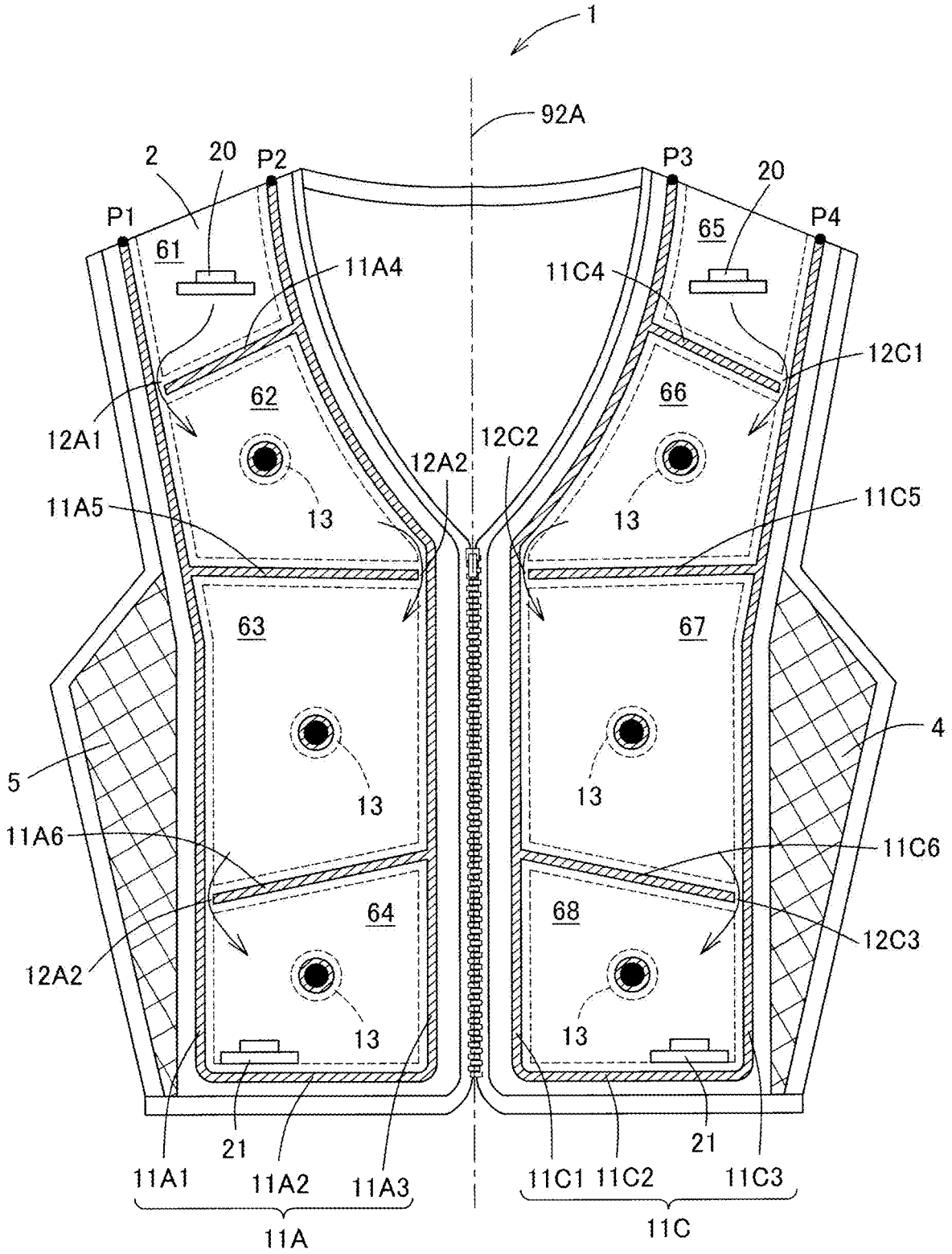
FIG. 21 is a front view of a schematic configuration of a cooling garment in Embodiment 8.
Figure 22:
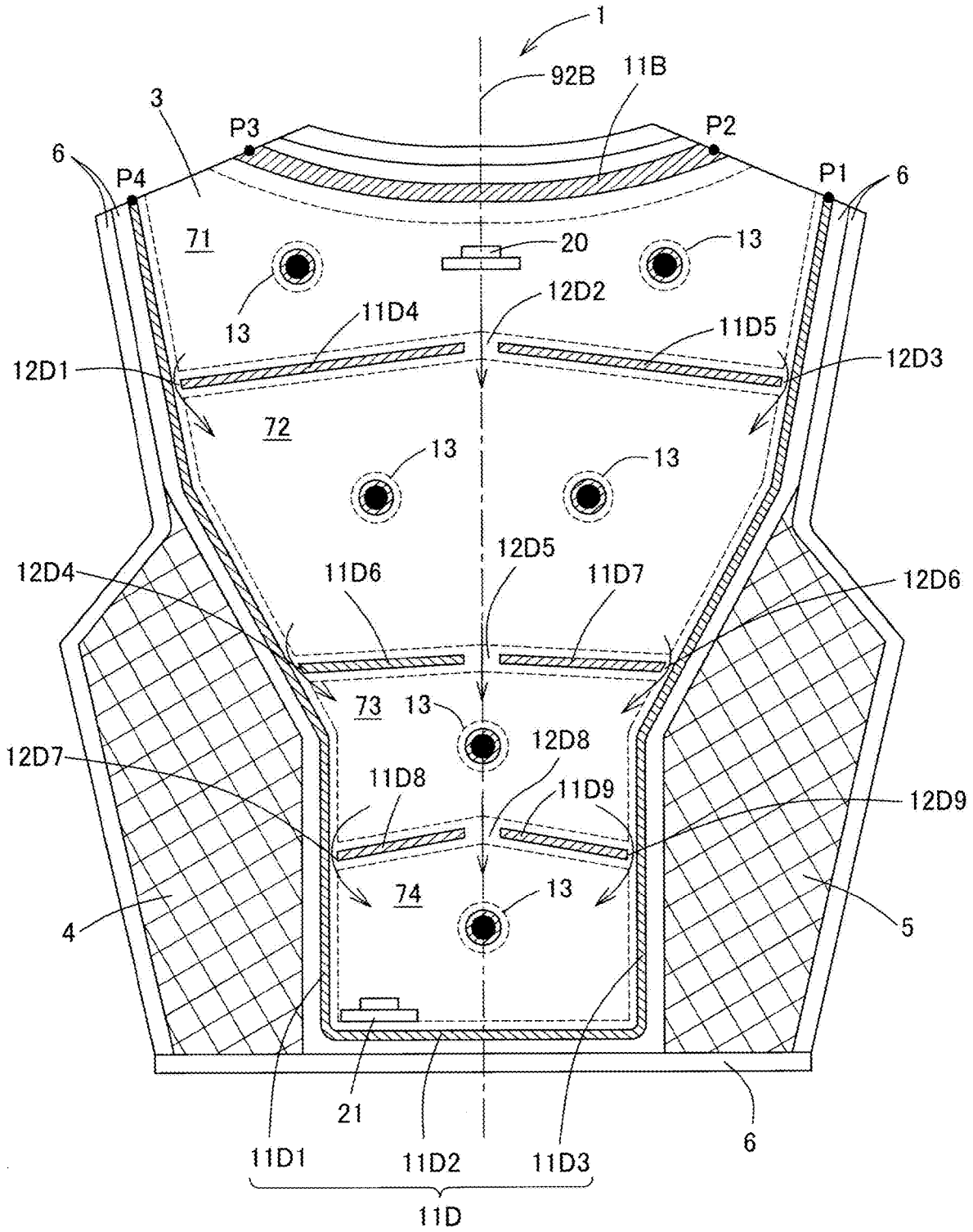
FIG. 22 is a: rear view of a schematic configuration of the cooling garment in Embodiment 8.

FIG. 21 illustrates a front view of a schematic configuration of the cooling garment 1 in Embodiment 8, and FIG. 22 illustrates a rear view of a schematic configuration of the cooling garment 1 in Embodiment 8.

As shown in FIGS. 21 and 22, the pressing bonding part 11 has a continuous outer edge pressing bonding part including pressing bonding parts (11*a*, 11*b*, 11*c*, 11*d*) drawn in a single stroke, as described in Embodiment 1.

Specifically, the outer edge pressing bonding part 11 includes a right front side pressing bonding part 11A, a left front side pressing bonding part 11C, a neck side pressing bonding part 11B, and a back side pressing bonding part 11D.

The right front side pressing bonding part 11A includes a right front side first pressing bonding part 11A1, a right front side second pressing bonding part 11A2, and a right front side third pressing bonding part 11A3.

The left front side pressing bonding part 11C includes a left front side first pressing bonding part 11C1, a left front side second pressing bonding part 11C2, and a left front side third pressing bonding part 11C3.

The back side pressing bonding part 11D includes a back side first pressing bonding part 11D1, a back side second pressing bonding part 11D2, and a back side third pressing bonding part 11D3.

A highest part of the right front side first pressing bonding part 11A1 and a highest part of the back side third pressing bonding part 11D3 are defined as a joint P1 when a person wears the cooling garment 1. At the joint P1, a highest part of the right front side first pressing bonding part 11A1 and a highest part of the back side third pressing bonding part 11D3 are connected. A joint between a highest part of the right front side third pressing bonding part 11A3 and an end of the neck side pressing bonding part 11B is defined as a joint P2.

A joint between a highest part of the left front side first pressing bonding part 11C1 and an end of the neck side pressing bonding part 11B is defined as joint P3.

A highest part of the right front side third pressing bonding part 11A3 and a highest part of the back side first pressing bonding part 11D1 are defined as a joint P4.

At the joint P4, a highest part of the left front side third pressing bonding part 11C3 and a highest part of the back side first pressing bonding part 11D1 are connected.

As shown in FIG. 21, a right front side fourth pressing bonding part 11A4 (also referred to as a slope pressing bonding part 11A4) is branched from the right front side third pressing bonding part 11A3 and is connected to the right front side third pressing bonding part 11A3.

The right front side fourth pressing bonding part 11A4 slopes from a right highest part to a left bottom of a paper of FIG. 21.

In other words, the slope pressing bonding part 11A4 is inclined with respect to a line perpendicular to a centerline 92A (horizontal line).

A right front side first air gap 12A1 is provided between the right front side first pressing bonding part 11A1 and the right front side fourth pressing bonding part 11A4.

A right front side fifth pressing bonding part 11A5 (also referred to as a slope pressing bonding part 11A5) is branched from the right front side first pressing bonding part 11A1 and is connected to the right front side first pressing bonding part 11A1.

The right front side fifth pressing bonding part 11A5 slopes from a left top to a right bottom of the paper of FIG. 21.

A right front side second air gap 12A2 is provided between the right front side third pressing bonding part 11A3 and the right front side fifth pressing bonding part 11A5.

A right front side sixth pressing bonding part 11A6 (also referred to as a slope pressing bonding part 11A6) is branched from the right front side third pressing bonding part 11A3 and is connected to the right front side third pressing bonding part 11A3.

The right front side sixth pressing bonding part 11A6 slopes from a right top to a left bottom left of the paper of FIG. 21.

The right front side third air gap 12A3 is provided between the right front side first pressing bonding part 11A1 and the right front side sixth pressing bonding part 11A6.

The front side material 2 is divided into four areas on the right side and four areas on the left side and the front side material 2 is totally divided into total eight areas.

The four areas on the right side of the front side material 2 are a right front side first area 61, a right front side second area 62, a right front side third area 63 and a right front side fourth area 64.

The four areas on the left side of the front side material 2 are a left front side first area 65, a left front side second area 66, a left front side area 67 and a left front side area 68.

In each of the above areas, the intermediate layer 31 is arranged in a divided state, and each of the above pressing bonding parts surrounds the divided the intermediate layer 31 via the air gap.

In other words, the air gap is provided between each of the above pressing bonding parts and the divided intermediate layer 31.

The right front side first area 61 is the area surrounded by the right front side first pressing bonding part 11A1, the right front side fourth pressing bonding part 11A4 (slope pressing bonding part 11A4), the right front side third pressing bonding part 11A3, and the upper part of the front side material 2 (the line connecting to the joint P1 and the joint P2).

The water inlet 20 is arranged in the right front side first area 61.

As an arrow indicates, the water moves from the right front side first area 61 to the right front side second area 62 through the right front side first air gap 12A1.

The above slope pressing bonding part is inclined with respect to the horizontal line perpendicular to the longitudinal centerline of the cooling garment 1 when a person wears the cooling garment 1.

As the above slope pressing bonding part is inclined with respect to the horizontal line, and gravity causes the water to move from a top of the cooling garment 1 to a bottom of the cooling garment 1 along the above slope pressing bonding part.

As the angle of inclination becomes smaller, the amount of the water flowing from the air gap 12A1 becomes smaller, the angle of inclination being an angle between the horizontal line perpendicular to the longitudinal direction (centerline 92A) of the cooling garment 1 (front side material 2) and the slope pressing bonding part 11A4, and thus the water in the right front side first area 61 can be retained longer. As a result, the body can be cooled longer in the right front side first area 61.

A movement of the water of the intermediate layer 31 in the right front side first area 61 and the right front side second area 62 including the slope pressing bonding part 11A4A is analyzed by a general-purpose thermal fluid analysis software using a finite volume method.

The following procedure is used for the analysis.

(1) First, the cooling garment 1 is arranged on a horizontal table, the water is poured from the water inlet 20, and the water is absorbed uniformly into the intermediate layer 31 of the front side material 2.

At this time, an amount of the water in the intermediate layer 31 is a maximum amount of the water that the water overflows the intermediate layer 31 if any more water is added to the intermediate layer 31.

(2) Next, we analyzed temporal changes in a distribution of the water moving from the right front side first area 61 to the right front side second area 62 when we stood the cooling garment 1 in a vertical direction having the maximum amount of the water in the intermediate layer 31. At this time, a slope angle between a horizontal line perpendicular to the centerline 92A and the slope pressing bonding part 11A4 was changed (from 0 to 90 degrees).

Results of the above simulation will be explained.

The above simulation illustrates that the amount of the water moving from the right front side first area 61 to the right front side second area 62 (the amount of movement) is almost constant in about 10 seconds, even when a slope angle is changed.

After about 10 seconds, the amount of movement per unit time was found to be very small.

If the amount of the water that moves from the right front side first area 61 to the right front side second area 62 after 10 seconds at the slope angle of 90 degrees is a standard (100%) after 10 seconds, (a) After 10 seconds, the amount of the water moved at the slope angle of 45 degrees was approximately 91% to 93% of the above standard.

(b) After 10 seconds, the amount of the water moved at the slope angle of 0 degrees (when horizontal) was approximately 83% to 86% of the above standard.

In other words, it was found that as the slope angle becomes smaller, the amount of the water that moves from the right front side first area 61 to the right front side second area 62 becomes smaller.

It was also found that as the slope angle becomes smaller, the water is stored longer at the right front side second area 62 below the slope pressing bonding part 11A4, (e.g., at a point like the eaves, if the slope pressing bonding part 11A4 is the eaves).

This is presumably due to the following reasons.

The water above the slope pressing bonding part 11A4 tries to move downward due to gravity, but is blocked by the slope pressing bonding part 11A4.

Consequently, the water below the slope pressing bonding part 11A4 is not subject to the pressure of the water above the slope pressing bonding part 11A4, so the water stays at a location of the right front side second area 62 below the slope pressing bonding part 11A4. Thus, as the slope angle becomes smaller, the water can be stored longer in the intermediate layer 31.

On the other hand, when a top of the cooling garment 1 is rounded and the water is drained from the drainage outlet 21, as the slope angle is larger, an amount of the water flowing from the air gap 12A1 can be larger and consequently, the water can be drained smoothly from the drainage outlet 21.

Based on the above simulations, it was found that the slope angle of between 1 degree and 45 degrees is preferable, and the slope angle between 2 degrees and 15 degrees is even more preferable.

The same can be adapted for each of following slope pressing bonding parts.

The right front side second area 62 is an area bounded by the right front side first pressing bonding part 11A1, the right front side fifth pressing bonding part 11A5 (slope pressing bonding part 11A5), the right front side third pressing bonding part 11A3 and the right front side fourth pressing bonding part 11A4 (slope pressing bonding part 11A4).

The water holding part 13 is arranged in the right front side second area 62.

As an arrow indicates, the water moves from the right front area 62 to the right front side third area 63 through the right front side second air gap 12A2.

The right front side second area 62 includes the right front side fifth pressing bonding part 11A5 (slope pressing bonding part 11A5) and the right front side fourth pressing bonding part 11A4 (slope pressing bonding part 11A4).

The right front side second area 62 has a slope pressing bonding part like the slope pressing bonding part 11A5, so the water can be held for a longer time in the right front second side area 62 and the water can be move easily downward when the water is drained from the drainage outlet 21 by rounding the top of the cooling garment 1.

The right front side third area 63 is an area bounded by the right front side first pressing bonding part 11A1, the right front side sixth pressing bonding part 11A6 (slope pressing bonding part 11A6), the right front side third pressing bonding part 11A3 and the right front side fifth pressing bonding part 11A5 (slope pressing bonding part 11A5).

The water holding part 13 is arranged in the right front side third area 63.

As an arrow indicates, the water moves from the right front side third area 63 to the right front side fourth area 64 through a right front side third air gap 12A3.

The right front side third area 63 has the same effect as the right front side second area 62.

The right front side fourth area 64 is an area bounded by the right front side first pressing bonding part 11A1, the right front side second pressing bonding part 11A2, the right front side third pressing bonding part 11A3, and the right front side sixth pressing bonding part 11A6 (slope pressing bonding part 11A6).

The water holding part 13 and the drainage outlet 21 are arranged in the right front side fourth area 64.

The drainage outlet 21 is arranged in a lower right side of the right front side fourth area 64. When the top of the cooling garment 1 is rounded, the water flows out of the right front side third air gap 12A3 arranged on the right side, so the water can be drained faster from the drainage outlet 21 near the right front side third air gap 12A3.

According to the above embodiment, when the water is supplied from the water inlet 20 to the intermediate layer 31 and the front side material 2 on the right side is pushed by a human hand, the water can be supplied to the intermediate layer 31 on the right side of the front side material 2 through the right front side first air gap 12A1, the right front side second air gap 12A2 and the right front side third air gap 12A3.

In addition, the water can be stored in the right front side first area 61, the right front side second area 62, the right front side third area 63, and the right front side forth area 64.

As a result, the above embodiment can cool the body for a long time.

As shown in FIG. 21, when a person observed from the front, the configuration of the right side of the front side material 2 and the configuration of the left side of the front side material 2 are symmetrical with respect to the centerline 92A (in this case, the centerline 92A is a projection of the centerline 92 onto the front side material 2).

Therefore, a composition of the left side of the front side material 2 is omitted from the explanation.

Air gaps are provided at a connection between the right front side third pressing bonding part 11A3 and the right front side fourth pressing bonding part 11A4, a connection between the right front side first pressing bonding part 11A1 and the right front side fifth pressing bonding part 11A5, a connection between the right front side third pressing bonding part 11A3 and the right front side sixth pressing bonding part 11A6, a connection between the left front side first pressing bonding part 11C1 and the left front side fourth pressing bonding part 11C4, a connection portion between the front side third pressing bonding part 11C3 and the front side left fifth pressing bonding part 11C5, and at the connection portion between the left front side first pressing bonding part 11C1 and the front side left sixth pressing bonding part 11C6.

As shown in FIG. 22, when a person observes from the back, the back side fourth pressing bonding part 11D4 (also referred to as the first slope pressing bonding part) slopes from the top right to the bottom left of the paper, starting from the centerline 92B (in this case, the centerline 92B is the projection of the centerline 92 onto the back side material 3).

A back side first air gap 12D1 is provided between the back side first pressing bonding part 11D1 and the side fourth pressing bonding part 11D4.

When the centerline 92B is defined as a starting point, the back side fifth pressing bonding part 11D5 (also referred to as the second slope pressing bonding part) slopes from the upper left to the lower right of the paper.

A back side third air gap 12D3 is provided between the back side third pressing bonding part 11D3 and the back side fifth pressing bonding part 11D5.

The first slope pressing bonding part 11D4 and the second slope pressing bonding part 11D5 are mountainous in shape.

The apex (virtual vertices) of the mountainous shape described above passes through the centerline 92B, and the mountainous shape is symmetrical with respect to the centerline 92B. A back side second air gap 12D2 is provided between one end of the first slope pressing bonding part 11D4 (centerline 92B side) and one end of the second slope pressing bonding part 11D5 (centerline 92B side) (near the virtual apex).

One end of the first slope pressing bonding part 11D4 (centerline 92B side) may be connected to one end of the second slope pressing bonding part 11D5 (centerline 92B side) without the back side second air gap 12D2.

When the centerline 92B is defined as a starting point, the back side sixth pressing bonding part 11D6 (also referred to as the third slope pressing bonding part) slopes from the upper right part to the lower left part of the paper.

A back side fourth air gap 12D4 is provided between the back side first pressing bonding part 11D1 and the back side sixth pressing bonding part 11D6.

When the centerline 92B is defined as a starting point, the back side seventh pressing bonding part 11D7 (also referred to as the fourth slope pressing bonding part) slopes from the upper left to the lower right of the paper.

A back side sixth air gap 12D6 is provided between the back side seventh pressing bonding part 11D7 and the back side third pressing bonding part 11D3.

The third slope pressing bonding part 11D6 and the fourth slope pressing bonding part 11D7 are mountainous in shape.

Since the mountain shape is the same as above, the description is omitted.

When the centerline 92B is defined as a starting point, the back side eighth pressing bonding part 11D8 (also referred to as the fifth slope pressing bonding part) slopes from the upper right part to the lower left part of the paper.

A back side seventh air gap 12D7 is provided between the back side eighth pressing bonding part 11D8 and the back side first pressing bonding part 11D1.

When the centerline 92B is defined as a starting point, The back side ninth pressing bonding part 11D9 (also referred to as the sixth slope pressing bonding part) slopes from the upper left part to the lower right part of the paper.

A back side ninth air gap 12D9 is provided between the back side ninth pressing bonding part 11D9 and the back side third pressing bonding part 11D3.

The back side eighth air gap 12D8 is arranged between one end of the eighth slope pressing bonding part 11D8 (centerline 92B side) and one end of the ninth slope pressing bonding part 11D9 (centerline 92B side).

The eight slope pressing bonding part 11D8 and the nineth slope pressing bonding part 11D9 have a mountain shape.

Since the mountain shape is the same as above, the description is omitted.

The back side material 3 is divided into four areas on the right side.

The four areas of the back side material 3 are a back side first area 71, a back side second area 72, a back side third area 73, and a back side fourth area 74.

The back side first area 71 is the area bounded by the back side first pressing bonding part 11D1, a back side fourth pressing bonding part 11D4, a back side fifth pressing bonding part 11D5, a back side third pressing bonding part 11D3, and the upper part of back side material 3.

Since the water inlet 20 is arranged on the centerline 92B in the back side first area 71, the water can separate and flow evenly along the first slope pressing bonding part 11D4 and the second slope pressing bonding part 11D5.

When the water is supplied to the intermediate layer 31 from the water inlet 20 and the back side material 3 is pressed by a human hand, the water moves from the back side first air gap 12D1, the back side second air gap 12D2 and the back side third air gap 12D3 through the back side first area 71 to the back side second area 72 described below, as the arrow indicates.

Since the water can move from both sides and the center of the back side material 3 from the back side first area 71 to the back side second area 72, the water can be evenly distributed to the intermediate layer 31 in the back side second area 72.

As the slope angle between the horizontal line perpendicular to the longitudinal direction of the cooling garment 1 (back side material 3) and the slope pressing bonding part 11D4 becomes smaller, the amount of water flowing from the back side first air gap 12D1 becomes smaller and the water in the back side second area 72 can be retained longer.

As a result, the body can be cooled longer in the back side second area 72.

On the other hand, when the upper part of the cooling garment 1 is rounded and the water is drained from the drainage outlet 21, as the slope angle is larger, the amount of water that flows from the back side first air gap 12D1 becomes larger, so the water can be drained smoothly from the drainage outlet 21.

Based on the above simulation, from one degree to 45 degrees or less in the slope angle is preferred, and from 2 degrees to 15 degrees or less is even more preferred.

The same is true for each of the slope pressing bonding parts (11D5 through 11D9).

The back side second area 72 is bounded by back side first pressing bonding part 11D1, the back side sixth pressing bonding part 11D6, the back side seventh pressing bonding part 11D7, the back side third pressing bonding part 11D3, the back side fifth pressing bonding part 11D5, and the back side fourth pressing bonding part 11D4.

Two water holding parts 13 are arranged in the back side second area 72.

As the arrows indicate, the water can move from the back side area 72 to the back side third area 73 through the back side forth air gap 12D4, the back side area fifth air gap 12D5, and the back side sixth air gap 12D6.

Configurations and effect of the back side second area 72 is similar to those of the back side first area 71.

The back side third area 73 is bounded by the back side first pressing bonding part 11D1, the back side eighth pressing bonding part 11D8, the back side ninth pressing bonding part 11D9, the back side third pressing bonding part 11D3, the back side seventh pressing bonding part 11D7, and the back side sixth pressing bonding part 11D6.

One water holding part 13 is arranged in the back side third area 73.

As the arrows indicate, the water can move from the back side third area 73 to the back side fourth area 74 through the back side seventh air gap 12D7, the back side eighth air gap 12D8, and the back side ninth air gap 12D9.

The back side fourth area 74 is surrounded by the back side first pressing bonding part 11D1, the back side second pressing bonding part 11D2, the back side third pressing bonding part 11D3, the back side ninth pressing bonding part 11D9, and the back side eighth pressing bonding part 11D8.

One water holding parting area 13 and one drainage outlet 21 are arranged in the back side fourth area 74.

The drainage outlet 21 is arranged at the lower left side of the back side fourth area 74.

When the upper part of the cooling garment 1 is rounded, the water flows out of the back side seventh air gap 12D7 arranged on the left side, the water can be drained faster from the drainage outlet 21 near the back side seventh air gap 12D7.

The drainage outlet 21 may be arranged at the lower part of the right side.

According to the above arrangement, when the water is supplied to the intermediate layer 31 from the water inlet 20 and the back side material 3 is pressed by a human hand, the water is passed to the back side material 3 through the back side first air gap 12D1, the back side second air gap 12D2, the back side third air gap 12D3, and each of the back side fourth air gap 12D4 to the back side ninth air gap 12D9.

In addition, the water can be stored in the back side first area 71, the back side second area 72, the back side third area 73, and the back side fourth area 74.

As a result, the above aspect can cool the body for a long time.

In addition, since the water can move from the back side first area 71 to the back side second area 72 from air gaps on both sides of the back side material 3 and from an air gap in the center, the water can be evenly distributed to the intermediate layer 31 in the back side second area 72.

The back side third area 73 and the back side fourth area 74 are the same as above.

When the upper part of the cooling garment 1 is rounded, the water can be discharged smoothly through the drainage outlet 21.

The front side material 2 may also have a mountain-shaped slope pressing bonding part such that the back side material 3 has the mountain-shaped slope pressing bonding part.

Although the right front side fourth pressing bonding part 11A4 is connected to the right front side third pressing bonding part 11A3, an air gap may be provided between the right front side fourth pressing bonding part 11A4 and the right front side third pressing bonding part 11A3. However, in the above case, the air gap meets at least one or more of the following conditions;

(Condition 1) When the water is supplied from the water inlet 20 of the cooling garment 1 and the cooling garment 1 is worn by a person, the water is stored in the right front side first area 61 and a water level of the stored water is above the air gap in the right front side first area 61, and the front side material 2 of the right front side first area 61 is not pushed by the hand of the person, then the water does not move from the right front side first area 61 (upper area) to the right front side second area 62 (lower area) through the air gap.

(Condition 2) When the water is stored in the right front side first area 61 and the right front side first area 61 is pushed by a human hand, the water can move from the right front side first area 61 to the right front side second area 62 through the air gap.

Embodiment 9

Figure 23:
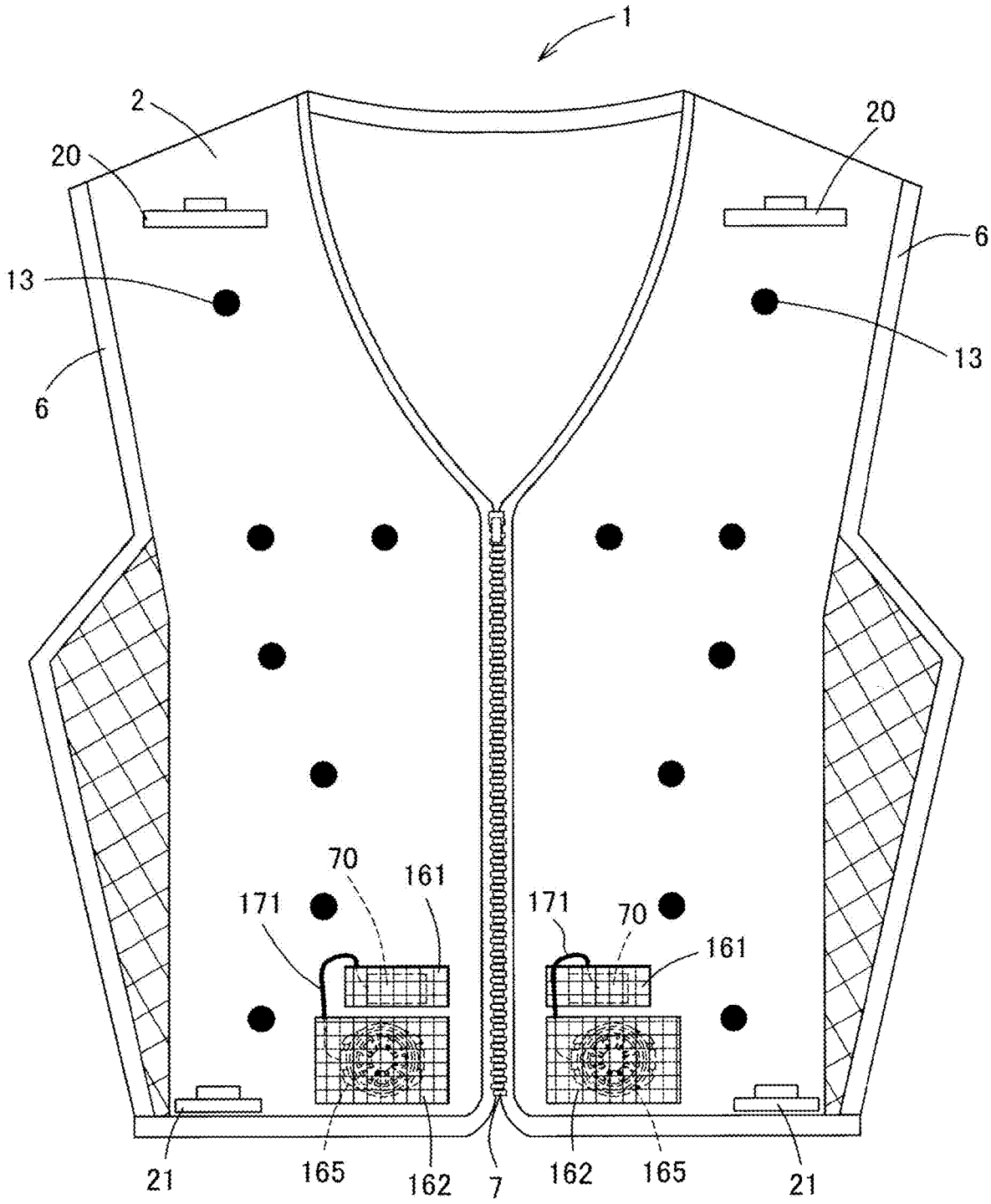
FIG. 23 is a front view of a schematic configuration of a cooling garment in Embodiment 9.
Figure 24:
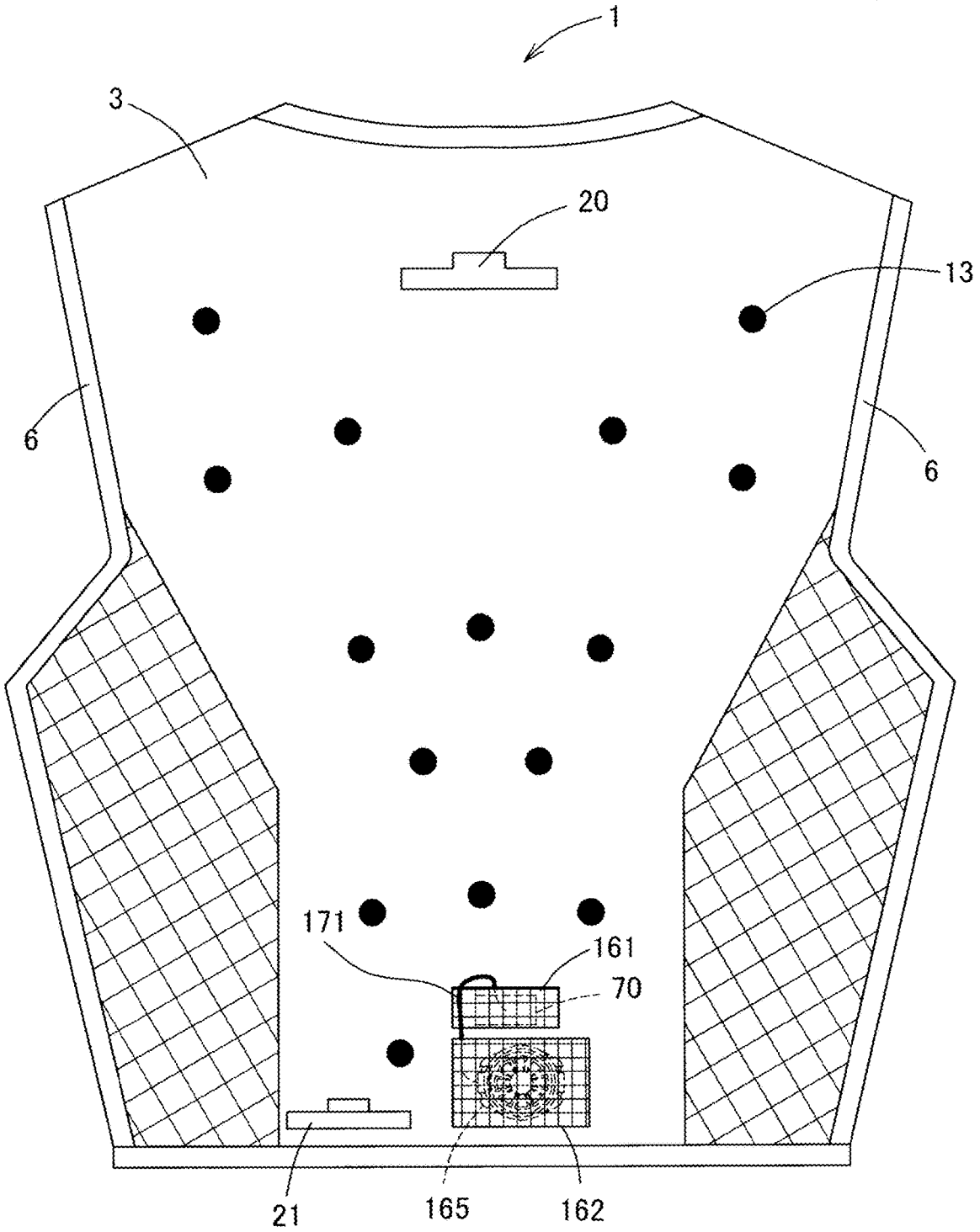
FIG. 24 is a: rear view of a schematic configuration of the cooling garment in Embodiment 9.
Figure 25A:
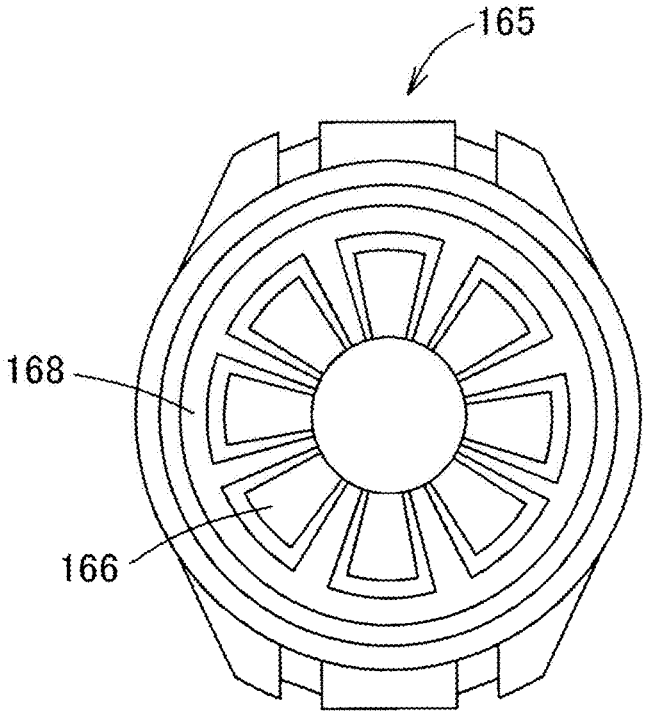
FIG. 25A is a plan view of a schematic configuration of a Peltier unit in Embodiment 9.
Figure 25B:
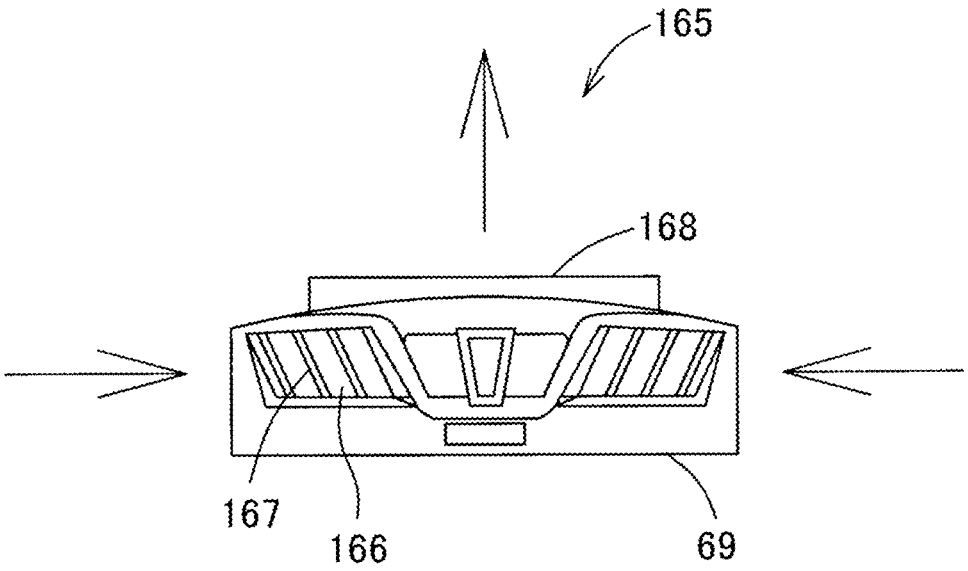
FIG. 25B is a front view of a schematic configuration of the Peltier unit in Embodiment 9.

Embodiment 9 is an aspect in which a Peltier element unit 165 is arranged to cool the water in the intermediate layer 31 of the cooling garment 1 and can cool the body for a long time. FIG. 23 is a front view of a schematic configuration of the cooling garment in Embodiment 9. FIG. 24 is a rear view of a schematic configuration of the cooling garment in Embodiment 9. FIG. 25A is a plan view of a schematic configuration of the Peltier element unit 165 in Embodiment 9, and FIG. 25B is a front view of a schematic configuration of the Peltier element unit 165 in Embodiment 9.

As shown in FIG. 23, pockets 162 for the Peltier element units and pockets 161 for batteries are arranged symmetrically around the central axis of fastener 7 in the lower part of the front side material 2.

As shown in FIG. 24, a pocket 162 for the Peltier element unit and a pocket 161 for the battery are arranged at the lower part of the back side material 3.

The pocket 162 for the Peltier element unit and the pocket 161 for the battery are mesh pockets through which air can pass easily.

The pocket 162 for the Peltier element unit houses the Peltier element unit 165 and the pocket 161 for the battery houses the battery 70.

The Peltier element unit 165 is connected to the battery 70 by a connection cord 171. The connection cord 171 is for example preferably a Type-C capable cord that can be connected to a mobile battery.

As shown in FIG. 25A, the Peltier element unit 165 includes a Peltier element, not shown, a heat exhaust fan 166, an air intake 167, an exhaust part 168 and a metal plate 69 that is cooled by a cooling part of the Peltier element.

As shown in FIG. 25B, the metal plate 69 is cooled by the cooling part of the Peltier element, and when the heat exhaust fan 166 rotates, air around the Peltier element unit 165 is sucked from the air intake 167. Then, the air heated by a heating part of the Peltier element is discharged from the exhaust part 168 in an upward direction of the Peltier element unit 165.

As shown in FIG. 23, an outer mesh of the pocket 162 for the Peltier element unit is contacted with the heat exhaust fan 166 of the Peltier element unit 165. A surface material inside the pocket 162 for the Peltier element unit in the front side material 2 is contacted with the metal plate 69 of the Peltier element unit 165.

The air heated by the heat exhaust fan 166 is discharged from the mesh. On the other hand, the metal plate 69 cools the water held by the intermediate layer 31 of the front side material 2.

According to the above Embodiment, as the Peltier element unit 165 is arranged at a part (for example, at a lower part of the cooling garment 1) in the cooling garment 1 where the water tends to store and cools the water, the Peltier element unit 165 can cool the body for a long time.

In addition, three batteries 70 are accommodated in three battery pockets 161 in FIGS. 23 and 24. However, since the cooling garment 1 becomes heavier by the three batteries 70, a person can wrap a waist pouch around a waist, the three pockets 161 for batteries in the cooling garment 1 are eliminated, and a configure that the three batteries 70 are arranged in the waist pouch is possible.

In other words, the three batteries 70 and the three Peltier element units 165, which are arranged in the waist pouch, are electrically connected to the connection cords 171.

Instead of three batteries 70, one battery 70 arranged in the waist pouch may be electrically connected to each of the three Peltier element units 165 with the connection cords 171. According to the above embodiment, the weight of the cooling garment 1 can be lightened.

Embodiment 10

Embodiment 10 is an aspect that a person's side of the body is cooled by a cooling garment 100, and can cool the body even more than Embodiment 1.

Figure 26A:
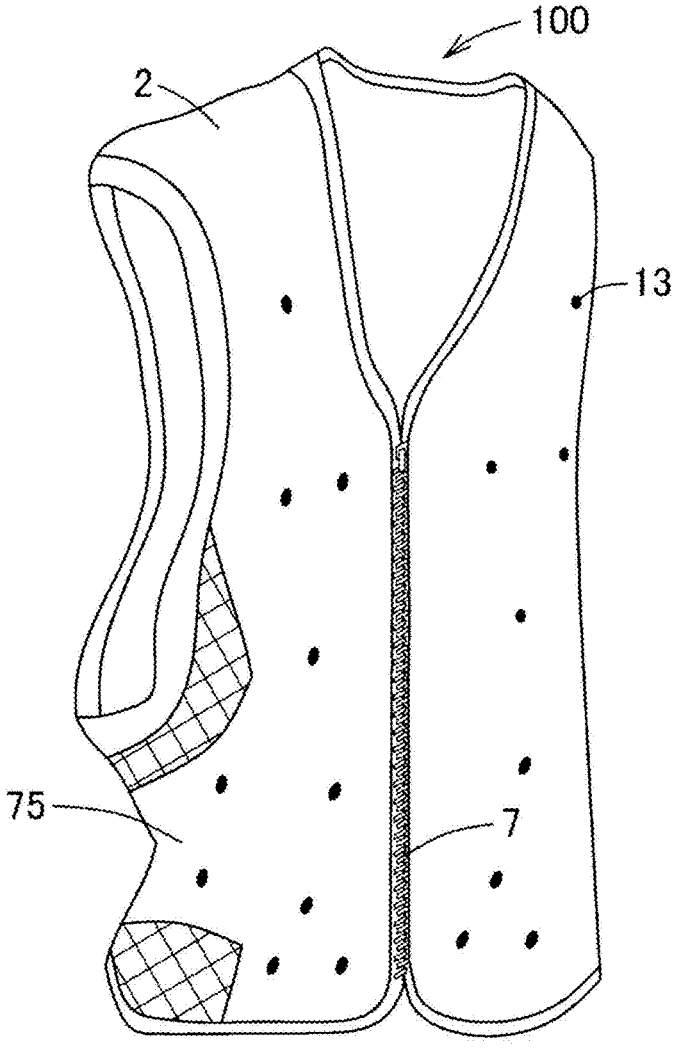
FIG. 26A is a perspective view of a schematic configuration of a cooling garment which is observed from a left side in Embodiment 10.
Figure 26B:
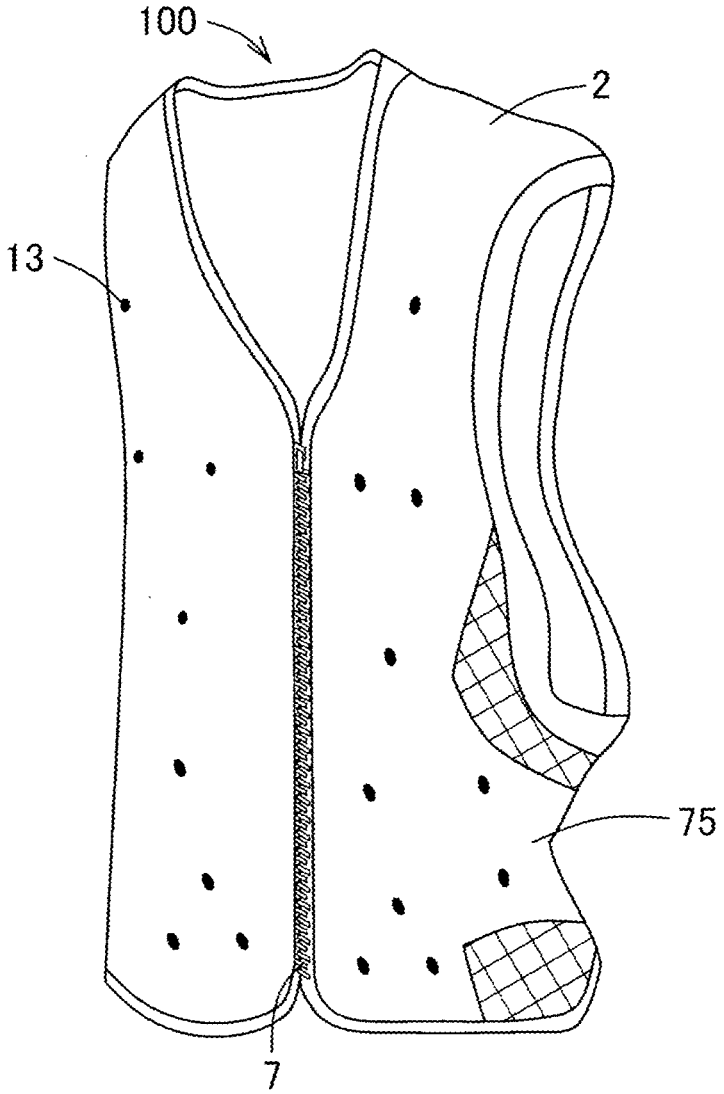
FIG. 26B is a perspective view of a schematic configuration of the cooling garment which is observed from a right side in Embodiment 10.

FIG. 26A is a front perspective view of a schematic configuration of the cooling garment 100 in Embodiment 10 when a person observes from a left side of it and FIG. 26B is a front perspective view of a schematic configuration of the cooling garment 100 in Embodiment 10 when a person observes from a right side of it.

As shown in FIGS. 26A and 26B, a side material 75 is connected to the front side material 2 with the back side material 3 at a left person's side and a right person's side.

The side material 75 includes the outer layer 30, the intermediate layer 31, and the inner layer 32, similar to the front side material 2 and the back side material 3. The intermediate layer 31 is continuously connected in the front side material 2, back side material 3, and the side material 75.

Figure 27A:
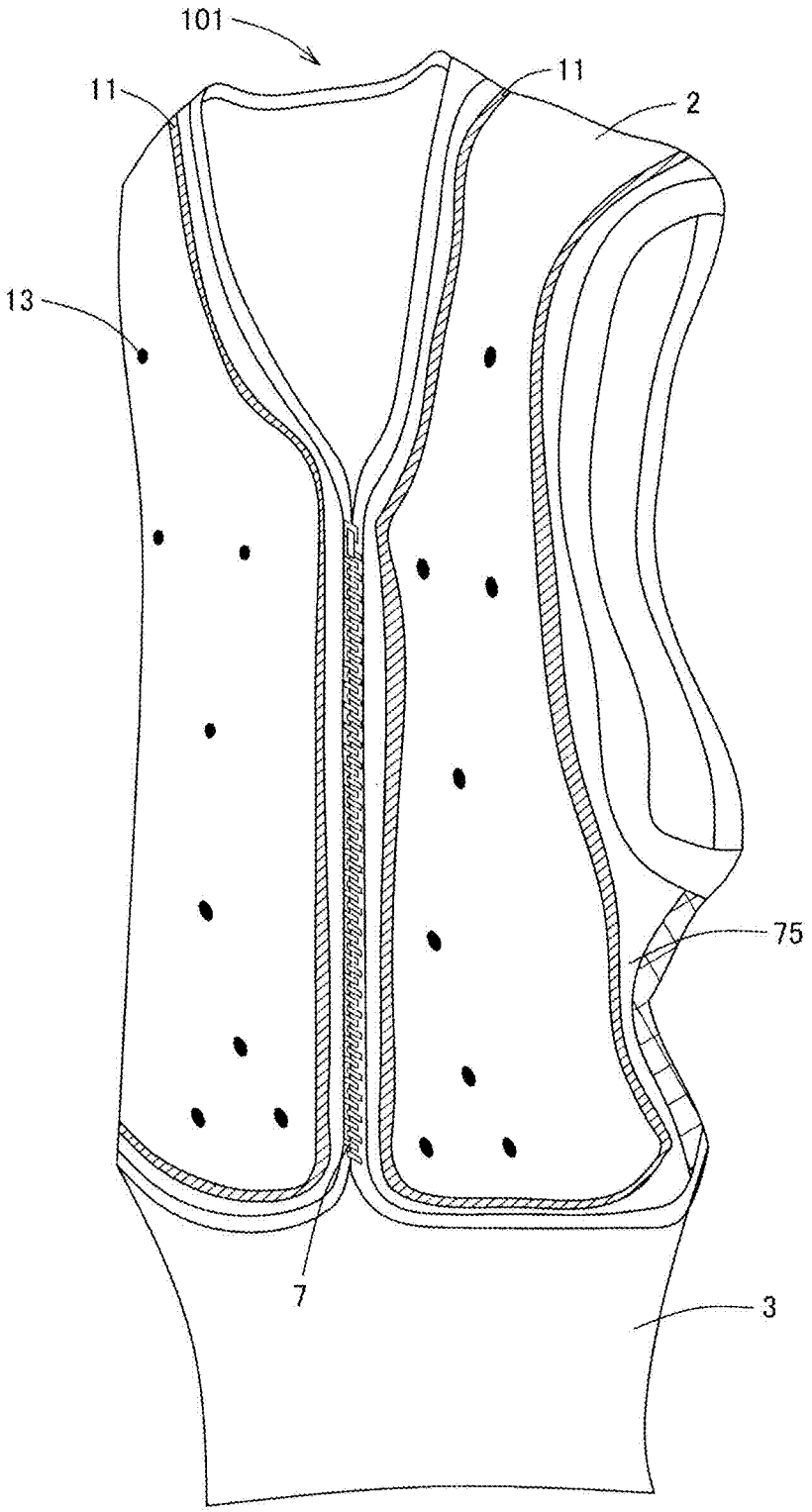
FIG. 27A is a perspective view of a schematic configuration of another cooling garment which is observed from a left side in Embodiment 10.
Figure 27B:
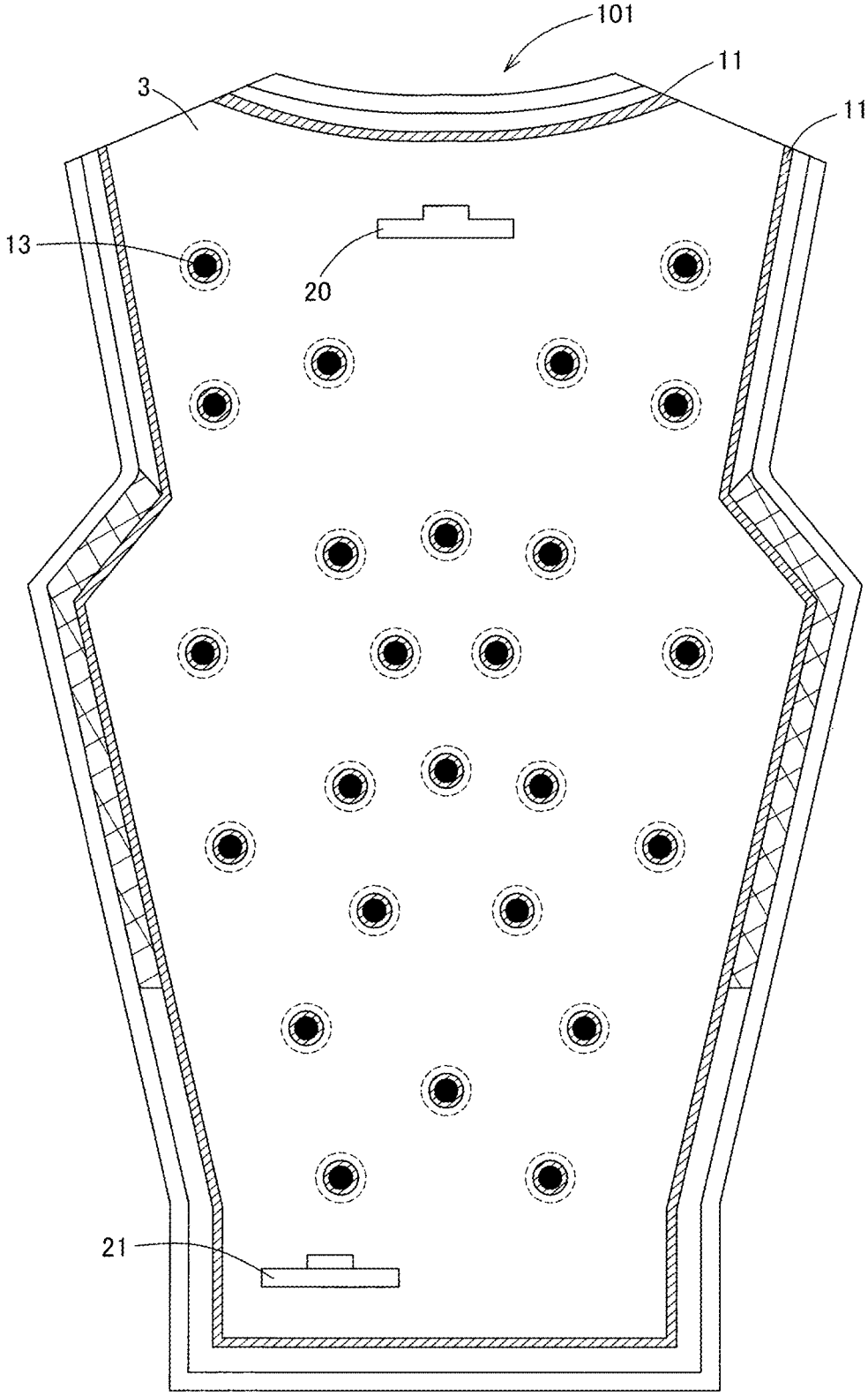
FIG. 27B is a rear view of a schematic of another cooling garment in Embodiment 10.

FIG. 27A is a front perspective view of a schematic configuration of another cooling garment 101 in Embodiment 10 when a person observes from a left side of it and FIG. 27B is a rear perspective view of a schematic configuration of another cooling garment 101 in Embodiment 10.

As shown in FIGS. 27A and 27B, the side material 75 employs a stretchable elastic mesh for a size adjustment. In this case, the intermediate layer 31 of the front side material 2 is not connected to the intermediate layer 31 of the back side material 3.

According to the above Embodiment, the cooling garments 100 and 101 can cool the person's sides and cool the entire body.

Figure 20:
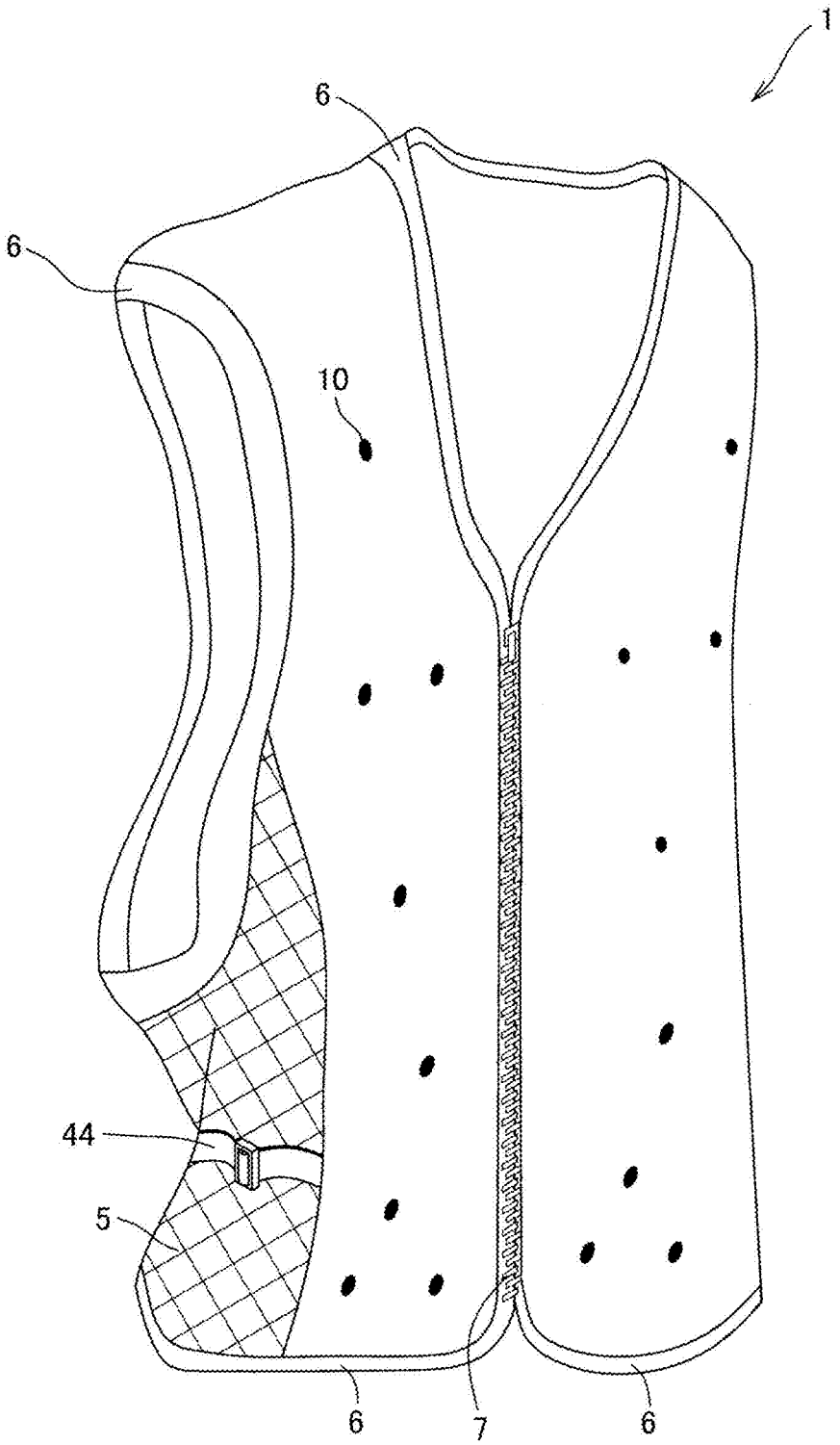
FIG. 20 is a perspective view of a cooling garment using adjuster which is observed from a left side.

An adjuster 44 may be provided on the stretchable elastic mesh for a size adjustment in FIGS. 27A and 27B as shown in FIG. 20.

Instead of the stretchable elastic mesh for a size adjustment, only mesh and the adjuster 44 may be provided.

Embodiment 11

Embodiment 11 is an aspect that mainly a thorax and a back (back part) which are upper parts of person's body is cooled in the cooling garments 102, 103, and 104 for users who do not want to cool an abdomen.

Figure 28:
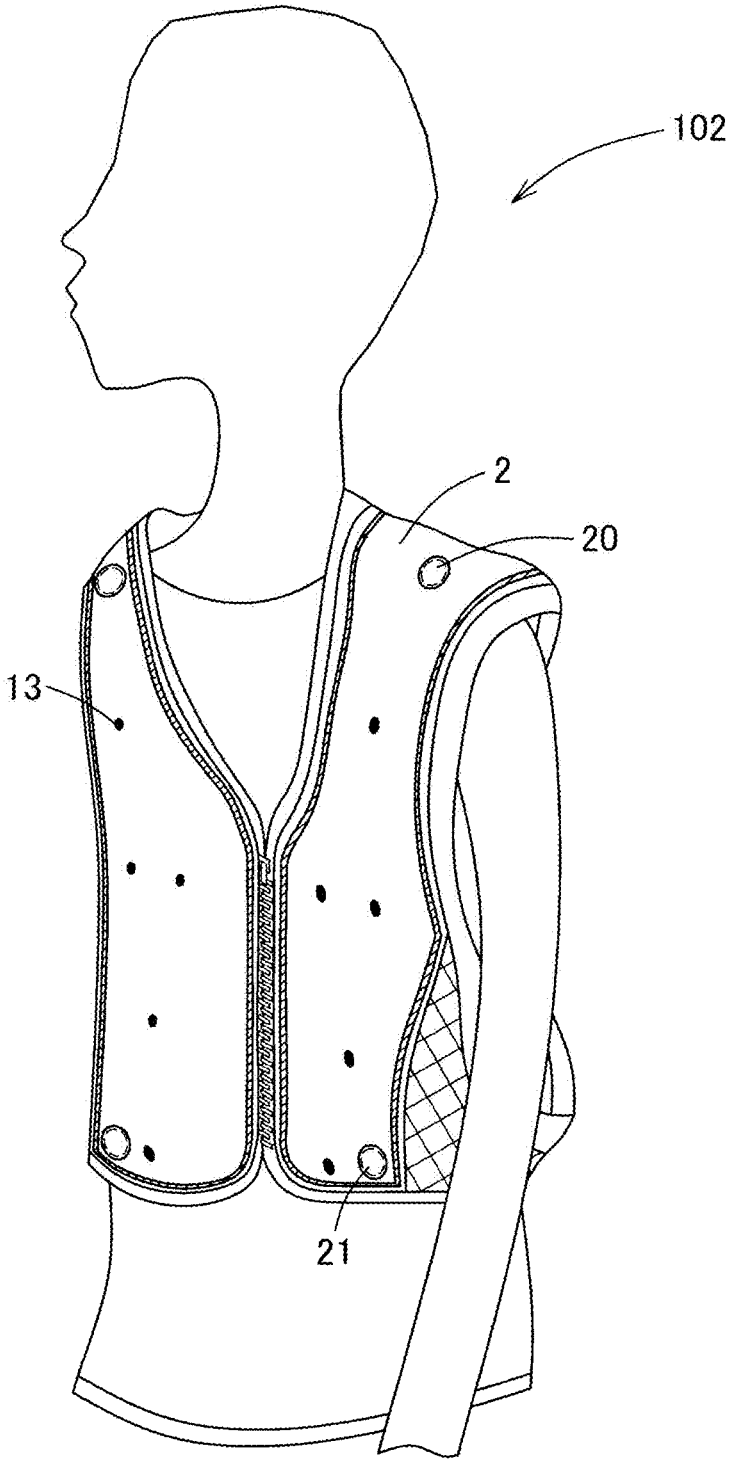
FIG. 28 is a front perspective view of a schematic configuration of a cooling garment which is observed from a right side in Embodiment 11.

FIG. 28 is a front perspective view of a schematic configuration of the cooling garment 102 in Embodiment 11 when a person observes from a right side of it.

As shown in FIG. 28, the front side material 2 of the cooling garment 102 is shortened to cool the thorax so that it does not cover the abdomen.

The front side material 2 of the cooling garment 102 may cover a part of the abdomen according to a user.

The back side material 3 of the cooling garment 102 is shortened to cool the back so that it does not cover a waist.

The back side material 3 of the cooling garment 102 may cover a part of the waist according to a user.

The water inlet 20 and the drainage outlet 21 are provided in the front side material 2 of the cooling garment 102 and two drainage outlets 21 are provided in the front side material 2 of the cooling garment 102.

Figure 29A:
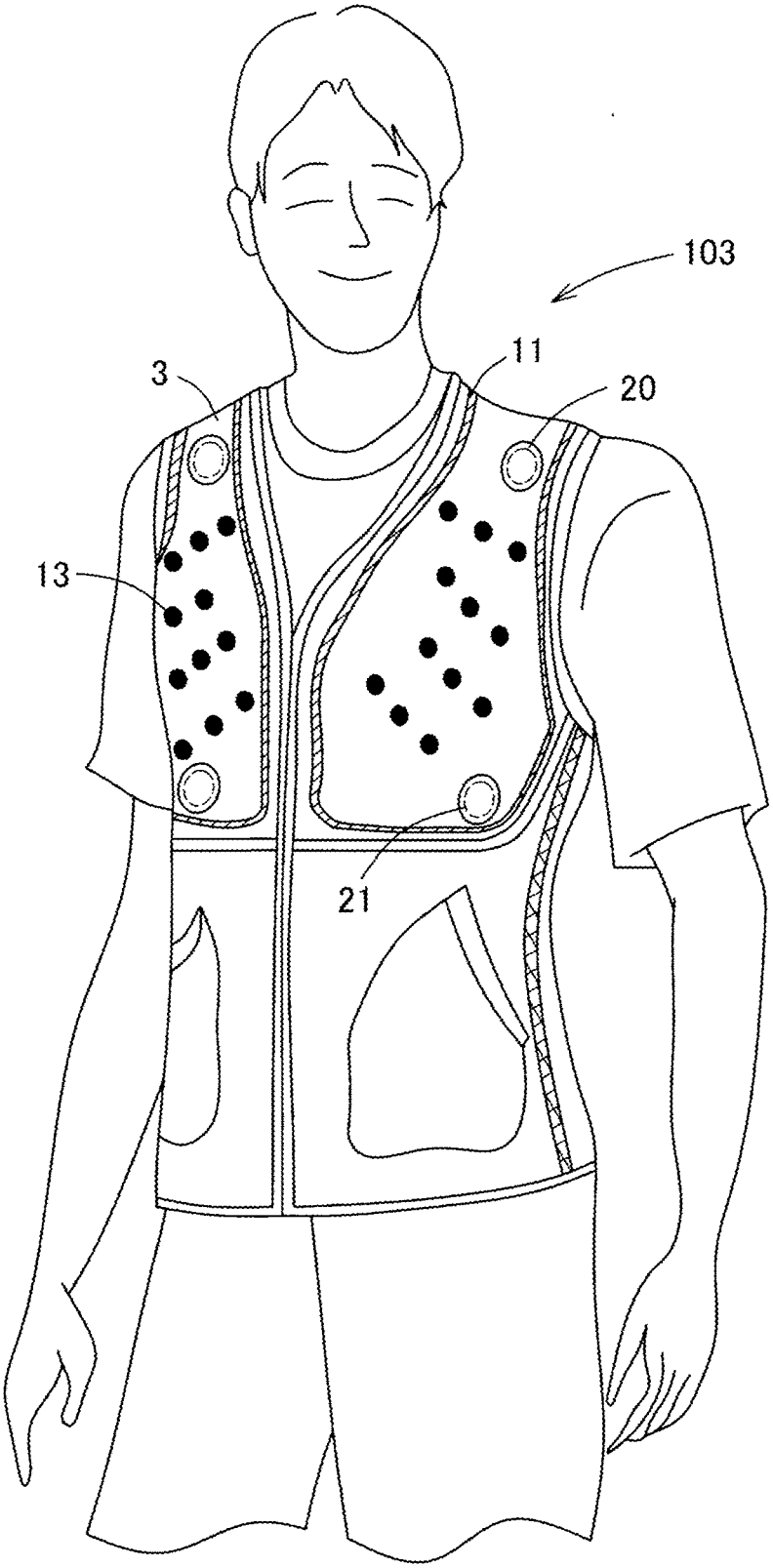
FIG. 29A is a perspective view of a schematic configuration of another cooling garment which is observed from a right side in Embodiment 11.
Figure 29B:
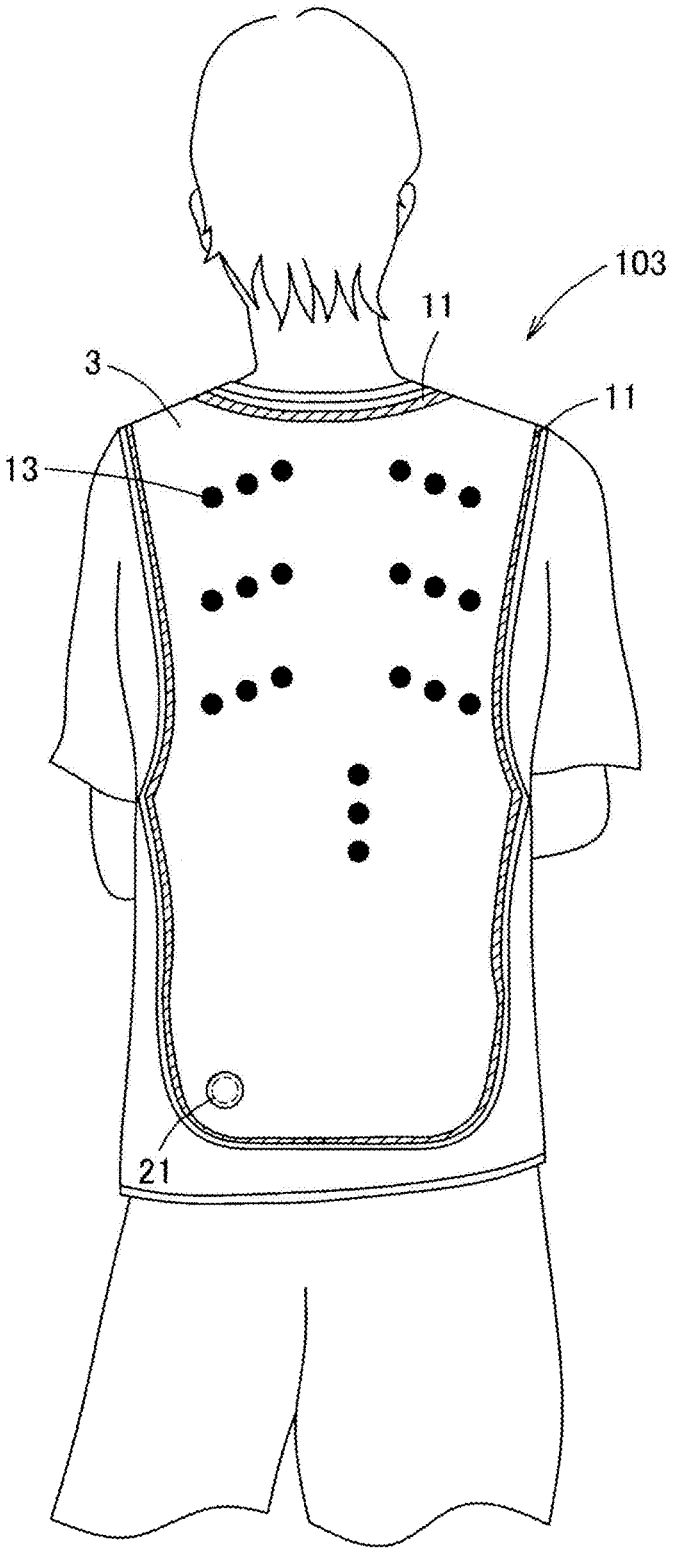
FIG. 29B is a rear view of a schematic of another cooling garment in Embodiment 11.

FIG. 29A is a front perspective view the of a schematic configuration of another cooling garment 103 in Embodiment 11 when a person observes from a right side of it and FIG. 29B is a rear view of a schematic configuration of another cooling garment 103 in Embodiment 11. As shown in FIG. 29A, like FIG. 28, the front side material 2 of the cooling garment 103 is shortened to cool the thorax so that it does not cover the abdomen. A material of the abdomen is a common material (e.g., polyester) that does not include the intermediate layer 31.

Each of the sides has the mesh similar to FIGS. 27A and 27B.

The water inlet 20 and the drainage outlet 21 are provided in the front side material 2 of the cooling garment 103 and one drainage outlet 21 is provided in the back side material 3 of the cooling garment 103.

Figure 30A:
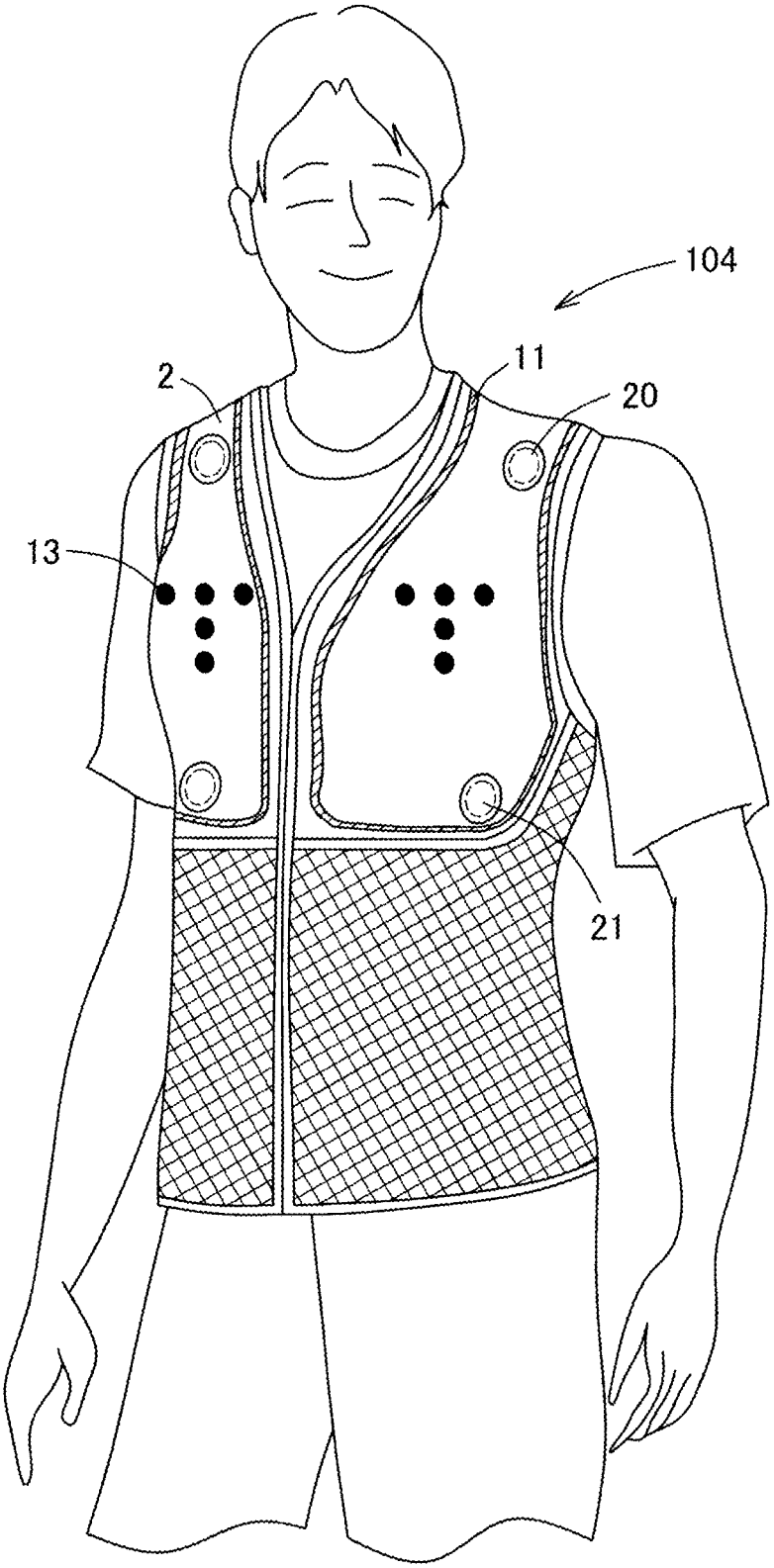
FIG. 30A is a front perspective view of a schematic configuration of another cooling garment which is observed from a right side in Embodiment 11.
Figure 30B:
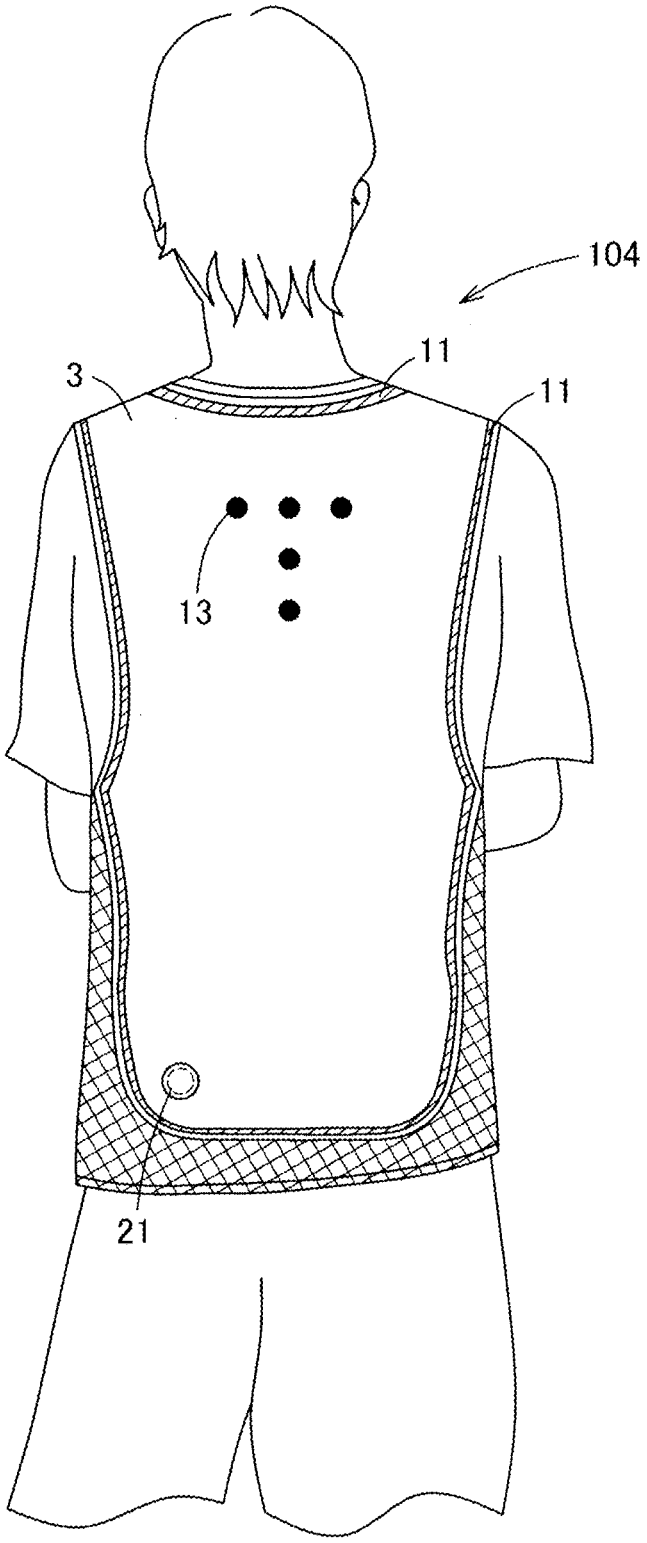
FIG. 30B is a rear view of a schematic of another cooling garment in Embodiment 11.

FIG. 30A is a front perspective view of a schematic configuration of yet another cooling garment 104 in Embodiment 11 when a person observes from a right side of it and FIG. 30B is a rear view of a schematic configuration of yet another cooling garment 104 in Embodiment 11.

As shown in FIGS. 30A and 30B, the front side material 2 and back side material 3 of the cooling garment 104 differs from a point that the material of the abdomen of the cooling garment 103 in FIGS. 29A and 29B constitutes by the stretchable mesh, and the other constitution is the same constitution.

The constitution shown in FIGS. 30A and 30B can accommodate different sizes of users.

According to the above Embodiment, the cooling garments 102, 103, and 104 are configured in a short length to cool mainly the thorax and the back of the body, thus a correspondence to users who do not want to cool their abdomen becomes capable.

Embodiment 12

Embodiment 12 is an aspect that the person side in which a person feels cool is cooled for long time by the cooling garment 105.

Figure 31:
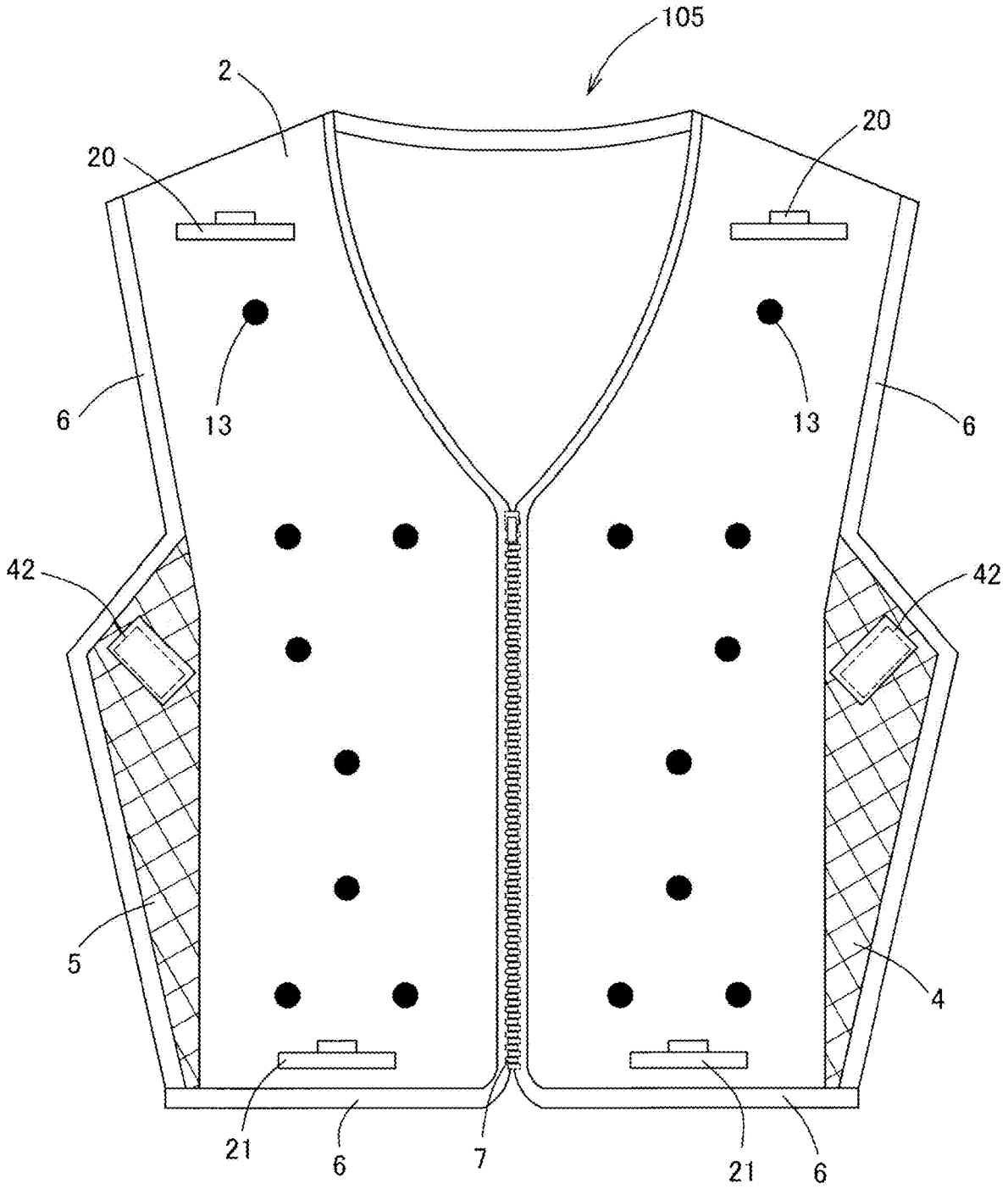
FIG. 31 is a front view of a schematic configuration of a cooling garment in Embodiment 12.
Figure 32:
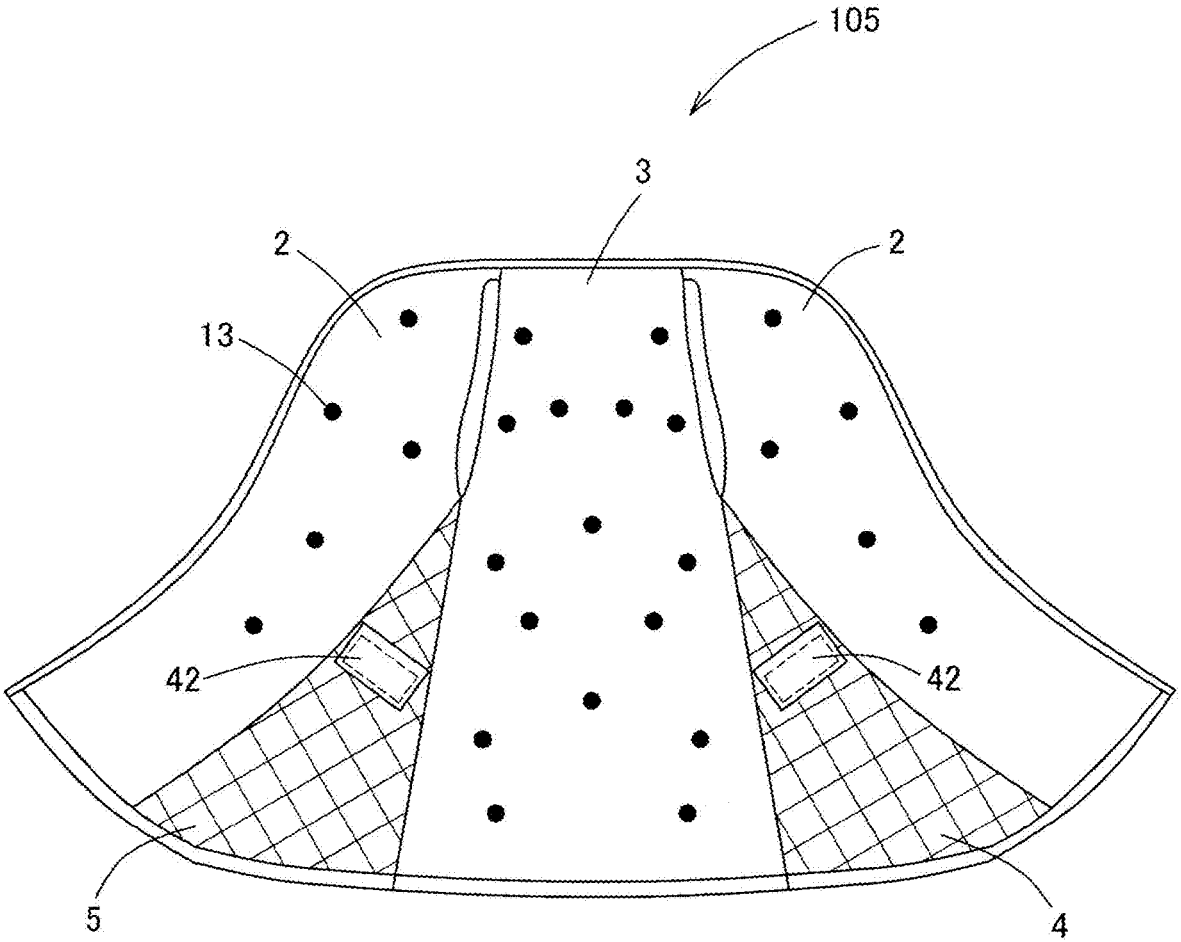
FIG. 32 is a rear view of a schematic configuration of the cooling garment in Embodiment 12.

FIG. 31 is a schematic front view of the cooling garment 105 in Embodiment 12 and FIG. 32 is a schematic view of the inside of the front side material 2 of the cooling garment 105 in Embodiment 12.

As shown in FIGS. 31 and 32, in Embodiment 12, two pockets 42 for holding the refrigerant 43 are arranged at a left person side and a right person side on a surface of the front side material 2 and an inside of the front side material 2.

According to the above Embodiment, the person side in which a person feels cool can be cooled for long time.

Embodiment 13

Embodiment 13 is an aspect in which temperature indicator material 80 is arranged on the cooling garments 106 and 107 to visually capture whether the water is supplied into the cooling garments 106 and 107 has been evenly distributed.

Figure 33:
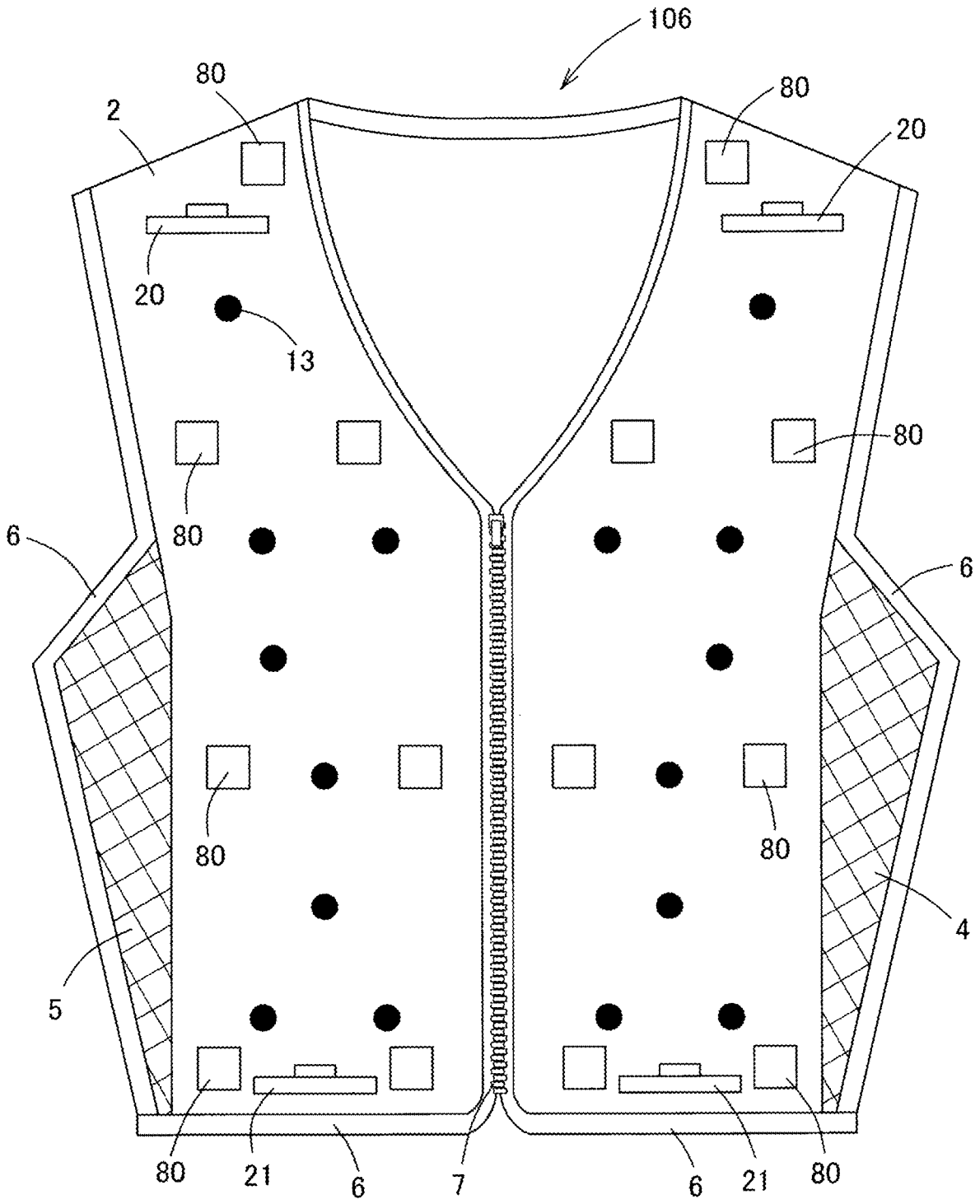
FIG. 33 is a front view of a schematic configuration of a cooling garment in Embodiment 13.
Figure 34:
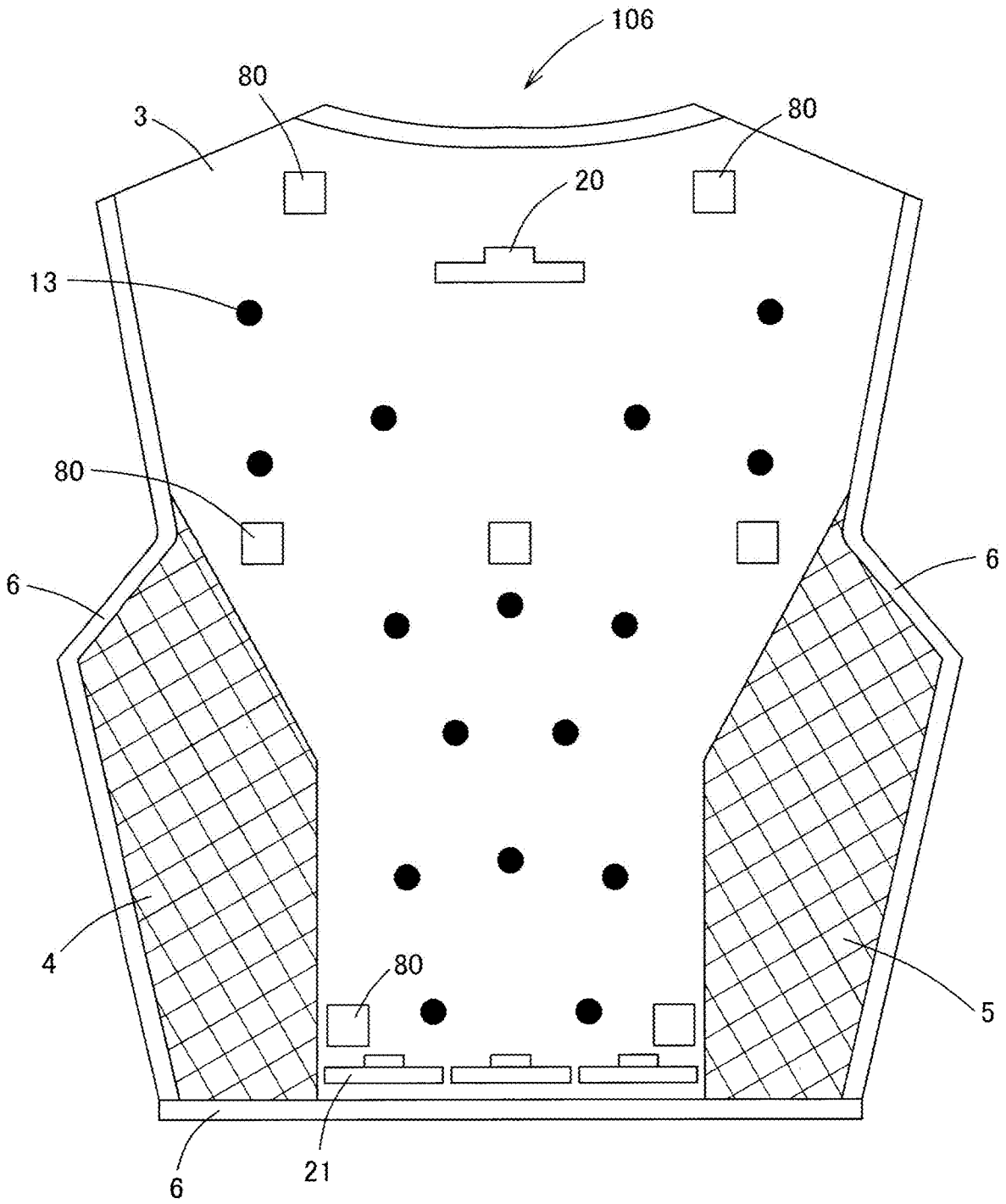
FIG. 34 is a rear view of a schematic configuration of the cooling garment in Embodiment 13.
Figure 35:
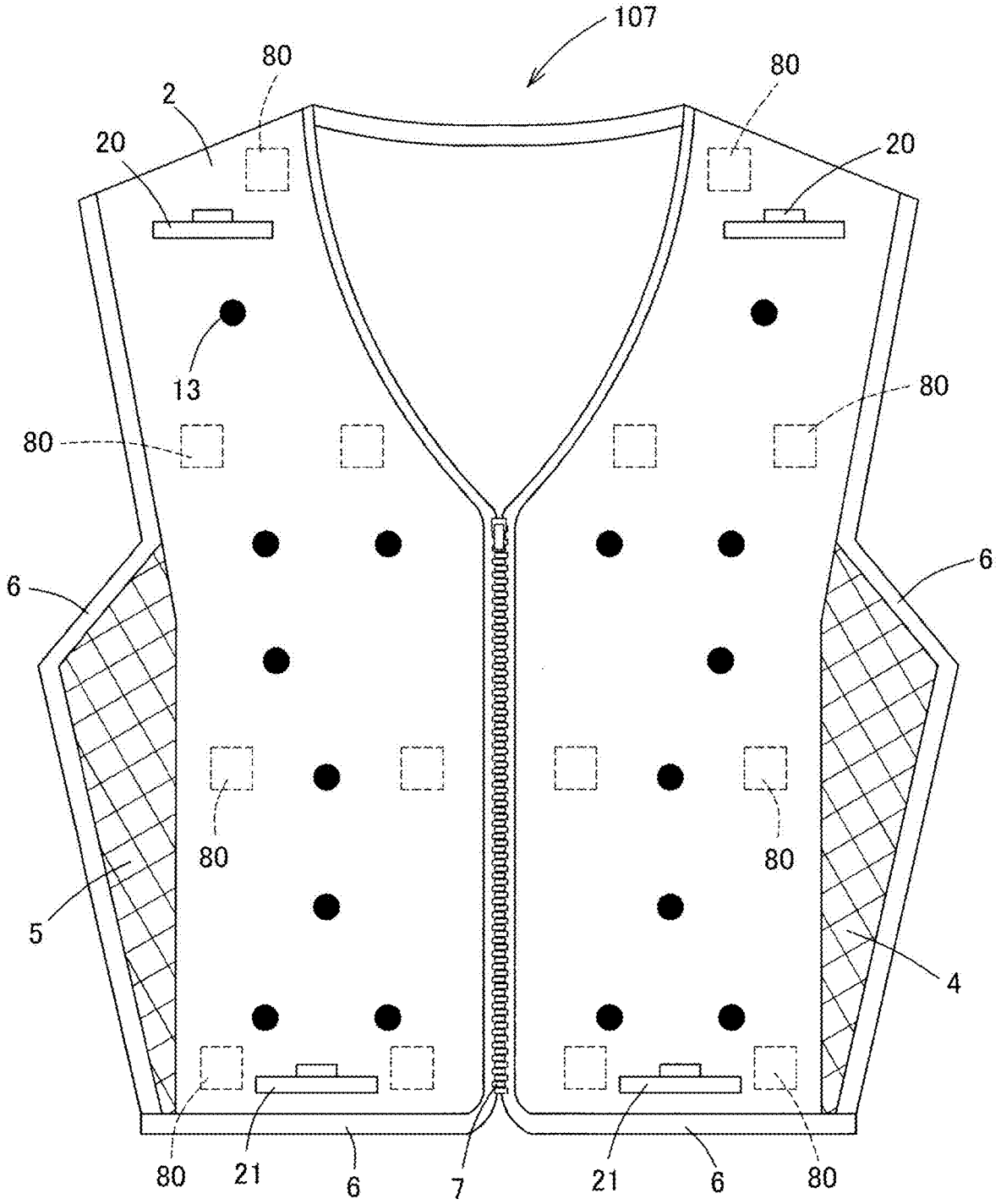
FIG. 35 is a front view of a schematic configuration of another cooling garment in Embodiment 13.

FIG. 33 is a front view of a schematic configuration of the cooling garment 106 in Embodiment 13, FIG. 34 is a rear view of a schematic configuration of the cooling garment in Embodiment 13 and FIG. 35 is a front view of a schematic configuration of another cooling garment 107 in Embodiment 13.

As shown in FIGS. 33 and 34, the temperature indicator materials 80 are arranged from upper parts to lower parts of the front side material 2 and the back side material 3 in the cooling garment 106.

The temperature indicator material 80 is a temperature sensing material using a special material that changes color when a specific temperature is reached and the temperature sensing material such as DIGITALTHERMOTAPE (registered trademark) of Nichiyu Giken Kogyo Co., Ltd. can be used.

The water (e.g., the water with a temperature between 2 and 10 degrees Celsius) is poured from the water inlet 20 and the cold water is pushed and stroke the cooling garment 106 downward from near the water inlet 20 of the cooling garment 106 with a human hand, and the cold water is pushed into the lower part of the cooling garment 106.

At that time, a color of the temperature indicator material 80 arranged at the upper part of the cooling garment 106 changes, then a color of the temperature indicator material 80 arranged downward changes in sequence, and finally a color of the temperature indicator material 80 arranged at the lower part of the cooling garment 106 changes.

FIG. 35 is a front view of a schematic configuration of another cooling garment 107 in Embodiment 13.

The temperature indicator material 80 is arranged inside of the cooling garment 107 and a color change of the temperature indicator material 80 becomes invisible from the outside and the cooling garment 107 retains an outside design of the cooling garment 107.

According to the above Embodiment, it can be seen that the water is evenly spread over the entire cooling garment 106 by the temperature indicator material 80.

And a user does not need to supply more the water than necessary.

Embodiment 14

Embodiment 14 is an aspect that a radiative cooling material 85 is covered over the cooling garment 1.

Figure 36:
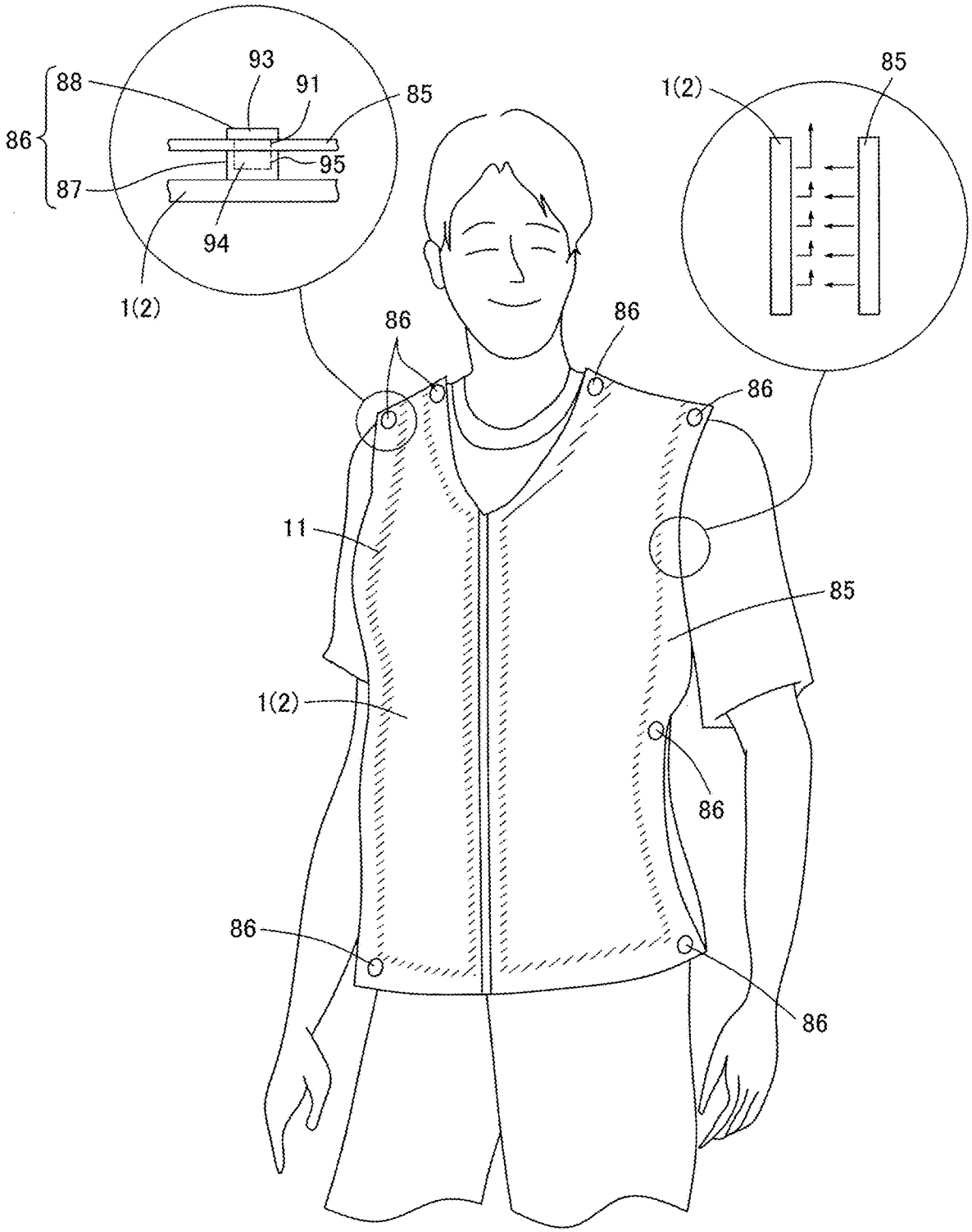
FIG. 36 is a front view of a schematic configuration of a radiative cooling material in Embodiment 14.
Figure 37:
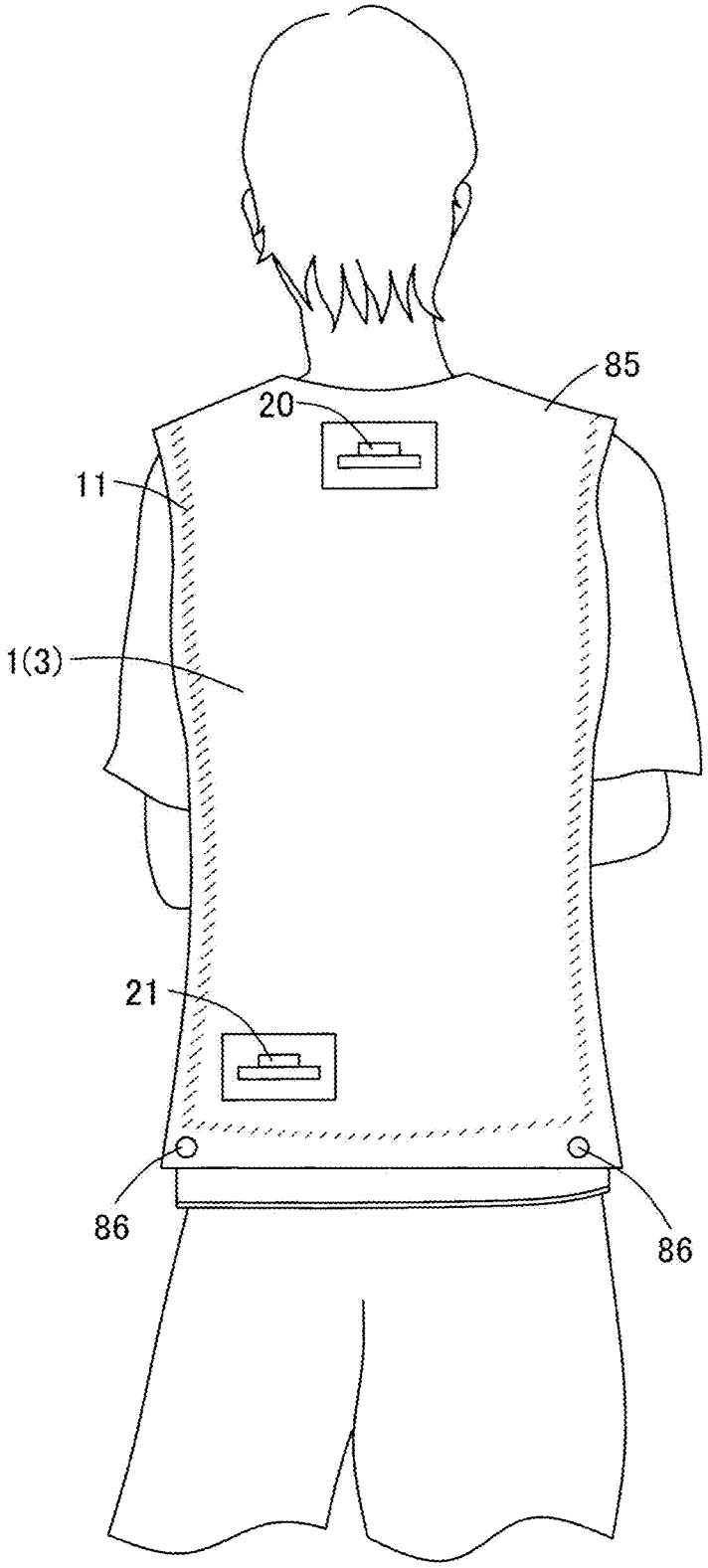
FIG. 37 is a rear view of a schematic of the radiative cooling material in Embodiment 14.

FIG. 36 is a front view of a schematic configuration of the radiative cooling material 85 in Embodiment 14 and FIG. 37 is a back view of a schematic configuration of the radiative cooling material 85 in Embodiment 14.

As shown in FIGS. 36 and 37, the radiative cooling material 85 is covered over the cooling garment 1.

The cooling garment 1 adopts the cooling garment 1 in Embodiment 1 and schematically describes the cooling garment 1 in Embodiment 1.

In FIGS. 36 and 37, an outer edge pressing bonding part 11 is schematically described with a dashed line.

The radiative cooling material 85 is a material that uses a principle of "radiative cooling" to lower a temperature of the radiative cooling material 85 and an environmental temperature of a shadow opposite to a direct sunlight (hereinafter referred to as a shadow temperature) without using energy by releasing heat to space, even under direct sunlight. The radiative cooling material 85 can be used, for example, Radi-Cool material of Radi-Cool Japan Co., Ltd. Depending on sunlight conditions, the shadow temperature of the Radi-Cool material can be 10 to 20 degrees Celsius lower than the shadow temperature of typical fabrics.

In addition, as the radiative cooling material 85, for example, the radiative cooling material "SPACECOOL (registered trademark)" of SPACECOOL Co., Ltd. can be used.

The radiative cooling material 85 has a space on the cooling garment 1 and is secured with a fixing member 86.

An upper left-hand view in FIG. 36 is an enlarged view of an area around the fixing member 86.

The fixing member 86 includes a spacer 87 and a pin 88.

The spacer 87 is provided on a surface of the cooling garment 1 and has a spacer hole 95. A pin 88 is made of rubber and has a head part 93 and a convex part 94.

The radiative cooling material 85 has a radiative cooling material hole 91.

The convex part 94 of the pin 88 penetrates the radiative cooling material hole 91 and the convex part 94 is fitted into the spacer hole 95, thus the radiative cooling material 85 is fixed on the cooling garment 1 so as to have space between the radiative cooling material 85 and the cooling garment.

On the other hand, as the pin 88 can be removed from the spacer hole 95, the pin 88 can be removed from spacer hole 95 and the radiative cooling material 85 can be removed from the cooling garment 1.

Water vapor that vaporizes from the intermediate layer 31 of the cooling garment 1 and generates is released to an outside through the space formed by the spacer 87.

The cooling garment 1 and the radiative cooling material 85 may be in partial contact with each other if the water vapor generated by vaporizing from the intermediate layer 31 is released from the outside of the radiative cooling material 85.

An upper right-hand view in FIG. 36 is an enlarged view of a left person side.

A space is provided between the front side material 2 of the cooling garment 1 and the radiative cooling material 85. If the direct sunlight hits the radiative cooling material 85, the shadow temperature becomes lower by the radiative cooling material 85, thus a rise of the temperature of the water which occurred by the direct sunlight can be suppressed, the water being held in the intermediate layer 31 of the cooling garment 1.

Thus, an amount of the water vapor released from the intermediate layer 31 into the space becomes reduced, the body can be cooled for a long time.

A structure of the back side material 3 in FIG. 37 is similar to that of the front side material 2 in FIG. 36.

According to the above Embodiment, as the space is provided between the radiative cooling material 85 and the cooling garment 1, the radiative cooling material 85 lowers the shadow temperature, and the amount of the water vapor released from the intermediate layer 31 into the space becomes reduced, the body can be cooled for a longer time.

Embodiment 15

Embodiment 15 is an aspect of the cooling garment 108 that is adopted to, for example, elementary school and kindergarten children.

Figure 38A:
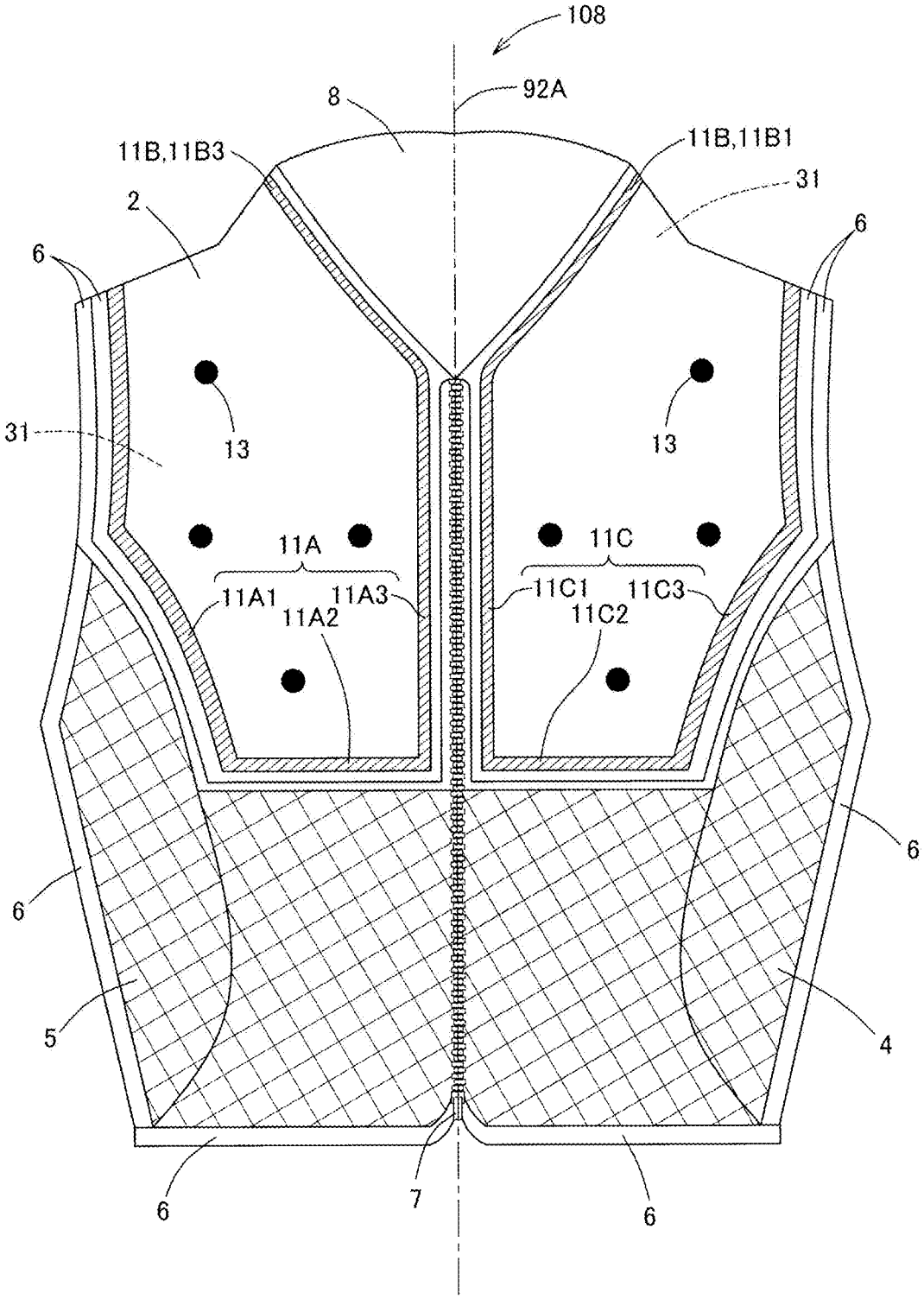
FIG. 38A is a front view of a schematic configuration of a cooling garment in Embodiment 15.
Figure 38B:
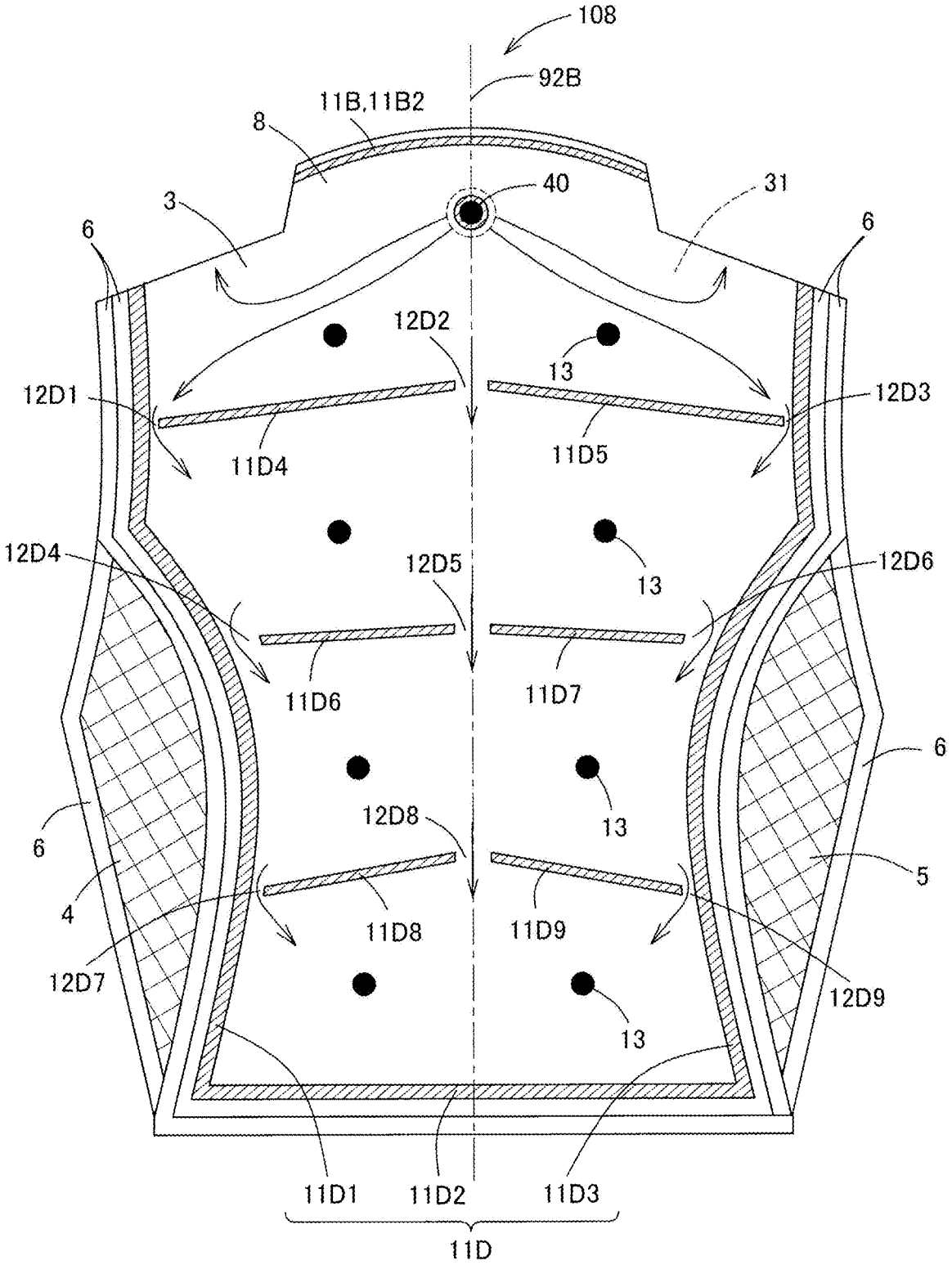
FIG. 38B is a rear view of a schematic of the cooling garment in Embodiment 15.

FIG. 38A is a front view of a schematic configuration of a cooling garment 108 in Embodiment 15 and FIG. 38B is a rear view of a schematic configuration of the cooling garment 108 in Embodiment 15.

As shown in FIG. 38A, the outer edge pressing bonding parts 11 (11A1, 11A2, 11A3, 11C1, 11C2, 11C3) are short constitutions not so as to cool the thorax and the abdomen of the front side material 2.

The abdomen consists of the mesh to improve a ventilation. The left side material 4 and the right side material 5 consist of rubber meshes and can stretch and shrink to accommodate changes in body size.

As shown in FIGS. 38A and 38B, the cooling garment 108 includes a collar 8 like a school uniform for junior high school boys.

The outer edge pressing bonding part 11B and the intermediate layer 31 is provided in the collar 8 and the collar 8 is also configured to cool the neck.

A neck side pressing bonding part 11B arranged around the neck connects with the outer edge pressing bonding part 11A and 11C, and constitutes the outer edge pressing bonding part 11.

The neck side pressing bonding part 11B has a neck side first pressing bonding part 11B1, a neck side second pressing bonding part 11B2 and a neck side third pressing bonding part 11B3, each of them is connected to the other so that a single line can be drawn.

The left front side first pressing bonding part 11C1 is connected to the neck side first pressing bonding part 11B1 and the right front side third pressing bonding part 11A3 is connected to the neck side third pressing bonding part 11B3.

As shown in FIG. 38B, the back side material 3 of Embodiment 15 is basically the same constitution as that of FIG. 22. A difference between FIG. 38B and FIG. 22 is that the collar 8 including the intermediate layer 31 and the water inlet drainage outlet 40 are provided in FIG. 38B.

The water inlet drainage outlet 40 is arranged in the collar 8. A center of the water inlet drainage outlet 40 passes through the centerline 92B.

As arrows indicate, the water supplied from the water inlet drainage outlet 40 moves in three main directions as follows.

(1) The water moves from the water inlet drainage outlet 40 to both shoulders and then moves from the both shoulders to the front side material 2.

(2) The water moves from the water inlet drainage outlet 40 toward the back side first air gap 12D1 and the back side third air gap 12D3 arranged on both sides of the back side material 3.

(3) The water moves from the water inlet drainage outlet 40 toward the back side second air gap 12D2 arranged in a center of the back side material 3.

As described above, the water can spread evenly over the front side material 2 and the back side material 3.

Since FIG. 38B has almost the same constitution as FIG. 22, the duplicated parts are omitted.

Embodiment 16

The cooling garment 109 of Embodiment 16 is an aspect that almost all of the front side material 2 is constituted of the mesh and the outer edge pressing bonding part portion (back side pressing bonding part portion) 11D surrounds the intermediate layer 31 of the back side material 3.

Figure 39A:
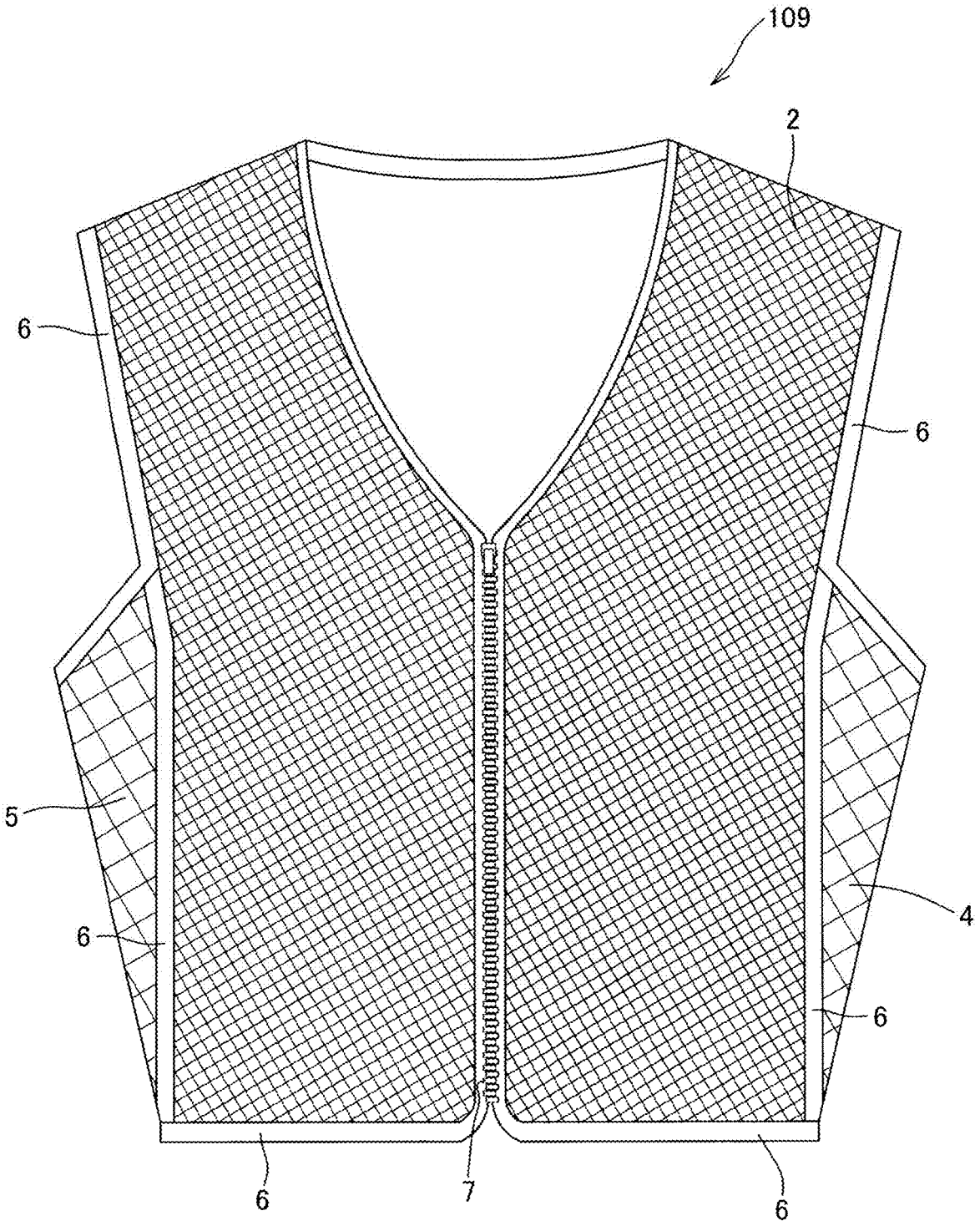
FIG. 39A is a front view of a schematic configuration of a cooling garment in Embodiment 16.
Figure 39B:
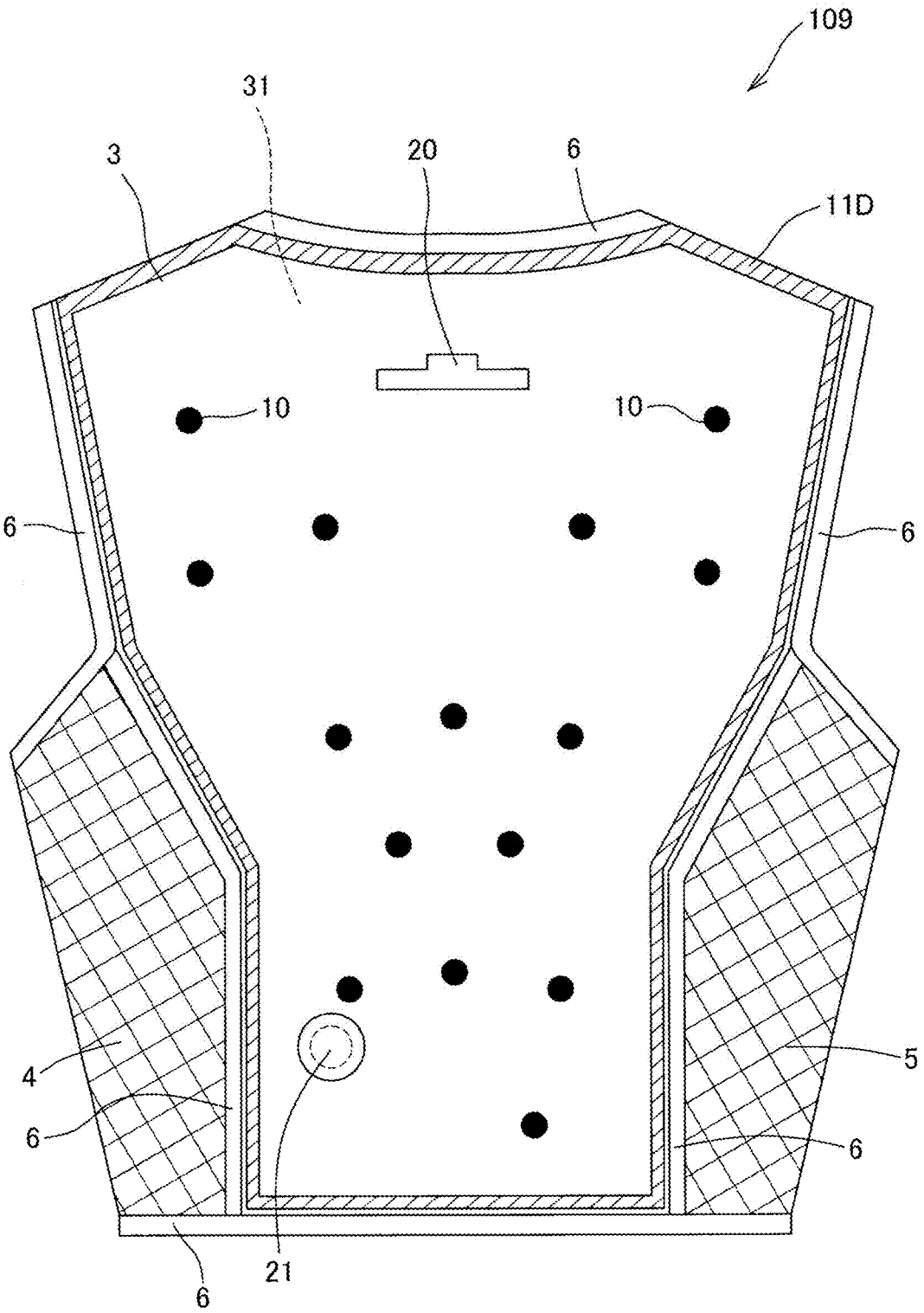
FIG. 39B is a rear view of a schematic configuration of a cooling garment in Embodiment 16.

FIG. 39A is a front view of a schematic configuration of the cooling garment 109 in Embodiment 16 and FIG. 39B is a rear view of a schematic configuration of the cooling garment 109 in Embodiment 16.

As shown in FIG. 39A, almost all of the front side material 2 of the cooling garment 109 is constituted of the mesh and the front side material 2 of the cooling garment 109 does not include the outer layer 30, the intermediate layer 31, and the inner layer 32.

A coarseness of the mesh of the front side material 2 is equivalent to a coarseness of the mesh of the left side material 4 or the right side material 5.

The coarseness of the mesh of the front side material 2 may be coarser or finer than the coarseness of the mesh of the left side material 4 or the right side material 5.

As shown in FIG. 39B, the back side material 3 of the cooling garment 109 includes the outer layer 30, the intermediate layer 31 and the inner layer 32.

The back side material 3 of the cooling garment 109 is a modification of the back side material 3 of FIG. 2 in Embodiment 1

The water inlet 20 is provided on the upper part and a cap-type drainage outlet 21 is provided on the lower part in the back side material 3 of the cooling garment. The drainage outlet 21 can be a lid type like the water inlet 20.

The intermediate layer 31 is surrounded by the pressing bonding part 11D (back side pressing bonding part 11D) where the outer layer 30 and the inner layer 32 are pressed or bonded around the outer edge of the back side material 3 of the cooling garment 109.

According to the above Embodiment, since the front side material 2 constitutes the mesh, sweat that evaporates from the body can be discharged through the mesh, thus an amount of a stuffiness can become reduced.

In addition, since sweat does not remain in the front side material 2, it is difficult for sweat odor to adhere to the front side material 2.

In addition, the water is supplied to only the intermediate layer 31 of the back side material 3 in the cooling garment 109.

Thus, an amount of the water poured can be reduced and a weight of the cooling garment 109 can be reduced.

The above effects are especially effective during hot weather, such as summer.

Embodiment 17

The cooling garment 110 in Embodiment 17 is an aspect that a design of the outside of the cooling garment 110 is considered, and the water inlet 20 and the drainage outlet 21 are arranged on the inside of the cooling garment 110.

Figure 40:
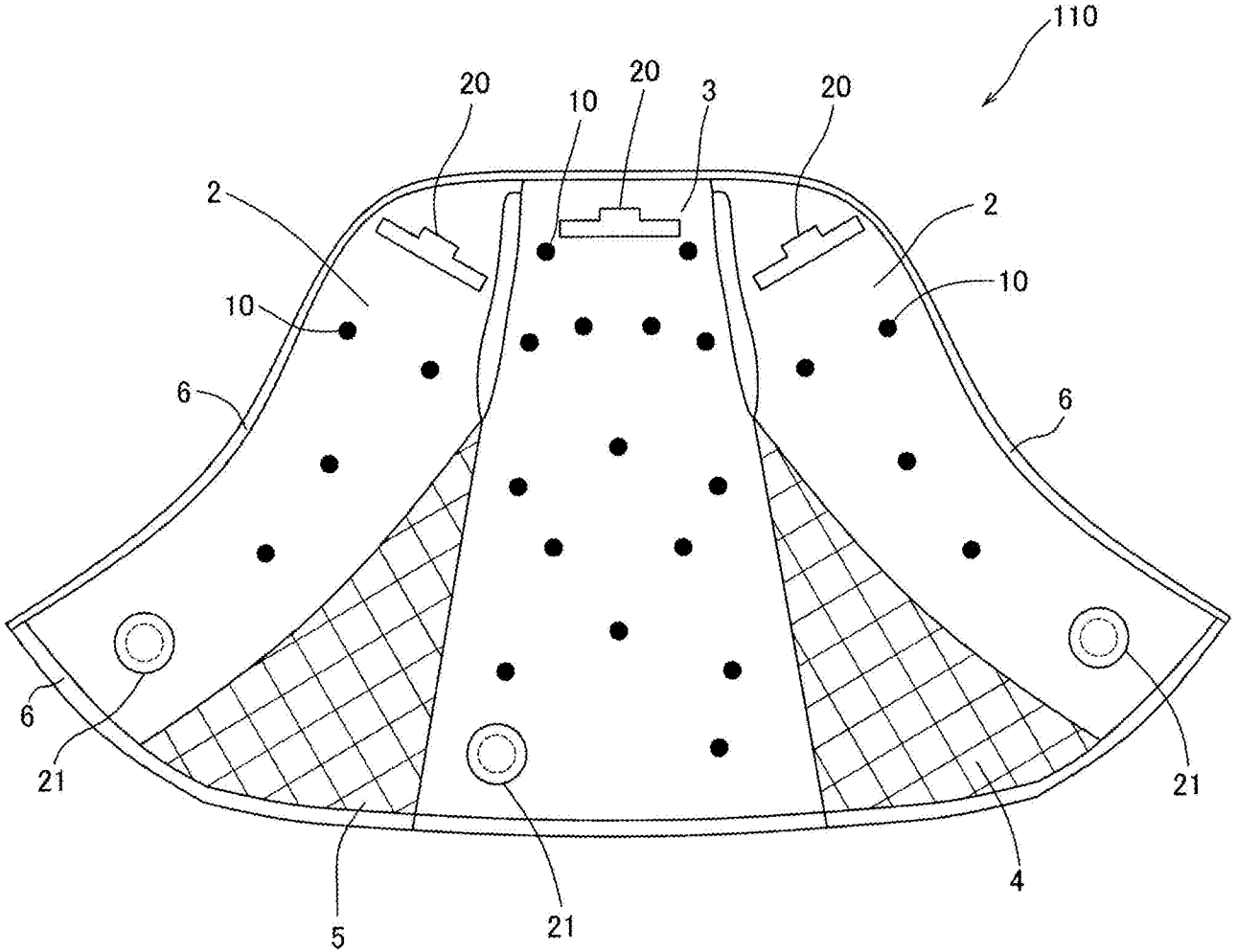
FIG. 40 is an inside view of a schematic configuration of a cooling garment in Embodiment 17.

FIG. 40 is a schematic view of a schematic configuration illustrating the inside of the cooling garment 109 in Embodiment 17.

As shown in FIG. 40, the water inlets 20 are provided on the right and left sides of the upper inside of the front side material 2 and the water inlets 20 are provided on the upper inside of the back side material 3.

In addition, the drainage outlets 21 are provided on the right and left sides of the lower inside of the front side material 2 and the drainage outlets 21 are provided on the lower inside of the back side material 3.

At least one the water inlet 20 and at least one the drainage outlet 21 may be provided on any one of the insides of the right side of the front side material 2, the inside of the left of the front side material 2 or the inside of the back side material 3.

For example, the one water inlet 20 may be provided on the upper inside of the back side material 3 and the one drainage outlet 21 may be provided on the lower inside of the right side of the front side material 2 in the cooling garment 110.

According to the above Embodiment, since the cooling garment 110 has the same water pouring and draining functions as the cooling garment 1 of Embodiment 1 and the water inlet 20 and the drainage outlet 21 are arranged inside the cooling garment 110, so damaging a design of the outside of the cooling garment 110 is prevented.

Since the water inlet 20 and the drainage outlet 21 are provided inside the cooling garment 110, opening the lid of the water inlet 20 or the drainage outlet 21 can be prevented in a case where the lid of the water inlet 20 or the drainage outlet 21 is snagged on an object.

In Embodiment 1, the left side material 4 and the right side material 5 are made of the stretchable material, but as shown in FIG. 20, the adjuster 44 that can adjust a length may be provided. The left side material 4 may also be made of a non-stretchable material and the adjuster 44 may be provided.

In addition, the water inlet 20 or the drainage outlet 21 in Embodiment 1 may be constituted of the cap of Embodiment 3.

In FIG. 9, the drainage outlets 21 are provided at the three lower part of the back side material 3, but one drainage outlet 21 may be provided only at the center, only at the right end, or they may be provided both at the center and the right end.

In FIG. 10, the water inlet 20 and the drainage outlet 21 are provided at two locations on the left and right sides of the front side material 2, but either one on the left or right side can be used.

In FIGS. 21, 22, and 38B, four areas are provided in the front side material 2 and the back side material 3, but providing at least two or more areas is sufficient.

In Embodiment 1, the aspect that the material of the inner layer 32 and/or the material of the outer layer 30 is treated with the antistatic treatment using antistatic yarn and other materials is described.

However, the present disclosure may include following aspects without using antistatic yarn and other materials as the material of the inner layer 32 and/or the material of the outer layer 30.

The aspect is an aspect using a spin tape having antistatic (preventing static electricity) properties.

The spin tape is made from a material kneaded a conductive material inside fibers of conductive yarn.

The spin tape is sewn onto a front surface and/or a back surface of the garment.

The spin tape may be adhered to the front surface and/or back surface of the garment by bonding, joining, or welding.

For the spin tape, for example, "STA-GUARD SPIN TAPE" of Tokai Thermo Co., Ltd. can be used.

For the spin tape, for example, "STC60" of SHINDO Co., Ltd. can be used.

The spin tape is arranged at an arbitrary position on the cooling garment, such as at the shoulders, the person sides, and the sides of the cooling garment.

In addition, the above present inventions may be substituted or combined as long as there is no contradiction.

As described above, the present disclosure includes a cooling garment, a cooling garment set and a method of wearing the cooling garment set as described in the following items.

Item 1

A cooling garment including:

a front side material arranged on a front side of a body; and a back side material arranged on a back side of the body, wherein the front side material or the back side material has an inner layer arranged closest to the body, which is waterproof;

an outer layer arranged farthest from the body, which is moisture permeable; and an intermediate layer made of a nonwoven fabric that is arranged between the inner layer and the outer layer, and that absorbs water and stores the absorbed water, wherein a water inlet that supplies the water to the intermediate layer is arranged on an upper part of the front side material or the back side material and a drainage outlet that drains the water absorbed by the intermediate layer is arranged on a lower part of the front side material or the back side material when the cooling garment is attached to the body.

According to the above aspect, the body temperature can be lowered without using electric power. In addition, since the cooling garment can easily repeat operations of pouring the water and draining the water, the body temperature can be lowered throughout the day by repeating the above operation multiple times a day.

Item 2

The cooling garment according to item 1, wherein the front side material or the back side material has a hole through the front side material or the back side material, a pressing bonding part that is a part where the outer layer and the inner layer are adhered to each other around the hole, a water holding part that has an air gap arranged around the pressing bonding part and between the outer layer and the inner layer, the air gap temporarily holding the water.

According to the above aspect, since the water can be held in the water holding part, thus the temperature of the body can be lowered for long time.

Item 3

The cooling garment according to item 2, wherein the water holding parts are plural, wherein the plurality of water holding parts are arranged in a staggered pattern.

According to the above aspect, since the water holding parts are arranged in a staggered manner and the water can be held in the water holding parts, so the body can be cooled for long time. In addition, since the direction of the water flowing from the water holding part arranged at the bottom faces the drainage outlet, the water can be discharged smoothly when the water is discharged.

Item 4

The cooling garment according to item 1, wherein the water inlet is arranged on an inner upper part of the front side material or the back side material and the drainage outlet is arranged on an inner lower part of the front side material or the back side material.

According to the above aspect, since the cooling garment has the same water pouring and water draining functions as the cooling garment of Embodiment 1 and the water inlet and the drainage outlet are provided inside of the cooling garment, the aspect can prevent the design of the outside of the cooling garment from being spoiled.

In addition, since the water inlet and the drainage outlet are provided inside the cooling garment, the aspect can prevent the lids of the water inlet or the drainage outlet from opening when they catch on an object.

Item 5

A cooling garment including:

a front side material arranged on a front side of a body; and a back side material arranged on a back side of the body, wherein the front side material or the back side material has an inner layer arranged closest to the body, which is waterproof;

an outer layer arranged farthest from the body, which is moisture permeable; and an intermediate layer made of a nonwoven fabric that is arranged between the inner layer and the outer layer, and that absorbs water and stores the absorbed water, wherein the front side material or the back side material has a slope pressing bonding part that is a part where the outer layer and the inner layer are adhered to each other, wherein the slope pressing bonding part is inclined with respect to a horizontal line perpendicular to a centerline of a longitudinal direction of the cooling garment so that the water moves from an upper part of the cooling garment toward a lower part of the cooling garment by gravity when the cooling garment is attached to the body.

According to the above aspect, the slope pressing bonding part can slow the speed of the water falling to the lower part and the body can be cooled for long time.

Item 6

The cooling garment according to item 4, wherein the slope pressing bonding part includes a first slope pressing bonding part and a second slope pressing bonding part, one end of the first slope pressing bonding part and one end of the second slope pressing bonding part are connected at a connection point, wherein the first slope pressing bonding part and the second slope pressing bonding part are mountainous shape of which an apex is the connection point when the cooling garment is attached to the body.

According to the above aspect, the first slope pressing bonding part and the second slope pressing bonding part, with their mountainous shape, can slow the speed of the water falling to the lower side and spread the water to both sides of the cooling garment.

Item 7

The cooling garment according to items 5 or 6, wherein the slope pressing bonding part includes a first slope pressing bonding part and a second slope pressing bonding part, one end of the first slope pressing bonding part and one end of the second slope pressing bonding part are arranged with a gap, wherein the first slope pressing bonding part and the second slope pressing bonding part are mountainous shape of which an apex is the gap when the cooling garment is attached to the body.

According to the above aspect, since the air gap is provided near the apex of the first slope pressing bonding part and the second slope pressing bonding part with the mountain shape, the water can be dropped from the center of the cooling garment to the lower side of it and the water can be spread over the cooling garment.

Item 8

The cooling garment according to items 6 or 7, wherein the front side material or the back side material includes an outer edge pressing bonding part along the outer edge of the front side material or the back side material, wherein air gaps are arranged between the outer edge pressing bonding part and the other end of the first slope pressing bonding part and between the outer edge pressing bonding part and the other end of the second slope pressing bonding part.

According to the above aspect, since the water can be dropped from the center and both sides of the cooling garment to the lower side, the water can be spread evenly in the cooling garment.

Item 9

A cooling garment including:

a front side material arranged on a front side of a body; and a back side material arranged on a back side of the body, wherein the front side material is constituted of a mesh, wherein the back side material has an inner layer arranged closest to the body, which is waterproof;

an outer layer arranged farthest from the body, which is moisture permeable; and an intermediate layer made of a nonwoven fabric that is arranged between the inner layer and the outer layer, and that absorbs water and stores the absorbed water, wherein the front side material or the back side material includes a pressing bonding part that is a part where the outer layer and the inner layer are adhered to each other, wherein the intermediate layer is divided into several parts, wherein the pressing bonding part of the front side material or the back side material surrounds around the intermediate layers divided through an air gap when the cooling garment is attached to the body.

According to the above aspect, since the cooling garment is divided into several pieces and the speed of the water falling to the lower side can be slowed and the body can be cooled for long time.

Item 10

A cooling garment including:

a front side material arranged on a front side of a body; and a back side material arranged on a back side of the body, wherein the front side material or the back side material has an inner layer arranged closest to the body, which is waterproof;

an outer layer arranged farthest from the body, which is moisture permeable; and an intermediate layer made of a nonwoven fabric that is arranged between the inner layer and the outer layer, and that absorbs water and stores the absorbed water, wherein the front side material or the back side material includes a pressing bonding part that is a part where the outer layer and the inner layer are adhered to each other, wherein the intermediate layer is surrounded by the pressing bonding part.

According to the above aspect, since the front side material is constituted of mesh, sweat released from the body can be discharged through the mesh, sweaty steam ca be reduced. In addition, sweat does not remain in the front side material, so the front side material is less prone to attach sweat odor.

In addition, the water is supplied to the intermediate layer only in the back side material. Thus, the amount of the water to be poured can be reduced, and the weight of the cooling garment can be reduced.

Item 11

A cooling garment set including:

the cooling garment according to any one of items 1 to 10 that is arranged close to the body; and air conditioning function garment that lowers the body temperature with an airflow fan and is arranged outside the cooling garment.

According to the above aspect, the air conditioning function garment allows outside air to be supplied into the surface of the cooling garment, the vaporization of the water in the cooling garment can promote and the temperature of the body can be lowered fast.

Item 12

A method for wearing a cooling garment set includes a cooling garment and an air conditioning function garment including:

(i) wearing the air conditioning function garment with a fan stopped over the cooling garment, and then rotating the fan of the air conditioning function garment; or (ii) wearing the air conditioning function garment with the fan rotating over the cooling garment;

wherein the cooling garment includes a front side material arranged on a front side of a body and a back side material arranged on a back side of the body wherein the front side material or the back side material has an inner layer arranged closest to the body, which is waterproof;

an outer layer arranged farthest from the body, which is moisture permeable; and an intermediate layer made of a nonwoven fabric that is arranged between the inner layer and the outer layer, and that absorbs water and stores the absorbed water, wherein a water inlet that supplies the water to the intermediate layer is arranged on an upper part of the front side material or the back side material and a drainage outlet that drains the water absorbed by the intermediate layer is arranged on a lower part of the front side material or the back side material when the cooling garment is attached to the body.

According to the above aspect, since the air conditioning function garment allows outside air to be supplied into the surface of the cooling garment, the vaporization of the water in the cooling garment can promote and the temperature of the body can be lowered fast.

INDUSTRIAL APPLICABILITY

This disclosure is a cooling garment and could achieve the third goal of the Sustainable Development Goals (SDGs), which is to "ensure the healthy lives and promote the well-being of all people of all ages.

The cooling garment of the present disclosure is power-saving because it does not use electricity and can cool the bodies of children and the elderly evenly and gently, thereby preventing heat stroke, the cooling garment can contribute to an achievement of the third goal of the Sustainable Development Goals (SDGs), the third goal being that "healthy lives are ensured and well-being of all people of all ages is promoted".

REFERENCE SIGNS LIST

1: 100-110 cooling garment
2: front side material
3: back side material
13: water holding part
20: water inlet
21: drainage outlet
30: outer layer
31: intermediate layer
32: inner layer
40: water inlet drainage outlet
42: pockets
43: refrigerant
50: air conditioning function garment
51: fan
61: right side front first area
62: right side front second area
63: right side front third area
64: right side front forth area
65: left side front first area
66: left side front second area
67: left side front third area
68: left side front forth area
71: back side first area
72: back side second area
73: back side third area
74: back side forth area
81: collar
11A, 11B, 11C, 11D: outer edge pressing bonding part

11A4-A6: slope pressing bonding part
11C4-C6: slope pressing bonding part
11D4: first slope pressing bonding part
11D5: second slope pressing bonding part
11D6: third slope pressing bonding part
11D7: fourth slope pressing bonding part
11D8: fifth slope pressing bonding part
11D9: sixth slope pressing bonding part
12A1-A3: right side front first-third air gap
12C1-C3: left side front first-third air gap
12D1-D9: back side first-nineth air gap

The invention claimed is:

1. A cooling garment comprising:

a front side material arranged on a front side of a body; and a back side material arranged on a back side of the body, wherein the front side material or the back side material has an inner layer arranged closest to the body, wherein the inner layer is waterproof;

an outer layer arranged farthest from the body, wherein the outer layer is moisture permeable; and an intermediate layer made of a nonwoven fabric that is arranged between the inner layer and the outer layer, and that absorbs water and stores the absorbed water, wherein a water inlet adapted to receive water to the intermediate layer is arranged on an upper part of the front side material or the back side material and a drainage outlet adapted to drain water in the intermediate layer away from the cooling garment is arranged on a lower part of the front side material or the back side material when the cooling garment is attached to the body, and wherein the front side material or the back side material has:

a hole penetrates the front side material or the back side material;

a pressing bonding part that is a part where the outer layer and the inner layer are adhered to each other around the hole; and a water holding part that has an air gap arranged around the pressing bonding part and between the outer layer and the inner layer, the air gap is adapted to temporarily hold water.

2. The cooling garment according to claim 1, wherein the water holding parts are plural, wherein the plurality of water holding parts are arranged in a staggered pattern.

3. The cooling garment according to claim 1, wherein the water inlet is arranged on an inner upper part of the front side material or the back side material and the drainage outlet is arranged on an inner lower part of the front side material or the back side material.

4. A method for wearing a cooling garment set includes the cooling garment of claim 1 and an air conditioning function garment, comprising:

putting the cooling garment on a subject in need thereof, and putting the air conditioning function garment over the cooling garment, wherein the air conditioning function garment has a fan.

* * * * *